US011751633B2

(12) United States Patent
Burns et al.

(10) Patent No.: US 11,751,633 B2
(45) Date of Patent: Sep. 12, 2023

(54) DEVICES AND METHODS FOR ENHANCING THE FIT OF BOOTS AND OTHER FOOTWEAR

(71) Applicant: Boa Technology Inc., Denver, CO (US)

(72) Inventors: Robert Burns, Denver, CO (US); Charles Hamilton, Northville, MI (US); Ilya Minkin, Denver, CO (US); Rebecca Peterson, Denver, CO (US); Aaron Venturini, Littleton, CO (US); Tamara White, Denver, CO (US)

(73) Assignee: BOA TECHNOLOGY, INC., Denver, CO (US)

( * ) Notice: Subject to any disclaimer, the term of this patent is extended or adjusted under 35 U.S.C. 154(b) by 313 days.

(21) Appl. No.: 16/655,073

(22) Filed: Oct. 16, 2019

(65) Prior Publication Data

US 2020/0046080 A1 Feb. 13, 2020

Related U.S. Application Data

(63) Continuation of application No. 15/598,174, filed on May 17, 2017, now Pat. No. 10,492,568, which is a continuation of application No. 14/839,613, filed on Aug. 28, 2015, now abandoned.

(60) Provisional application No. 62/056,264, filed on Sep. 26, 2014, provisional application No. 62/043,209, filed on Aug. 28, 2014.

(51) Int. Cl.

| | |
|---|---|
| ***A43C 11/16*** | (2006.01) |
| ***A45F 5/02*** | (2006.01) |
| *A45C 13/10* | (2006.01) |
| *A41F 1/00* | (2006.01) |

(52) U.S. Cl.
CPC ..... *A43C 11/165* (2013.01); *A45F 5/02* (2013.01); *A41F 1/00* (2013.01); *A45C 13/1046* (2013.01)

(58) Field of Classification Search
CPC ..... A43C 11/165
See application file for complete search history.

(56) References Cited

U.S. PATENT DOCUMENTS

| | | | | |
|---|---|---|---|---|
| 3,522,668 A * | 8/1970 | Fesl | ..... | A43B 7/1495 36/117.9 |
| 4,030,215 A * | 6/1977 | Vogel | ..... | B29D 35/061 36/119.1 |
| 4,660,303 A * | 4/1987 | Courvoisier | ..... | A43B 5/0447 36/117.9 |

(Continued)

*Primary Examiner* — Jila M Mohandesi
(74) *Attorney, Agent, or Firm* — Kilpatrick Townsend & Stockton LLP

(57) ABSTRACT

A closure system for a boot or other footwear includes a tension member that is disposed within the boot and routed or guided about a path within the boot via one or more guides. The closure system also includes an adjustment member that is disposed within the boot and operably coupled with the tension member. The closure system further includes a reel based closure device having a knob that is operable to tension the tension member and to release tension from the tension member. Tensioning of the tension member adjusts a fit of the adjustment member about a foot within the boot to secure the foot within the boot and loosening of the tension member adjusts the fit of the adjustment member about the foot to allow the foot to be more easily removed from the boot.

20 Claims, 45 Drawing Sheets

(56) References Cited

U.S. PATENT DOCUMENTS

| | | | | |
|---|---|---|---|---|
| 4,937,953 | A * | 7/1990 | Walkhoff | A43B 5/0449 36/118.1 |
| 5,704,138 | A * | 1/1998 | Donnadieu | A43B 7/1495 36/50.1 |
| 6,792,702 | B2 * | 9/2004 | Borsoi | A43B 5/0401 36/117.6 |
| 7,818,899 | B2 * | 10/2010 | Dinndorf | A43B 7/14 36/88 |
| 8,381,362 | B2 | 2/2013 | Hammerslag et al. | |
| 8,468,657 | B2 | 6/2013 | Soderberg et al. | |
| 8,984,719 | B2 | 3/2015 | Soderberg et al. | |
| 9,439,477 | B2 | 9/2016 | Neiley | |
| 9,480,299 | B2 * | 11/2016 | Dinndorf | A43B 23/07 |
| 9,681,705 | B2 | 6/2017 | Trudel et al. | |
| 9,706,814 | B2 | 7/2017 | Converse et al. | |
| 9,770,070 | B2 | 9/2017 | Cotterman et al. | |
| 10,102,566 | B2 | 10/2018 | Joshi et al. | |
| 2005/0022427 | A1 * | 2/2005 | Kerns | A43C 11/165 36/50.1 |
| 2006/0156517 | A1 * | 7/2006 | Hammerslag | A43C 1/04 24/68 SK |
| 2006/0254093 | A1 * | 11/2006 | Fuchslocher | A43B 13/188 36/103 |

* cited by examiner

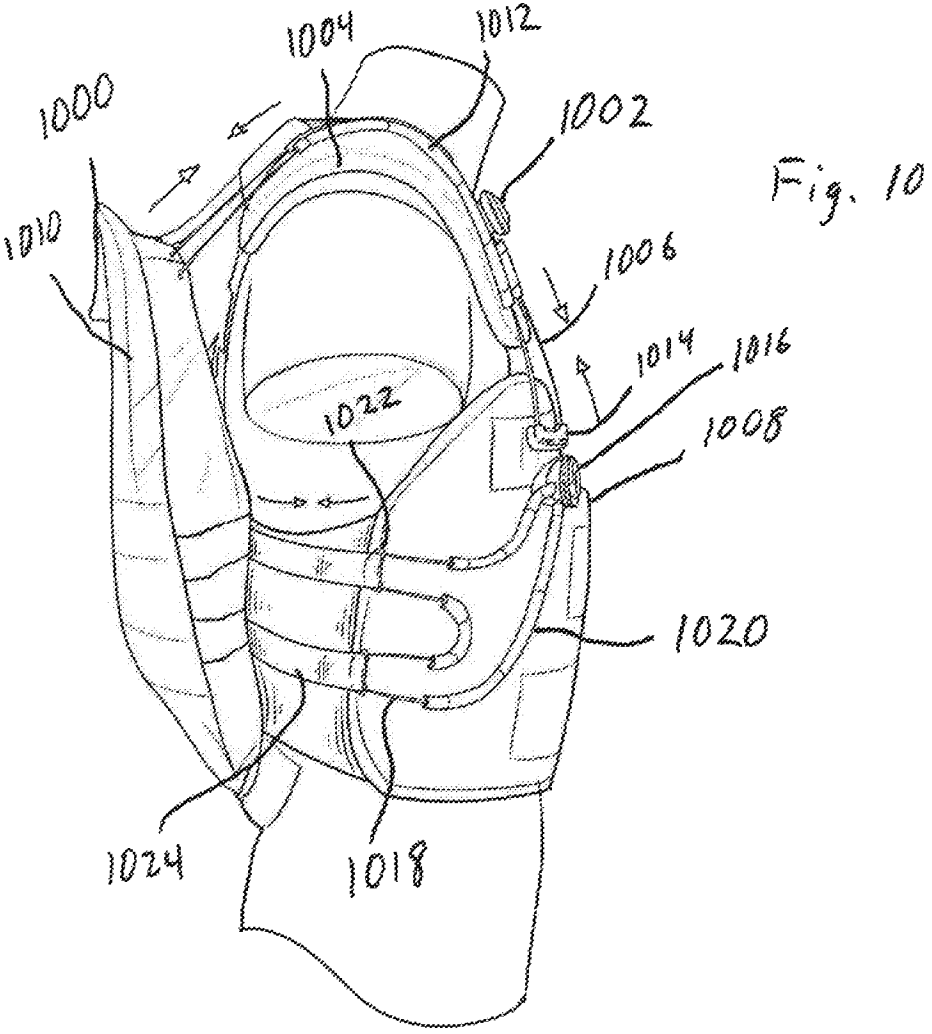
Fig. 10
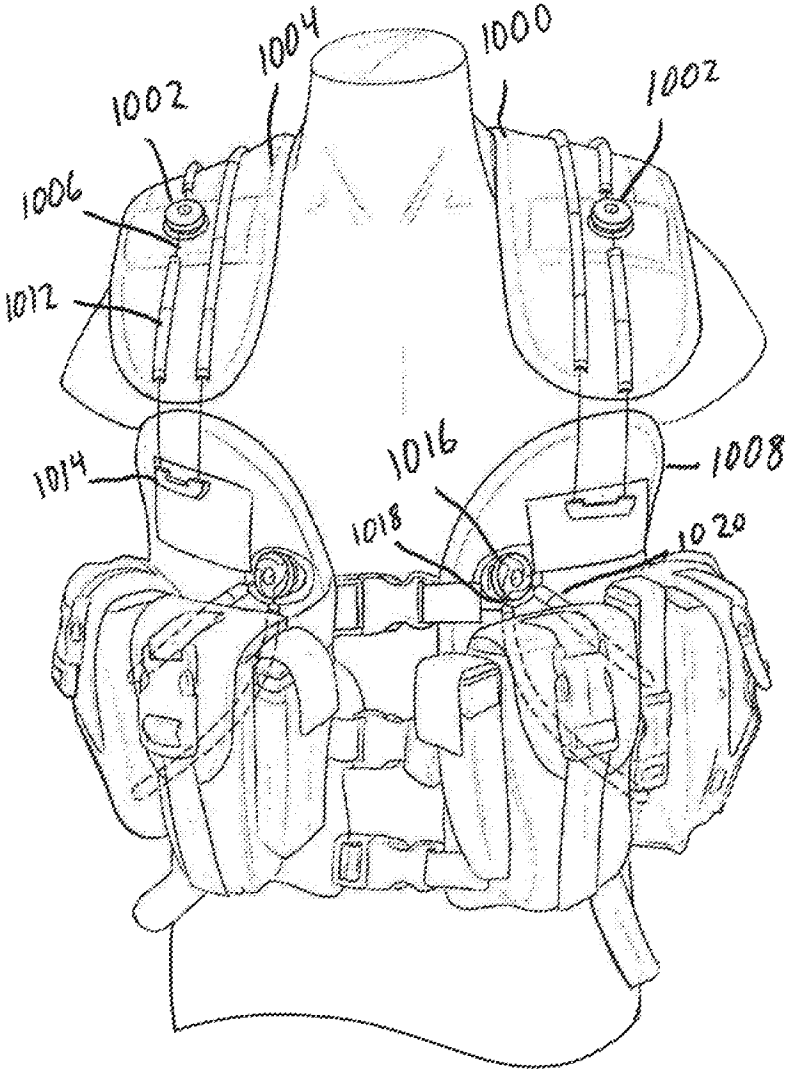

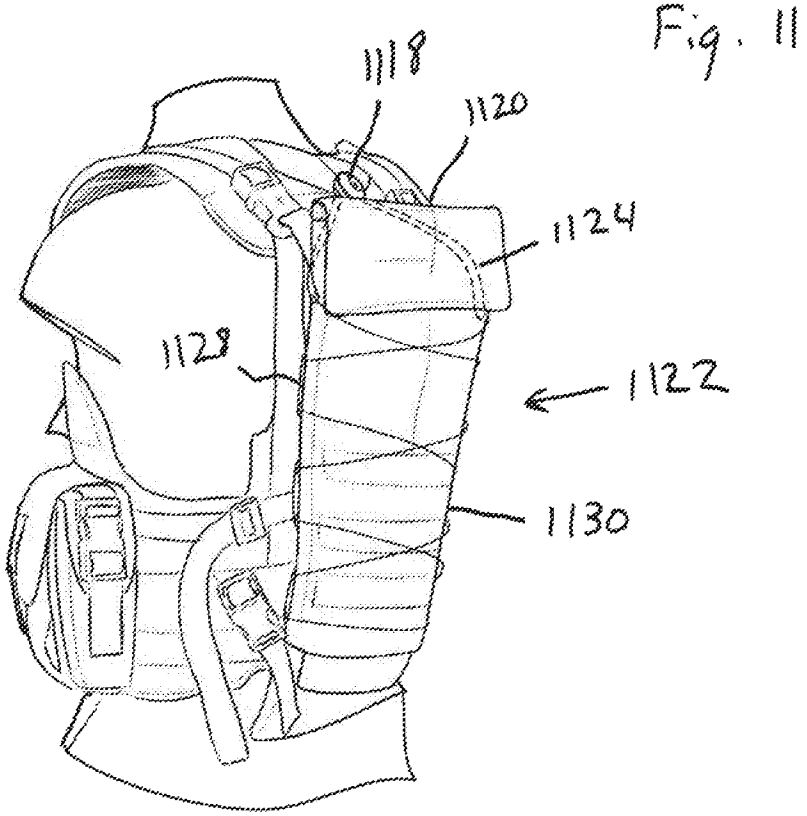
Fig. 11
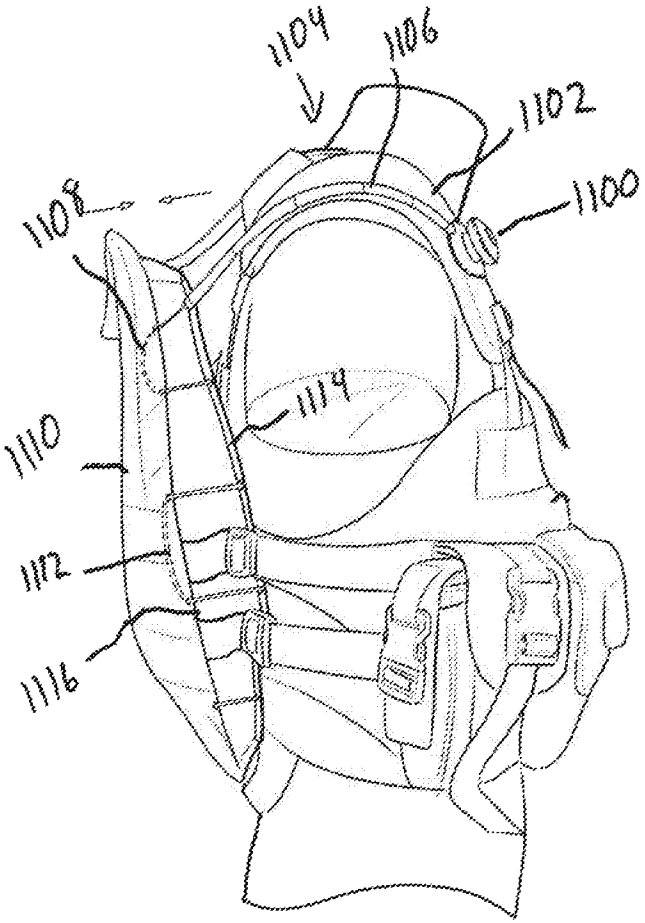

DEVICES AND METHODS FOR ENHANCING THE FIT OF BOOTS AND OTHER FOOTWEAR

CROSS-REFERENCE TO RELATED APPLICATIONS

This application is a continuation of U.S. patent application Ser. No. 15/598,174, filed May 17, 2017, which is a continuation of U.S. patent application Ser. No. 14/839,613, filed Aug. 28, 2015, now abandoned, which claims priority to U.S. Provisional Patent Application No. 62/043,209, filed on Aug. 28, 2014 and U.S. Provisional Patent Application No. 62/056,264, filed on Sep. 26, 2014, the disclosures of which are hereby incorporated by reference in their entirety for all purposes.

BACKGROUND

Many individuals wear boots and other footwear having an extended ankle portion or collar that covers and supports the ankle. These types of footwear are often worn for various aesthetic and/or functional reasons. Given the extended ankle or collar, these types of footwear are often made to easily slip on and off the foot. A disadvantage of these types of footwear, however, is that some of them may not be secured tightly to the foot. Rather, the footwear may remain rather loose about the foot, which may irritate the foot and/or the individual after extended use. As such, it may be desirable in some instances to configure this type of footwear so as to be easily donned and doffed, yet secured tightly to the foot.

BRIEF DESCRIPTION OF THE INVENTION

Embodiments described herein provide various closure devices that may be used to tighten boots or other types of footwear that typically have an extended ankle portion, although the closure devices described herein may also be used to close and/or tighten various "low-top" footwear. According to one aspect, a closure system for a footwear includes a tension member, a fit adjustment member, and a reel based closure device. The footwear may have a foot portion that is configured to fit around the foot of a wearer and an extended ankle portion that extends upward from the foot portion substantially above the wearer's ankle.

The tension member of the closure system is disposed within the footwear and routed or guided about a path within the footwear. The fit adjustment member of the closure system is disposed within the footwear and operably coupled with the tension member. The reel based closure device of the closure system includes a knob. The reel based closure device is operably coupled with the tension member so as to tension the tension member upon operation of the knob and to loosen the tension member. Tensioning of the tension member effects adjustment of the fit adjustment member relative to the wearer's foot to secure the foot within the footwear. Similarly, loosening of the tension member allows the fit adjustment member to be loosened from about the foot to enable the wearer to more easily remove the foot from the footwear.

In some embodiments, the fit adjustment member includes at least one strap that is positioned within the footwear so as to wind around at least a portion of the wearer's foot. In such embodiments, the at least one strap may be positioned within the footwear to encircle the foot at least once. A portion of the at least one strap may be slidingly disposed within a sole of the footwear. The at least one strap may be configured to constrict about the wearer's foot.

In other embodiments, the fit adjustment member may include a sleeve, liner, or shell that is disposed within the footwear. The tension member may be coupled with at least one side of the sleeve, liner, or shell so as to move the sleeve, liner, or shell inward and toward the wearer's foot upon tensioning of the tension member. In such embodiments, a second side of the sleeve, liner, or shell that is opposite the at least one side may be coupled with the footwear such that tensioning of the tension member causes the sleeve, liner, or shell to fold or pivot about the second side of the sleeve, liner, or shell. In other embodiments, the tension member may be coupled with opposing sides or edges of the sleeve, liner, or shell such that both opposing sides or edges of the sleeve, liner, or shell move inward and toward the wearer's foot upon tensioning of the tension member. In some embodiments, the fit adjustment member may be configured to press inward against a sleeve, liner, or tongue portion of the footwear.

According to another aspect, a closure system for a boot includes a tension member that is disposed within the boot and routed or guided about a path within the boot via one or more guides. The closure system also includes an adjustment member that is disposed within the boot and operably coupled with the tension member. The closure system further includes a reel based closure device having a knob that is operable to tension the tension member and to release tension from the tension member. Tensioning of the tension member may tighten a fit of the adjustment member about a foot within the boot to secure the foot within the boot and loosening of the tension member may loosen the fit of the adjustment member about the foot within the boot to allow the foot to be more easily removed from the boot.

In some embodiments, the adjustment member includes at least one strap that is positioned within the boot so as to wind around at least a portion of the foot. In such embodiments, the at least one strap may be positioned within the boot to encircle the foot at least once. A portion of the at least one strap may be slidingly disposed within a sole of the boot and/or the at least one strap may be configured to constrict about the foot.

In alternative or additional embodiments, the adjustment member includes a sleeve, liner, or shell that is disposed within the boot. The tension member may be coupled with at least one side of the sleeve, liner, or shell so as to move the sleeve, liner, or shell inward and toward the foot upon tensioning of the tension member. In such embodiments, a second side of the sleeve, liner, or shell that is opposite the at least one side may be coupled with the boot such that tensioning of the tension member causes the sleeve, liner, or shell to fold or pivot about the second side of the sleeve, liner, or shell. In other embodiments, the tension member may be coupled with opposing sides or edges of the sleeve, liner, or shell such that the opposing sides or edges of the sleeve, liner, or shell move inward and toward the foot upon tensioning of the tension member. The adjustment member may also be configured to press inward against a sleeve, liner, or tongue portion of the boot.

BRIEF DESCRIPTION OF THE DRAWINGS

The present invention is described in conjunction with the appended figures:

FIGS. 10-12 illustrate tensioning devices that adjust a position or fit of a backpack.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Accessories for Military and Other Apparel

FIGS. 1-27 provide devices and systems that help ensure the fit and securement of gear, especially tactical gear used by military personnel. Gear for military personnel must often be worn or equipped for prolonged periods and as such, a comfortable yet secure fit is desirable. For instance, helmets and armor that are not properly secured may fall off or leave parts of the wearer's body uncovered. Further, ill-fitting armor may reduce the mobility of the wearer as flexibility may be limited. Packs and other storage gear that are loose may produce excess force on a wearer's body, such as an ill-fitting backpack causing pain and fatigue to a wearer's shoulder and back. Additionally, the ill-fitting equipment may make moving difficult and uncomfortable. A proper fit of all equipment can ensure maximum safety and mobility for the wearer.

Figure 1:
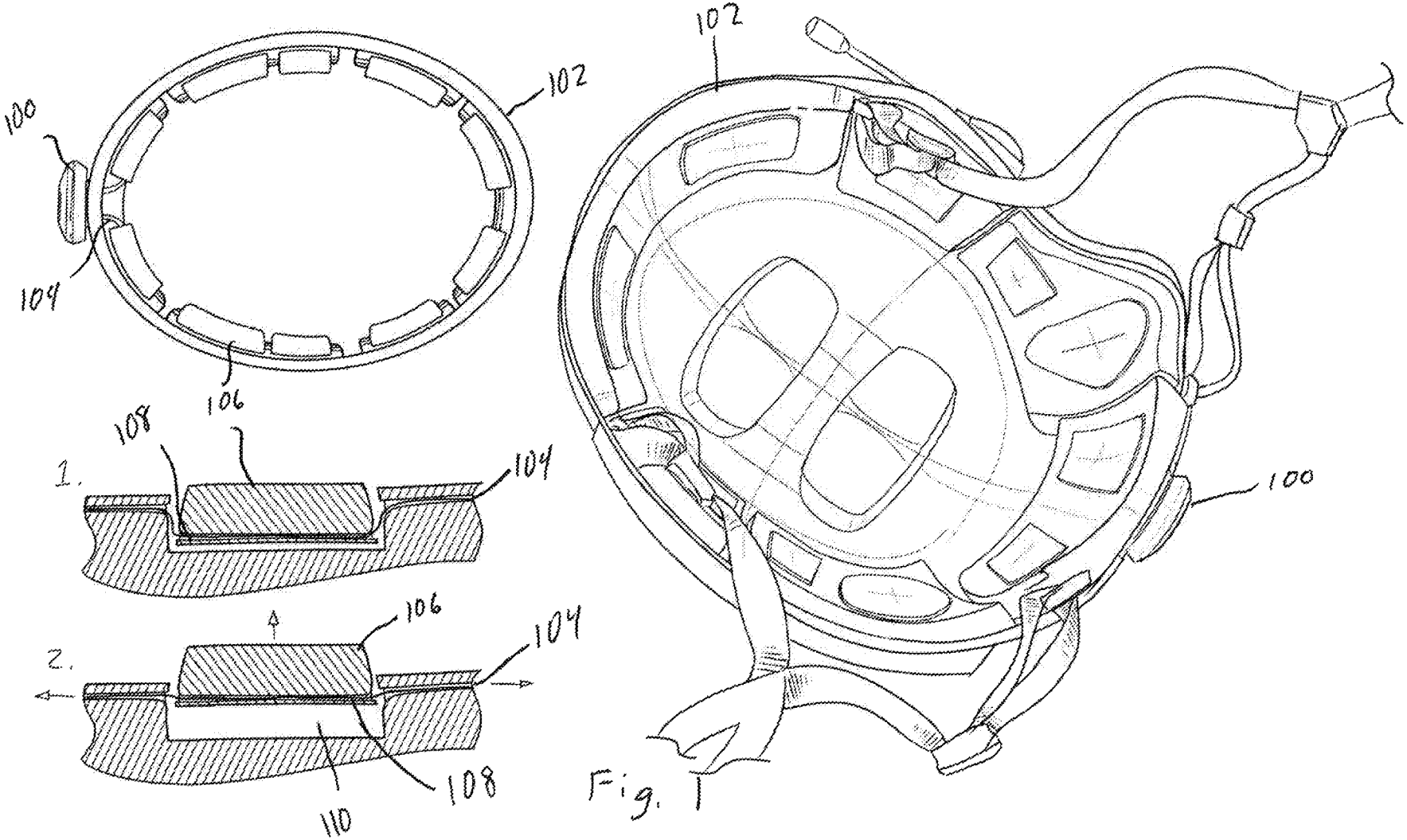
FIGS. 1-9 illustrate tensioning systems for adjusting and securing various equipment, such as helmets and/or masks.

FIGS. 1-9 illustrate tensioning systems for adjusting and securing various equipment, such as helmets and/or masks. FIG. 1 shows a tensioning device or reel 100, such as a reel as described in the following U.S. Patent Applications, each of which is incorporated by reference herein: U.S. patent application Ser. No. 14/071,435, U.S. patent application Ser. No. 14/328,521, U.S. patent application Ser. No. 12/623,362, U.S. patent application Ser. No. 12/853,141, U.S. patent application Ser. No. 13/865,951, U.S. patent application Ser. No. 14/297,047, and U.S. patent application Ser. No. 14/487,024. Additional embodiments of a reel are illustrated in FIGS. 28-31 and described herein below. Any of the other tensioning devices or reels may similarly include some or all of the components, in any combination, described in the above applications and/or illustrated in FIGS. 28-31 herein.

The tensioning device 100 may be secured to any part of a helmet 102. For example, the tensioning device 100 may be secured to a back of helmet 102 and may be used to tension a lace 104 that is positioned within the interior of the shell of helmet 102. In some embodiments, the lace 104 may be positioned within or behind one or more pads 106. For example, lace 104 may pass within a channel 108 of the pads 106 such that when the lace 104 is not under tension, each pad 106 may be recessed within a pocket 110. As the lace 104 is tensioned by the tensioning device 102, the lace 104 extending from the tensioning device 100 is shortened. This pushes the pads 106 radially inward and at least partially out of the pockets 110 toward a center of the helmet 102, thus reducing an inner circumference of the helmet 102 to tighten the helmet 102 against a wearer's head. In some embodiments, a helmet may not include pockets. Multiple pads and/or a single cushion may be placed within an inner wall of the helmet shell. Tensioning a lace that is coupled with or extends through the pads and/or cushion reduces the circumference of the pads and/or cushion to tighten the helmet.

Figure 2:
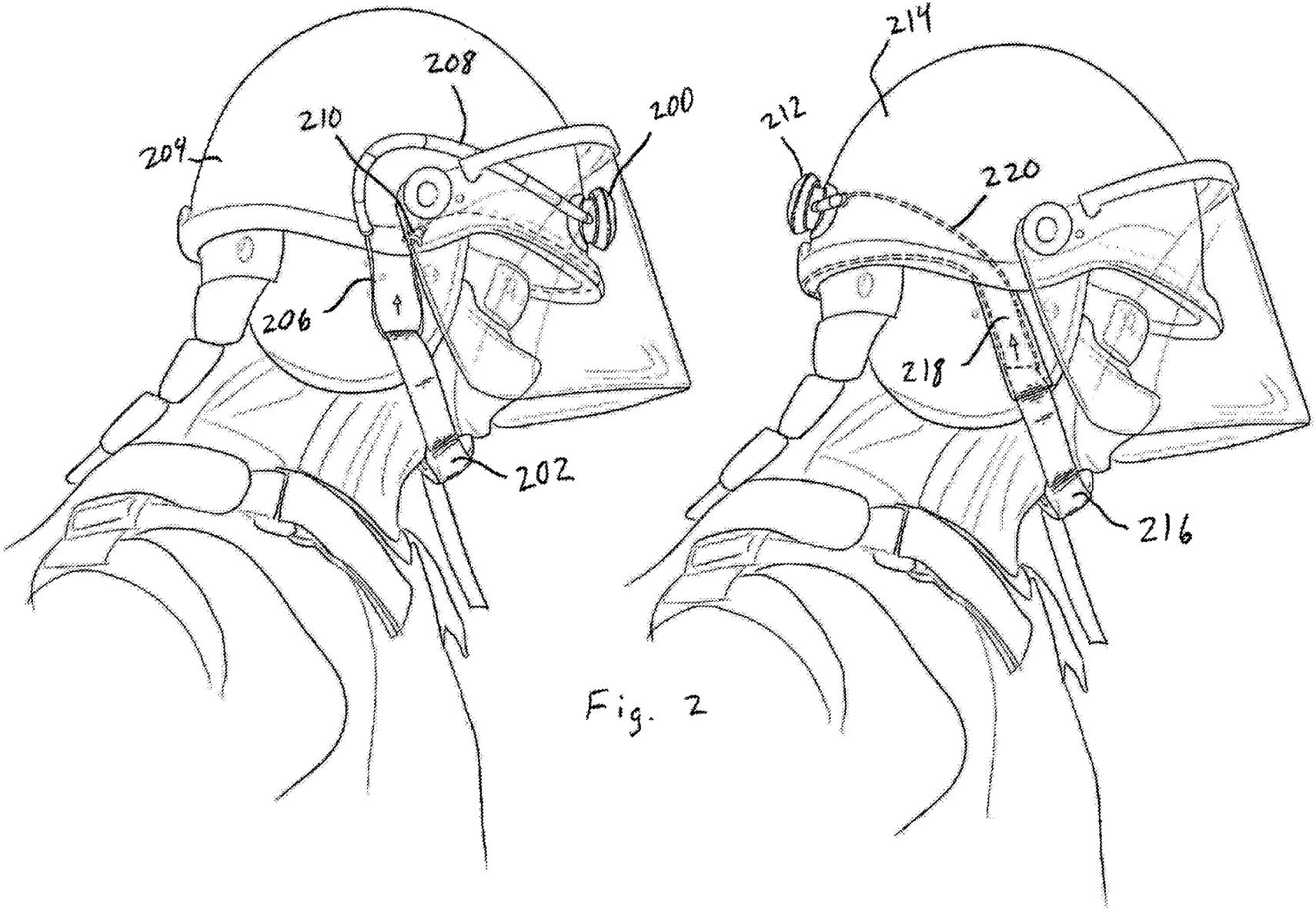

FIG. 2 depicts a tensioning device 200 that adjusts a position of a chinstrap 202 of a helmet 204. In some embodiments, a lace 206 may be tensioned by the tensioning device 200 positioned on an outside of the helmet 204. The lace 206 may pass through guides such as guide 208 and 210 to form a lace path that directs tension from the tensioning device 200 to the chinstrap 202. The lace 206 may also pass through a channel formed into the helmet 204. In some embodiments, the lace 206 may be coupled with the chinstrap 202, such as by engaging with a guide or loop of fabric of the chinstrap 202 such that when the lace 206 is tensioned, the chinstrap 202 is pulled upward and tight against a user's chin to secure the helmet 204 to the user's head. In many embodiments, the lace path will be symmetrical such that both a left side and a right side of the chinstrap 202 are equally tightened upon tensioning of the lace 206. In some embodiments, the lace path may be on only one side of the helmet and a chinstrap may be fixed to an opposite side of the helmet. In such an embodiment, the tensioning of the lace may pull the unfixed side of the chinstrap upward to tighten the chinstrap against the user's chin. In some embodiments, the guides 208 and 210 and/or any channels may be designed such that the tensioning device may be positioned on any part of the helmet 204. While shown in FIG. 2 as being positioned at the front of the helmet 204, the tensioning device 200 may similarly be positioned at a back or on a side of the helmet 204. For example, a tensioning device 212 may be positioned at a back of a helmet 214 to adjust the tightness of a chinstrap 216.

In some embodiments, a strap 218 may be coupled with or integrally formed with the helmet 214. The strap 218 may cover or conceal the lace 206 to prevent contact between the lace and the user's face. The strap 218 may include an open end that can slidingly receive a distal end of the chinstrap 216. The lace 220 may pass through a loop or guide positioned in the distal end of the chinstrap 216 such that as the lace 220 is tensioned, the chinstrap 216 is pulled tight against the user's chin.

Figure 3:
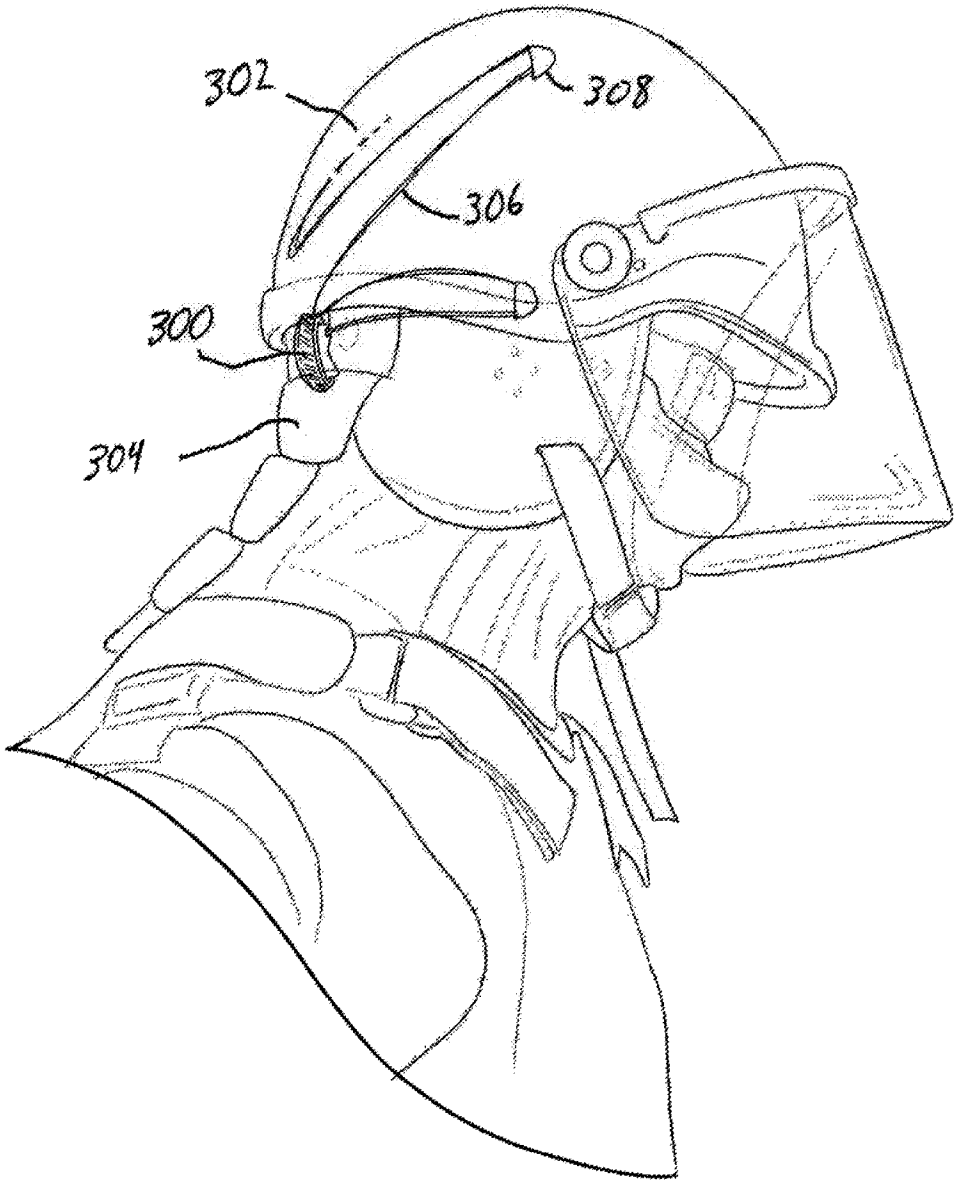

FIG. 3 shows a tensioning device 300 being used to adjust a fit of a helmet 302. In some embodiments, the tensioning device 300 may be positioned on an outside of the helmet 302. In other embodiments, the tensioning device 300 may be positioned under a flap of the helmet, such as under a rear surface of the helmet and/or under neck armor 304. A lace 306 tensioned by the tensioning device 300 may have a lace path defined within the helmet 302 by channels and/or guides 308. As the lace 306 is tensioned, internal padding of the helmet 302 may be pulled together to tighten the helmet against the user's head. For example, the helmet 302 may have a front pad and a back pad that may be pulled together by the tensioning lace 306.

Figure 4:
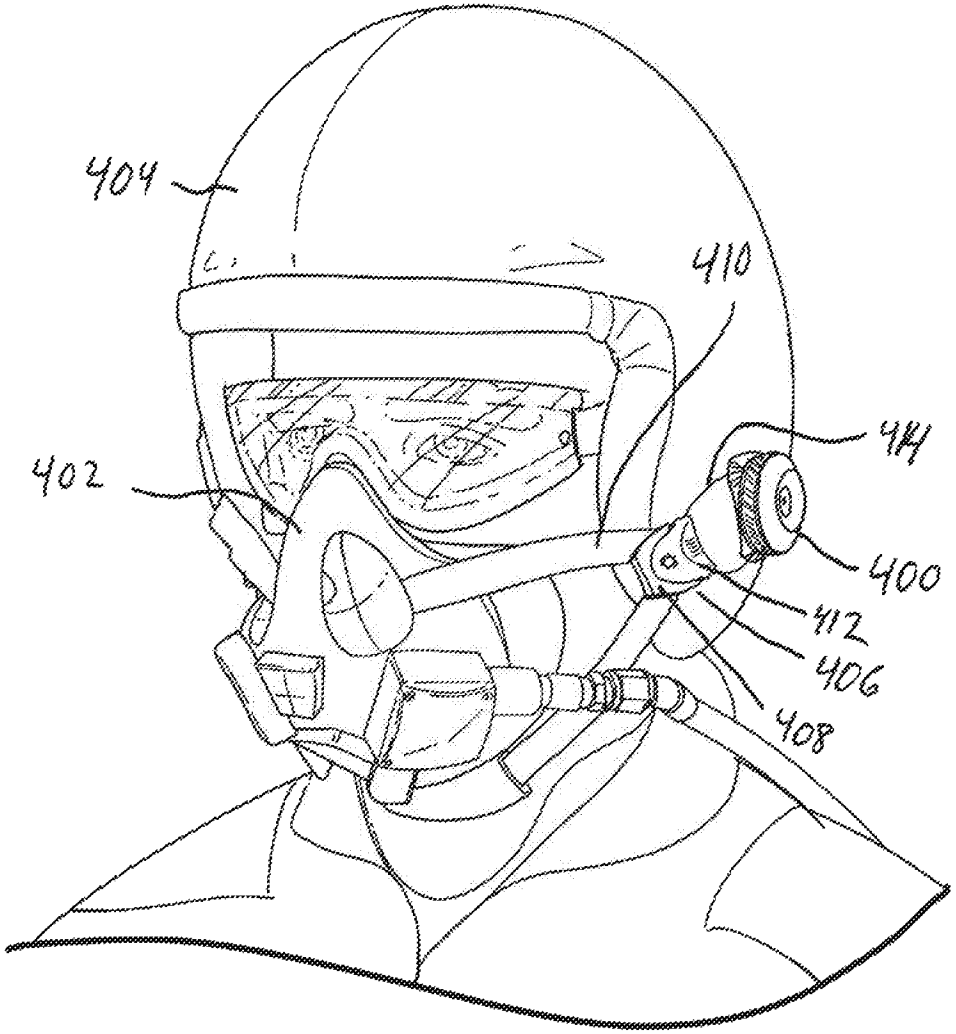
Figure 5:
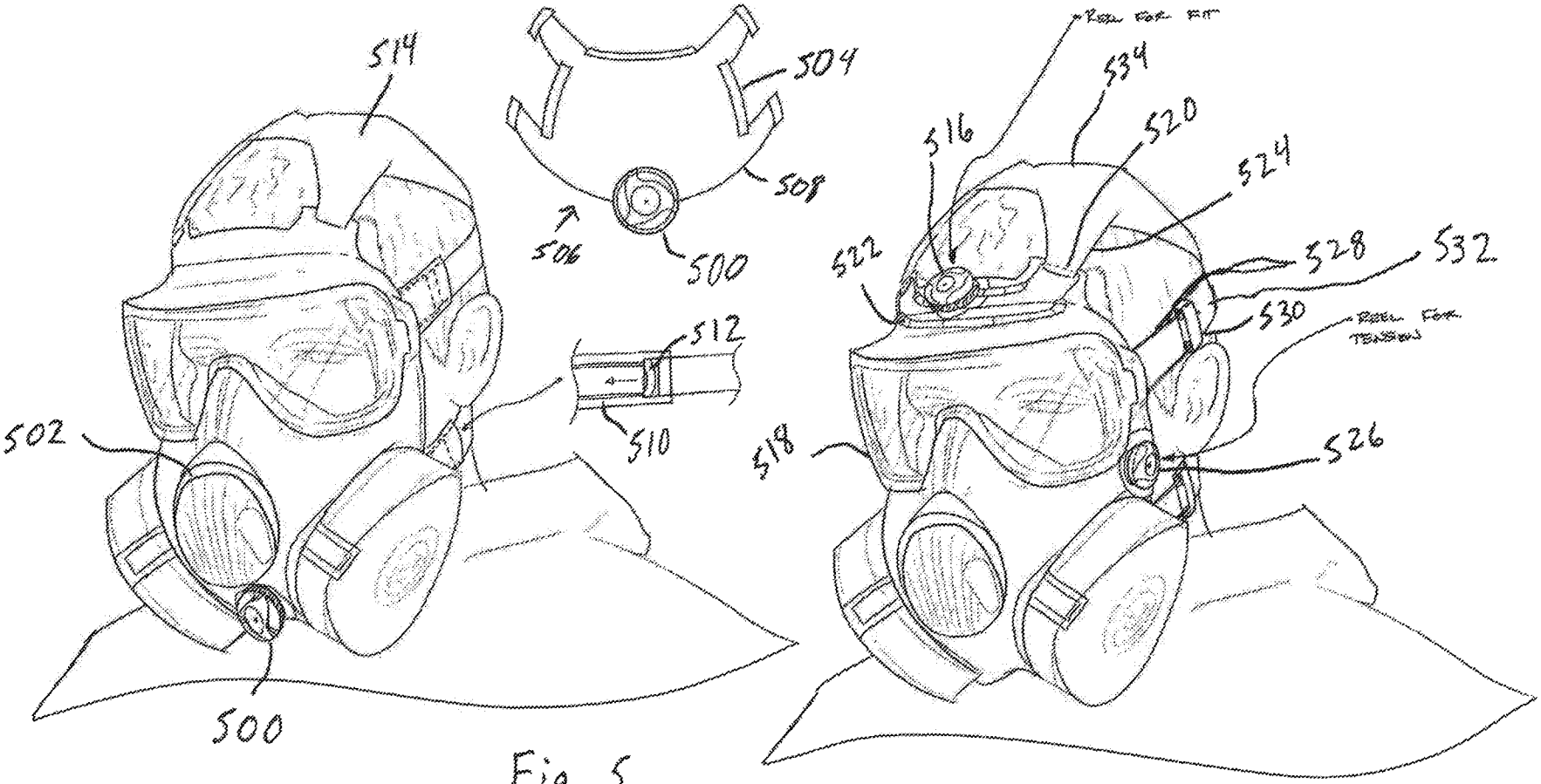
Figure 6:
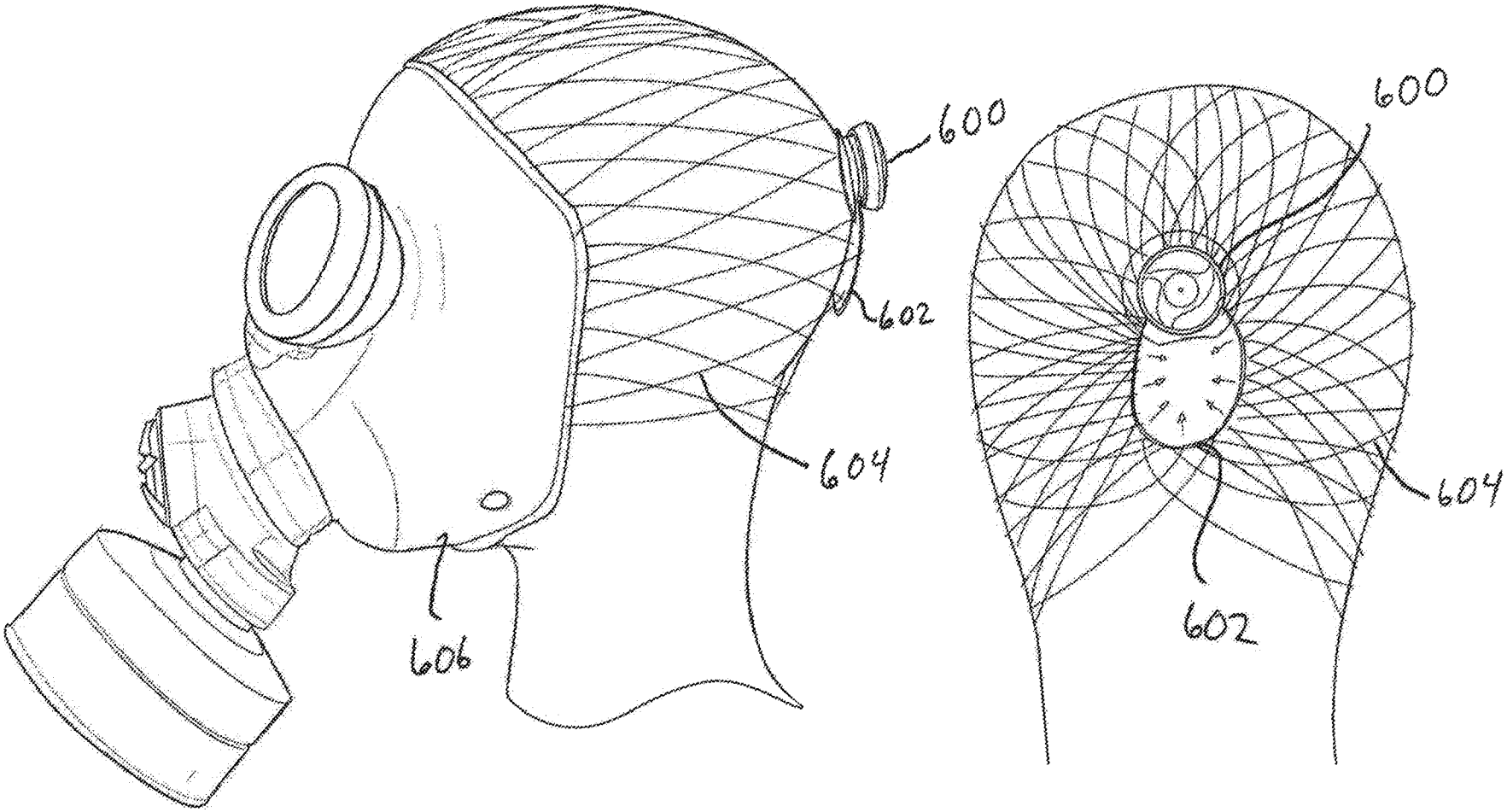

FIGS. 4 through 6 illustrate embodiments that employ a tensioning device for securing masks a user's face. For example, FIG. 4 depicts the tensioning device 400 securing a mask 402 to a helmet 404 and about a user's face. The mask 402 can be any kind of facemask, such as a gas mask, an oxygen mask, a shield, and the like. The mask 402 may include a detachable guide 406 to secure the mask 402 in place against a user's face. Embodiments of detachable guides 406 are described in greater detail in U.S. patent application Ser. No. 14/071,435, the entire disclosure of which is hereby incorporated by reference. A first component 408 of the guide 406 may be secured with or integrally formed with the mask 402, such as by attaching the first component 408 with a strap 410 of the mask 402. The first component 408 may include a channel or guide that receives the strap 410 to couple the components together. A second component 412 of the guide 406 may be attached to a shell of the helmet 404, such as by coupling the second component 412 with the lace 414. The first component 408 may be engaged with the second component 412, such as by snapping the first component 408 and the second component 412 together, to secure the components 408 and 412 together. When the first component 408 is disengaged from the second component 412, the mask 402 is free to be removed from a user's face. When the first component 408 is engaged with the second component 412, the mask 402 is positioned and secured over a user's face. The tensioning device 400 may tension the lace 414 that passes through a guide or channel in the second component 412 to pull the guide 406 closer to the tensioning device 400 and thereby tighten the strap 410 against a user's face. In some embodiments, the opposite side of the mask 402 and helmet 404 may similarly include a tensioning device 400 and guide 406.

FIG. 5 shows a tensioning device 500 used to secure a mask 502 about a user's face. One or more channels and/or guides 504 may be positioned on or within the mask 502 to define a lace path 506 for a lace 508. In some embodiments, the lace 508 may be positioned with a channel of a strap 510 to prevent the lace 508 from contacting and irritating the user's head. The lace 508 may in turn be coupled with a guide 512 positioned on a distal end of a strap of a head securing harness 514 such that as lace 508 is tensioned by the tensioning device 500, the head securing harness 514 is pulled against the back of the user's head and the mask 502 is drawn against the user's face. In some embodiments, the distal end of the strap of the head securing harness 514 is disposed within the channel or lumen of the strap 510.

In some embodiments, multiple tensioning devices may be used to adjust the fit of a mask. For example, a tensioning device 516 may be positioned on an upper portion of a mask 518 while a second tensioning device 526 (and possibly third tensioning device) are positioned on a lower portion of the mask 518. The tensioning device 516 may be used to tension a lace 520 that is directed by one or more guides 522 on the upper portion of the mask 518. The lace 520 may in turn be attached to straps 524 of a harness 534, such as by inserting the lace 520 through a loop of fabric and/or guide of the straps 524. As the lace 520 is tensioned, the straps 524 are pulled toward the upper portion of the mask 518 to secure the upper portion of the mask 518 against the user's head. The tensioning device 526 may operate in a similar manner as the tensioning device 500 to tension a lace 528 that passes through one or more guides 530. The guides 530 are positioned on the lower straps 532 of the harness 534 such that tensioning of the lace draws the lower portion of the harness 534 toward the mask 518 to secure the lower portion of the mask 518 against the user's head. The upper and lower positioned tensioning devices allow the upper and lower portions of the mask to be differentially tensioned. While two tensioning devices are shown, additional tensioning devices may be used to create more customizable fits. Additionally, various lace patterns may be defined or created by the lace guides and channels within or about the mask and/or harness to create various tensioning zones.

FIG. 6 shows another embodiment of a tensioning device used to secure a mask about a user's head. A tensioning device 600 may tension a loop of lace 602. A mesh or net 604 may be secured to the loop of lace 602 such that as the loop of lace 602 is tensioned, a diameter of the loop of lace 602 decreases. Decreasing the diameter of the loop of lace 602 pulls the mesh net 604 against a user's head. Opposing ends of the mesh net 604 may be coupled with a mask, such as a gas mask 606. As the mesh net 604 is tightened against the user's head, the gas mask 606 may be secured about the user's face.

Figure 7:
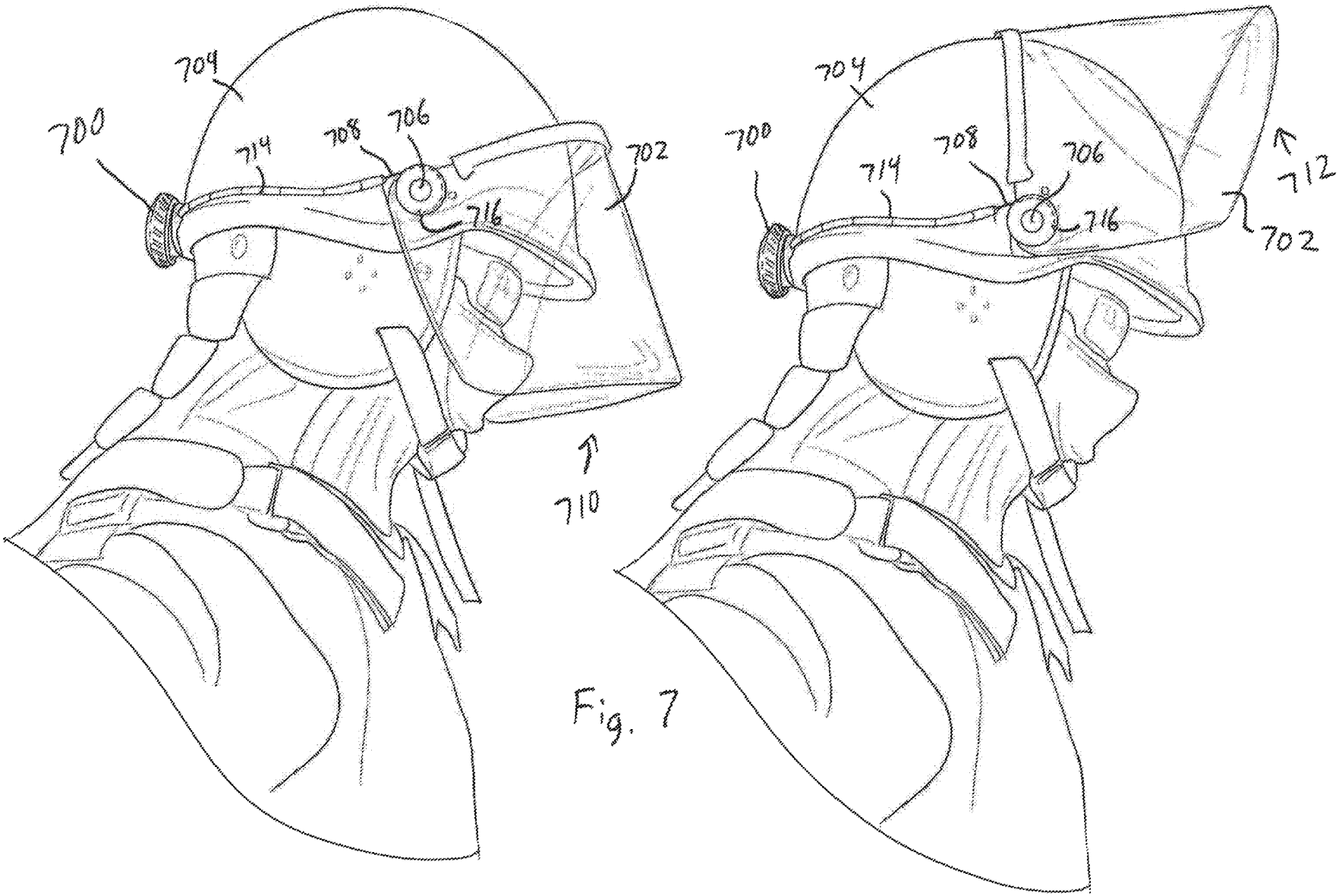

FIG. 7 illustrates a tensioning device 700 that may be used to maintain a visor 702 of a helmet 704 in a desired position. A knob 706 may be coupled with an upper portion of the visor 702 and/or may coupe the visor 702 with the helmet 704. The visor 702 may be free to rotate relative to the helmet 704 about the knob 706. A lace 708 may be coupled between the tensioning device 700 and the knob 706 with an end 716 of the lace 708 secured to a point of the knob 706 spaced radially apart from a rotational axis of the knob 706. As the lace 708 is tensioned by rotating the tensioning device 700 in a first direction, the end 716 pulls and rotates the knob 706, moving the visor 702 from a closed or shield position 710 to an open position 712. In some embodiments, the tension may be lessened by rotating the tensioning device 700 in a second direction to move the visor from the open position 712 to the shield position 710. In some embodiments, a lace path may be defined by one or more guides 714, such as tubing.

Figure 8:
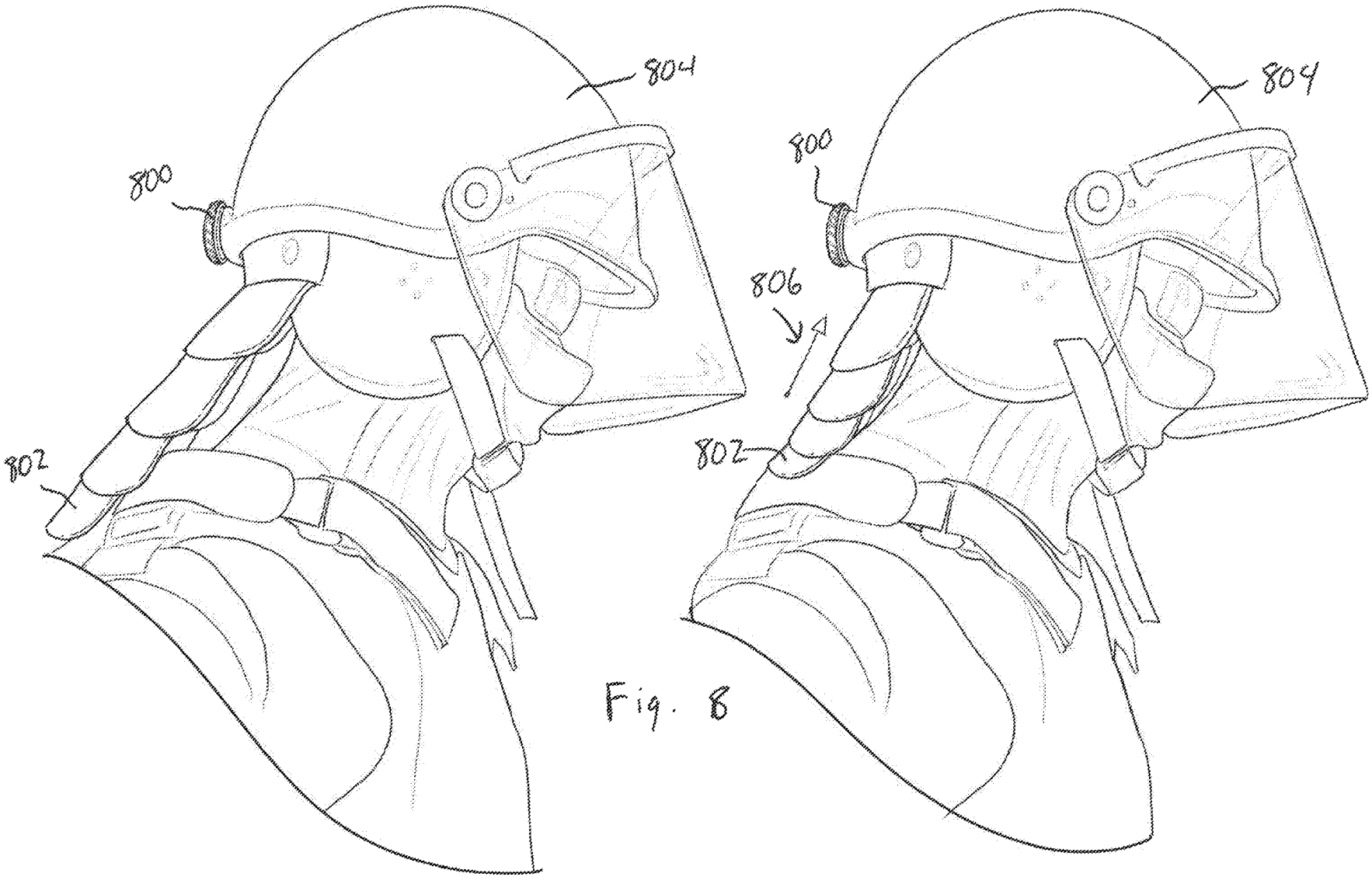

FIG. 8 illustrates a tensioning device 800 that may be used to adjust a position of a neck guard 802 attached to a helmet 804. The neck guard 802 may be coupled with a back of the helmet 804. A lace (not shown) may be threaded through or otherwise coupled with one or more layers of the neck guard 802 such that as the lace is tensioned by rotating the tensioning device 800 in a first direction, the neck guard may be retracted to a shortened configuration 806. In some embodiments, the tensioning device 800 may be rotatable in a second direction to reduce the tension on the lace and extend the neck guard 802. Shortening of the neck guard 802 may stiffen the neck guard and thereby increase the protection offered by the neck guard. Lengthening of the neck guard may loosen the neck guard and thereby allow the neck guard to be more flexible.

Figure 9:
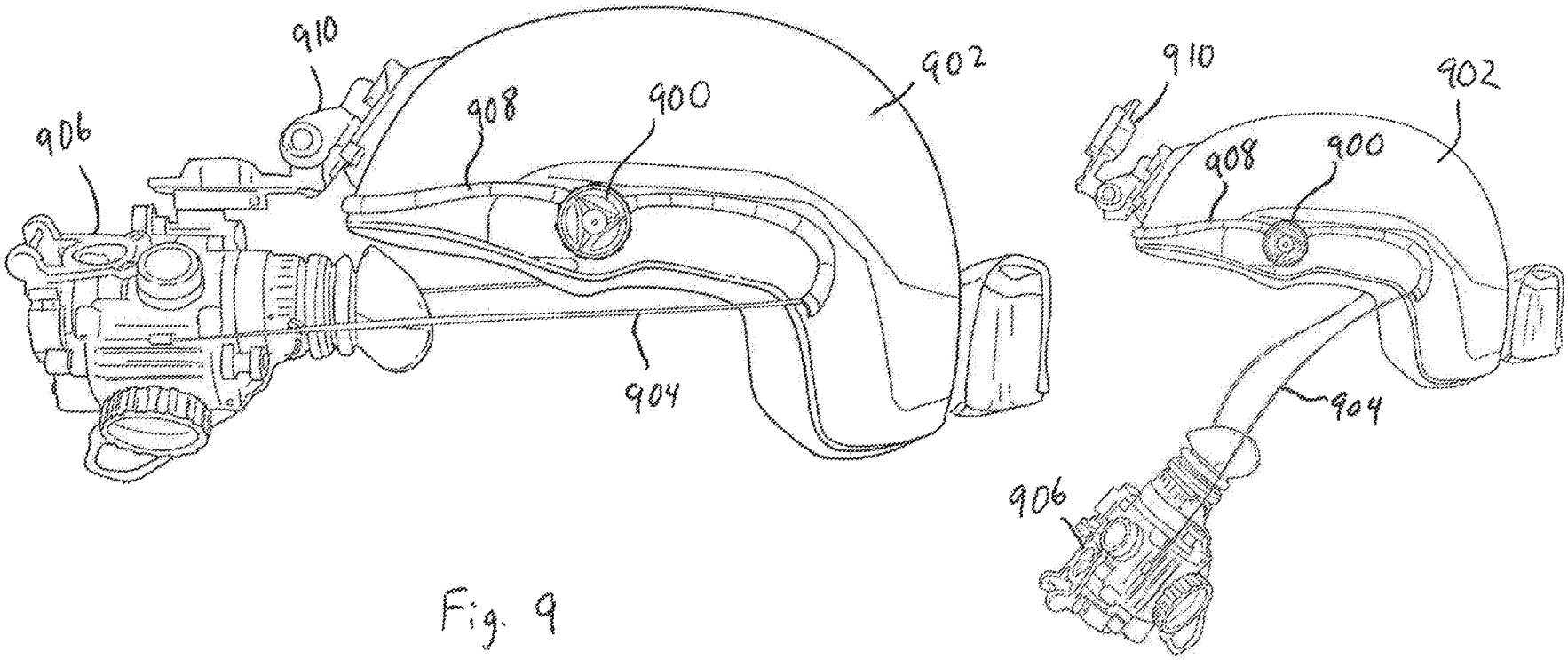

FIG. 9 shows a tensioning device 900 that may be used to position a facial accessory, such as binoculars or night vision goggles, with respect to a user. The tensioning device 900 may be coupled with a helmet 902 and may be configured to tension a lace 904 to secure the goggles 906 against a user's face. One or more guides 908 may extend around an outer periphery of the helmet 902 about a lace path. Opposing ends of the lace 904 may be fixed to the goggles 906 such that as the lace 904 is tensioned, the goggles 906 are drawn toward the helmet 902. When the lace 904 is not tensioned, the lace 904 acts as a tether to allow the goggles 906 to hang from helmet 902. This secures goggles 906 in a quickly accessible position for a user. A coupling arm 910 may be attached to the helmet 902 and may be pivoted downward to couple with a top of the goggles 906 to maintain the goggles 906 in a desired vertical position. In some embodiments, a second tensioning device may be coupled with the helmet above the goggles and may adjust a vertical position of the goggles.

Figure 12:
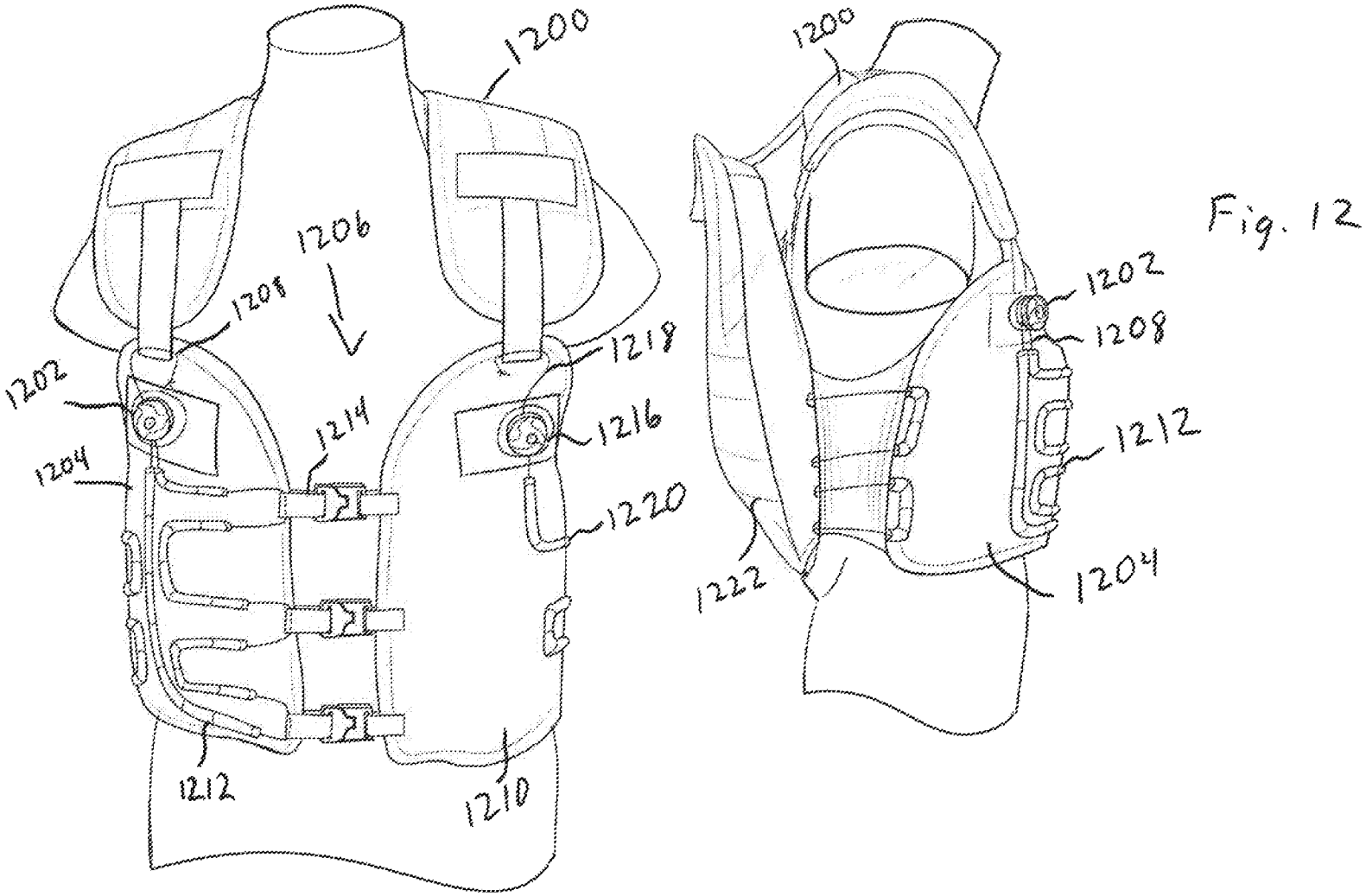

FIGS. 10-12 depict tensioning devices that adjust a position or fit of a backpack. For example, FIG. 10 shows a backpack 1000 that is secured to a user using multiple tensioning devices. Two tensioning devices 1002 are attached to a shoulder portion 1004 of the backpack 1000 and configured to tension the lace 1006 in order to adjust a vertical position of a front portion 1008 of the backpack 1000 and to adjust both a vertical and lateral position of a back portion 1010 of the backpack 1000. The laces 1006 may pass through the guides 1012 on the shoulder portion 1004, the guides 1014 on the front portion 1008, and the guides and/or channels on the back portion 1010. The backpack 1000 may also include two tensioning devices 1016 that tension lace 1018 that is positioned on a lower portion of the backpack 1000. The lace 1018 may pass through the guides 1020 on the front portion 1008 and/or guides 1022 on the straps 1024 of the back portion 1010. As the lace 1018 is tensioned, the back portion 1010 is pulled toward the front portion 1008 and around a user's midsection or core. By tensioning both the upper and lower laces, 1006 and 1018, a height and tightness or fit of the backpack 1000 about the user may be adjusted.

FIG. 11 shows a tensioning device 1100 positioned on a front shoulder portion 1102 of a backpack 1104. By positioning the tensioning device 1100 on a front shoulder portion 1102, a user is able to easily adjust compression of the backpack 1104 while wearing the backpack 1104. One or more guides 1106 (e.g., tubing) may be positioned along the shoulder portion 1102 to direct a lace 1108 from the tensioning device 1100 to a pack 1110 of the backpack 1104. The pack 1110 includes guides and/or channels 1112 that receive and direct the lace 1108 in a pattern about the pack 1110. The lace 1108 is wrapped around a front portion 1114 of the pack 1110 so that as the lace 1108 is tensioned, the lace 1108 compresses the pack 1110.

In some embodiments, a tensioning device 1118 may be positioned on an upper portion of a pack 1120 of a backpack 1122. One or more guides (e.g., tubing 1124 and/or other guides 1128) may be used to direct a lace 1126 across a back portion 1130 of the pack 1120, such as in a crisscrossing pattern. As the lace 1126 is tensioned, the lace 1126 may compress the back portion 1130 of the pack 1120.

FIG. 12 shows multiple tensioning devices that adjust a fit of a backpack 1200. A first tensioning device 1202 is attached to a right front portion 1204 of the backpack 1200 and is configured to tension a first lace 1208 that controls a vertical fit of the right front portion 1204 of the backpack 1200. The first tensioning device 1202 also is configured to tension a second lace (not numbered) that is guided about an opening between the right front portion 1204 and a left front portion 1210 of the backpack 1200. The guides 1212 (e.g., tubing) direct the second lace across the opening of the right front portion 1204 and the left front portion 1210. The second lace is coupled with one or more straps 1214, such as by inserting the second lace within guides or loops of the straps, that are attached to a buckle or coupling mechanism that may be coupled to close the opening and secure the backpack 1200 about a user's midsection. As the second lace is tensioned, the straps 1214 are likewise tensioned, which pulls the right front portion 1204 and left front portion 1210 toward one another and thereby tightens the backpack 1200 about the user's midsection. The backpack 1200 also includes a second tensioning device 1216 that is positioned on the left front portion 1210. The second tensioning device 1216 is configured to tension a third lace 1218 that controls a vertical fit of the left front portion 1210 of the backpack 1200. The second tensioning device 1216 also tensions a fourth lace (not numbered) that passes through the guides 1220 (e.g., tubing) to direct the fourth lace around the user's midsection and to a pack body 1222 of the backpack 1200. The fourth lace passes through one or more channels and/or guides of the pack body 1222 and through one or more guides 1224 positioned on a rear surface of the right front portion 1204. A distal end of the fourth lace may be coupled with the second tensioning device 1216. As the fourth lace is tensioned, pack body 1222 is pulled toward the right front portion 1204 and the left front portion 1210, which constricts the backpack 1200 against the user's midsection.

Figure 13:
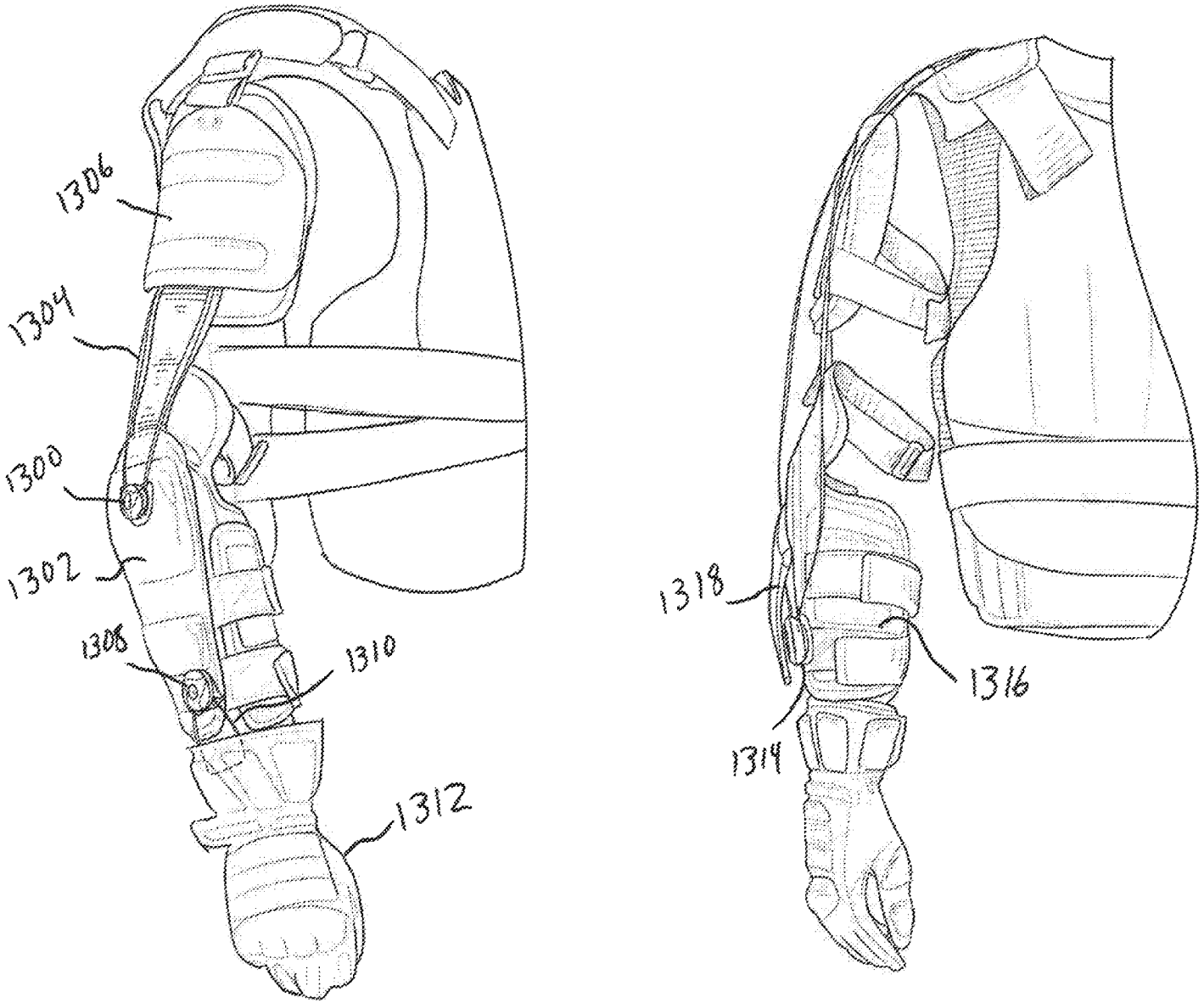
FIGS. 13-17 illustrate tensioning devices that adjust and secure armor to a user's arm.

FIGS. 13-17 depict tensioning devices that adjust and secure armor to a user's arm. For example, FIG. 13 shows a tensioning device 1300 on an elbow guard 1302 that tensions a lace 1304 that is coupled with a shoulder guard 1306. As lace 1304 is tensioned, the elbow guard 1302 and shoulder guard 1306 are pulled toward each other to adjust a fit of the armor about a user's arm. A second tensioning device 1308 may be included on the elbow guard 1302 to tension a lace 1310 that is coupled with a glove 1312. As the lace 1310 is tensioned, the glove 1312 is pulled upward toward the elbow guard 1302 to adjust a fit of the glove 1312 about the user's arm. When the lace 1310 is not under tension, the lace 1310 acts as a tether to prevent the glove 1312 from being lost and also maintains the glove 1312 in a readily accessible position. In some embodiments, the tensioning devices may be positioned under the armor for protection. For example, tensioning device 1314 is positioned on a forearm guard 1316 while a plate of armor 1318 protects the tensioning device 1314.

Figure 14:
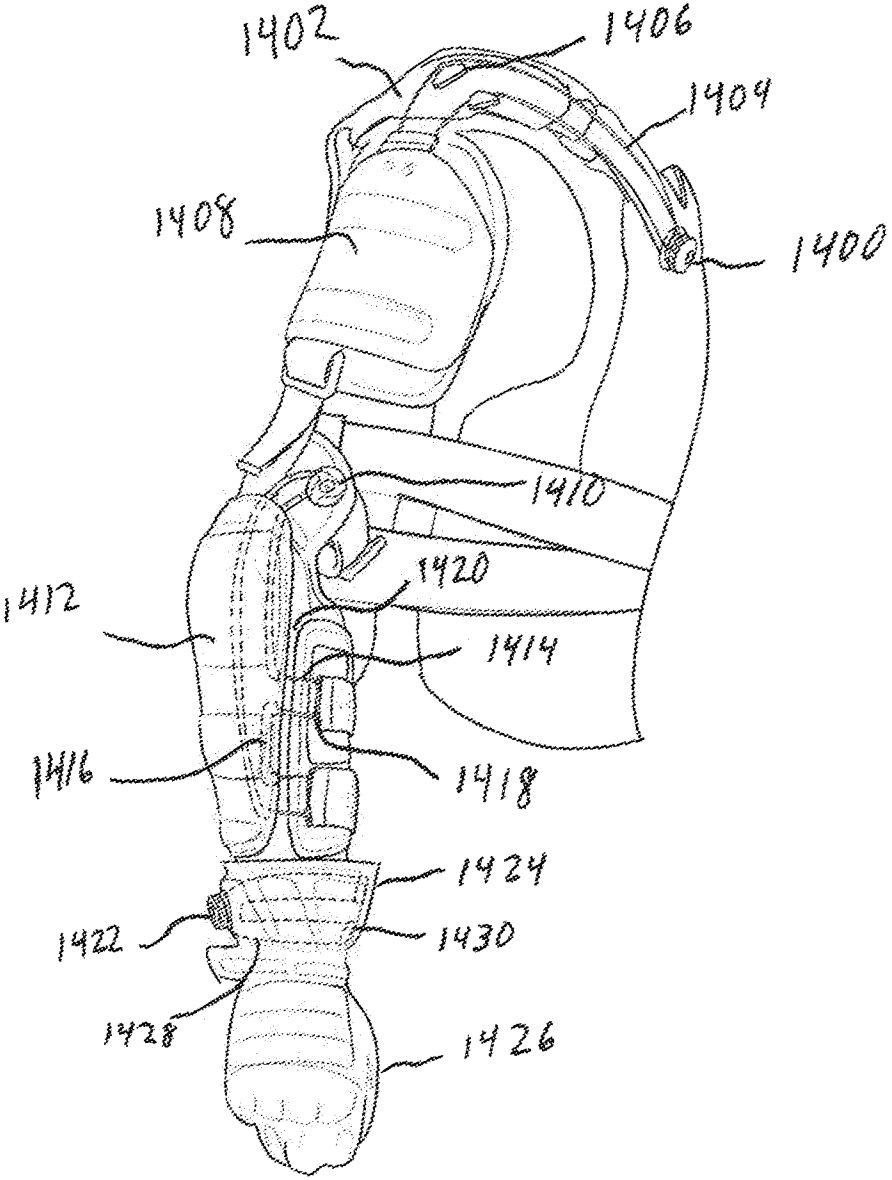

FIG. 14 depicts a tensioning device 1400 attached adjacent a shoulder guard 1402 near a user's chest. The tensioning device 1402 tensions a lace 1404 that passes around guides 1406 and couples with an upper arm guard 1408 such that when the lace 1404 is tensioned the upper arm guard 1408 is moved upward relative to the shoulder guard 1402. A tensioning device 1410 may also be positioned on a lower arm guard 1412 that can include multiple armor pieces or be of a clamshell configuration as shown. A lace 1414 may pass through the guides 1416 across a span of an opening 1420 of the clamshell components and through the guides 1418 before returning to the tensioning device 1400. The opening 1420 may be a longitudinal slit in the lower arm guard 1412 such that a user's lower arm may be slid into a side of lower arm guard 1412. As the lace 1414 is tensioned, the guides 1418 are pulled toward the guides 1416 to reduce the span of the opening 1420 to tighten the lower arm guard around a user's lower arm. In some embodiments, a tensioning device 1422 may be positioned on a cuff 1424 of a glove 1426. A lace 1428 may be coupled with the tensioning device 1422 and may pass through the cuff 1424 and guides 1430 such that as lace 1428 is tensioned, the cuff 1424 is tightened against a user's wrist.

Figure 15:
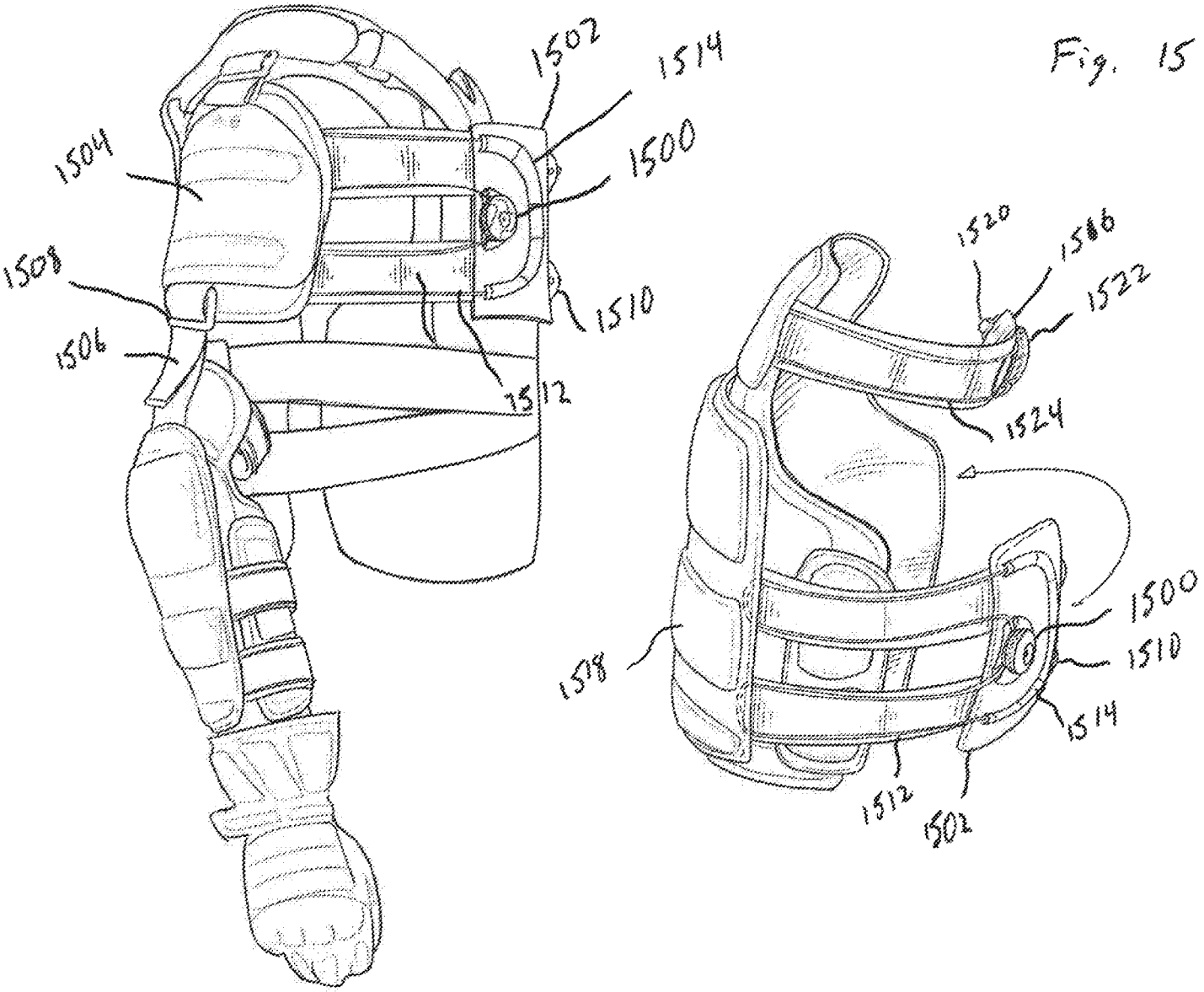

FIG. 15 depicts removable armor secured about a user by tensioning devices. A tensioning device 1500 is coupled to a panel 1502 that extends from an arm or shoulder guard 1504. The guard 1504 may include straps 1506 and/or buckles 1508 that couple the guard 1504 with other armor components. The panel 1502 and guard 1504 may be opened like a hinge or clamshell to enable the armor to be positioned about a user's midsection or torso. The panel 1502 and guard 1504 may include coupling components 1510 like the detachable guides described in the '435 application incorporated herein. The coupling components 1510 may interface with corresponding components positioned on the armor body to secure the guard 1504 and panel 1502 around a user's midsection. A lace 1512 may pass along the panel 1502 and through the guides and/or channels within the shoulder guard 1504 and through a guide 1514 on the panel 1502 such that tensioning of lace 1512 causes the panel 1502 and the guard 1504 to tighten around the user's midsection.

In some embodiments, a second panel 1516 may be included on a guard 1518. The panel 1516 may include a coupling component 1520 that couples the panel 1516 with the guard 1518. The panel 1516 may also include a tensioning device 1522. The tensioning device 1522 tensions a lace 1524 that traverses a length of the panel 1516 and attaches to the guard 1518 such that when tensioned, the lace 1524 tightens a portion of the guard 1518 about the user's torso. The guard 1518 may also include a panel 1502 to tighten a lower portion of the guard 1518 about the user's torso.

Figure 16:
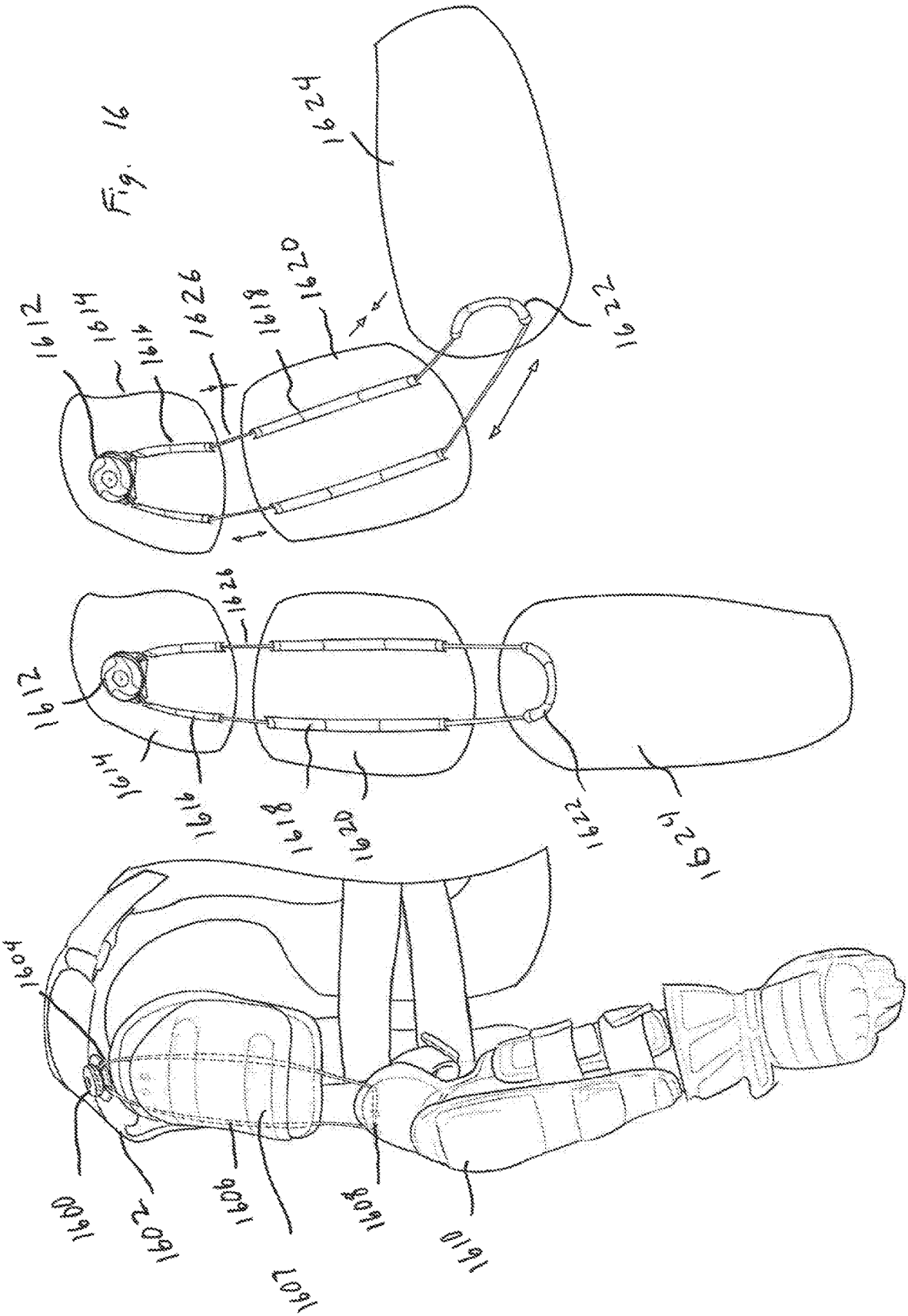

FIG. 16 illustrates tensioning devices for coupling multiple pieces of armor in a manner that allows movement of the armor pieces relative to each other. The tensioning device 1600 is positioned on a shoulder guard 1602 and tensions a lace 1604 that passes through guides 1606 (e.g., tubing) that are positioned on an upper arm guard 1607 and into a guide 1608 on a lower arm guard 1610 spaced apart from the shoulder guard 1602. As the lace 1604 is tensioned, the lower arm guard 1610 is moved relative to the shoulder guard 1602. This allows the position of the armor pieces to be adjusted relative to one another. Additionally, by maintaining a gap between the lower arm guard 1610 and the shoulder guard 1602, movement of the armor is facilitated as a user's moves his or her arm.

In some embodiments, a single tensioning device may be used to couple several armor pieces together. As illustrated, the tensioning device 1612 may be attached to a shoulder guard 1614 and configured to tension a lace 1626 that passes through the guides 1616 on the shoulder guard 1614, the guides 1618 on an upper arm guard 1620, and the guides 1622 on a lower arm guard 1624. As lace 1626 is tensioned, the guards 1614, 1620, and 1624 are pulled together. As a user bends his or her arm, the lace 1626 dynamically slides within the guides 1618 on the upper arm guard 1620 and/or guides 1622 on the lower arm guard 1624, which enables the guides, 1620 and 1634, to move and/or pivot relative to one another. This allows the position of the armor pieces to be move relative to one another in synch with the movement of the user's limb.

Figure 17:
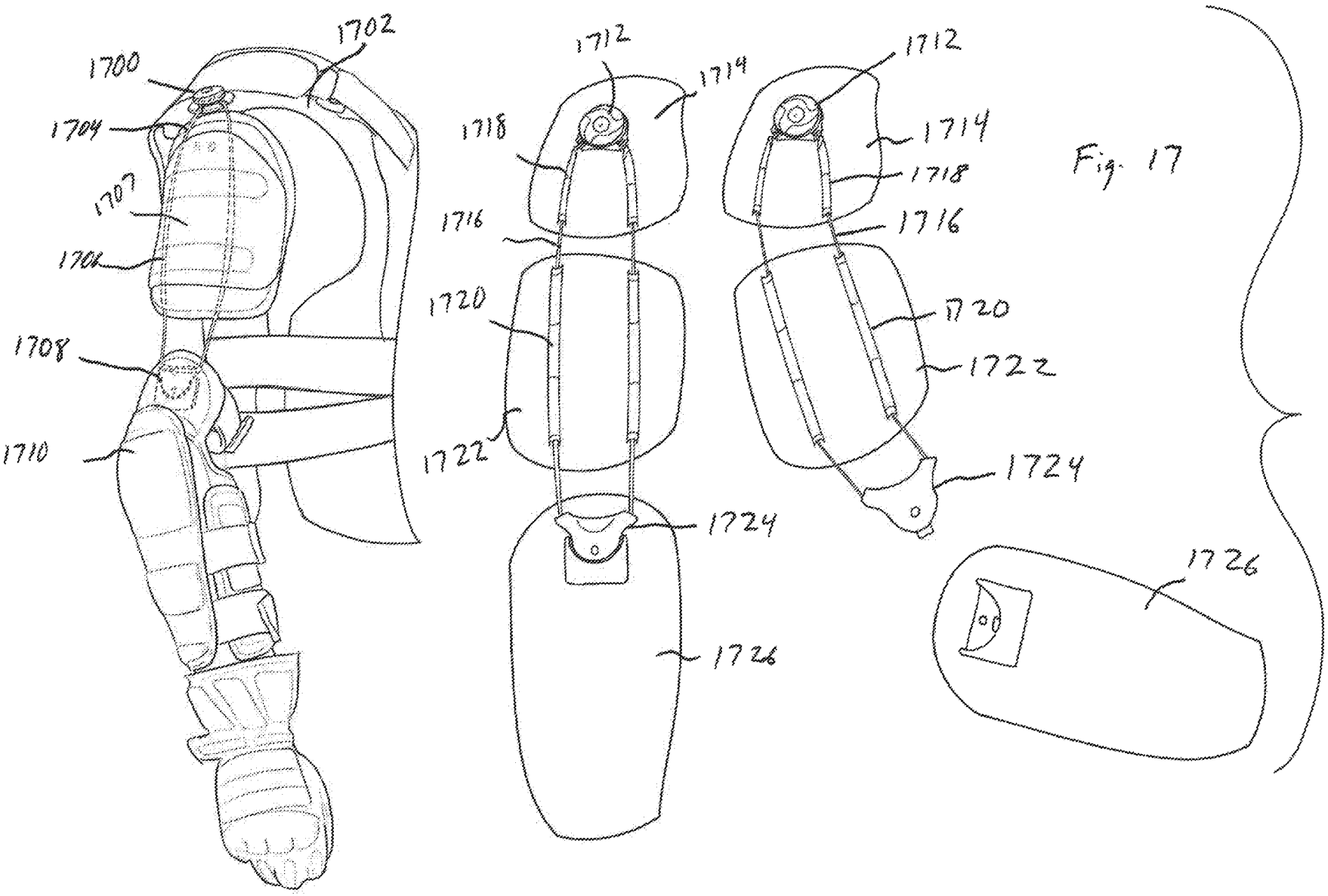

In some embodiments, one or more pieces of armor may be detachable from the rest of the armor. FIG. 17 shows a tensioning device 1700 on a shoulder guard 1702 that tensions a lace 1704. The lace 1704 passes through the guides 1706 on an upper arm guard 1707 and couples with a detachable guide 1708 that may be coupled with a lower arm guard 1710. When the detachable guide 1708 is coupled with the lower arm guard 1710, the lace 1704 may be tensioned to adjust a position of the lower arm guard 1710 relative to the shoulder guard 1702. The detachable guide may be decoupled from the lower arm guard 1710 in order to remove the lower arm guard 1710 from the other armor components.

In some embodiments, more than two pieces of armor may be removably coupled using the detachable guides. For example, a tensioning device 1712 may be positioned on a shoulder guard 1714 and may tension a lace 1716 that traverses through guides 1718 positioned on a shoulder guard 1714 and through guides 1720 positioned on an upper arm guard 1722 that couples with a detachable guide 1724. The detachable guide 1724 may couple with a lower arm guard 1726. The lower arm guard 1726 may be detached from the other guards 1716 and 1722 by decoupling the detachable guide 1724 from the lower arm guard 1726. Tensioning of the lace 1716 draws the guards (1716, 1722, and/or 1726) together. In some embodiments, multiple tensioning devices and/or multiple detachable guides may be used to allow removal of multiple pieces of armor.

Figure 18:
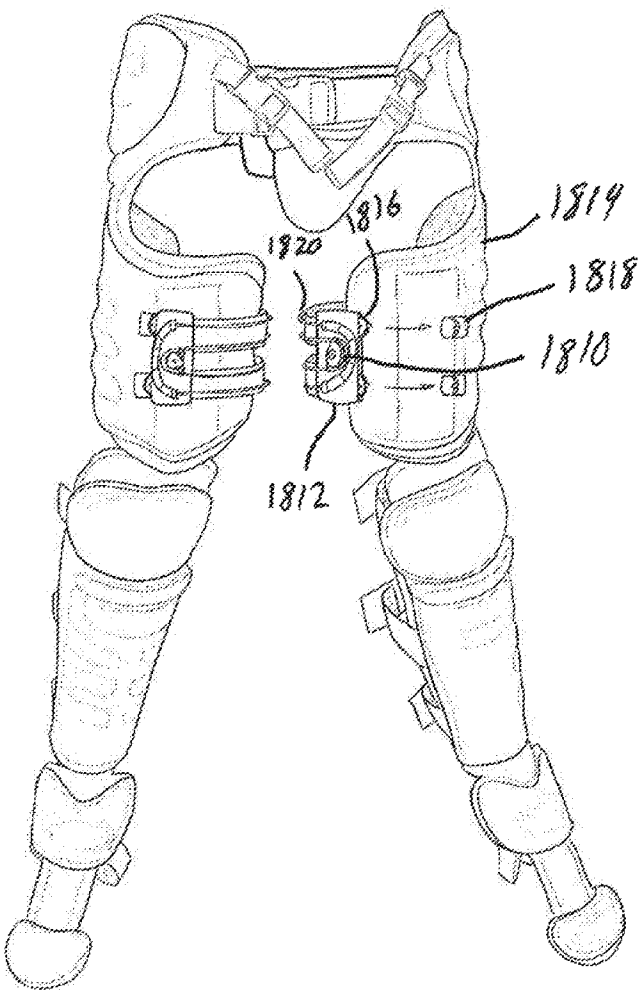
FIGS. 18-19 illustrate tensioning devices that secure leg armor about a user's leg.
Figure 18:
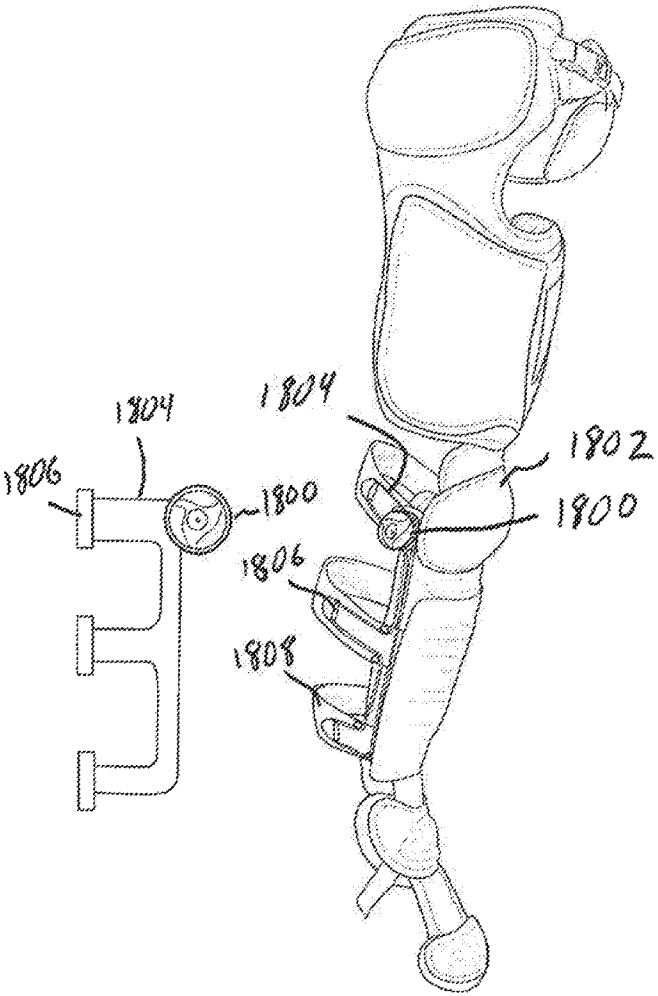
Figure 19:
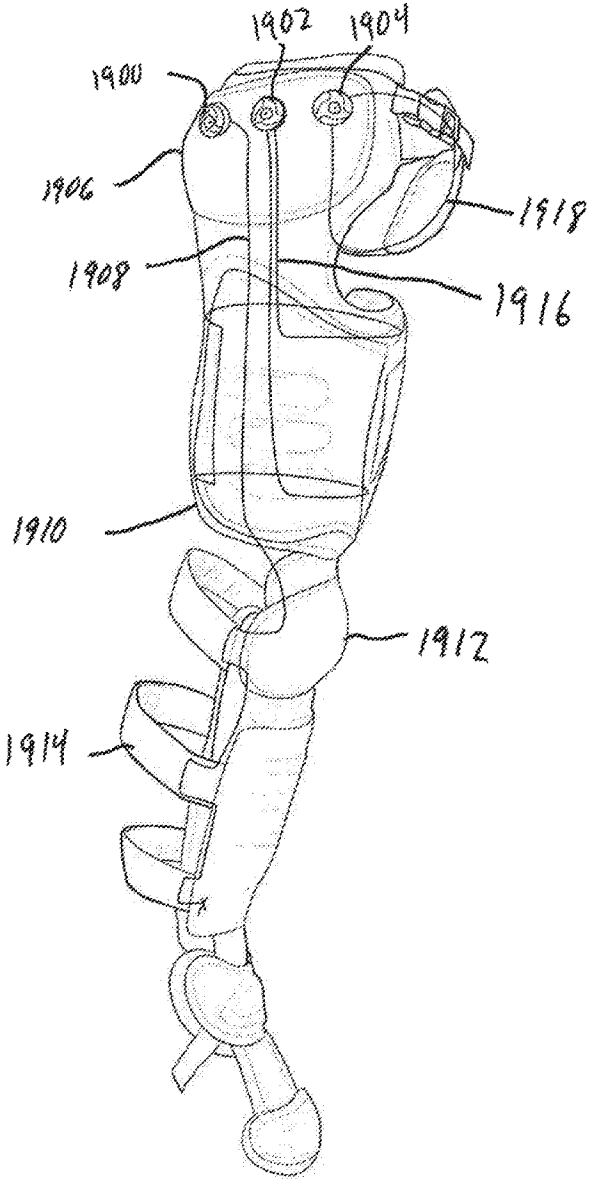

FIGS. 18 and 19 depict tensioning devices that secure leg armor about a user's leg. For example, FIG. 18 shows a tensioning device 1800 attached to a lower leg guard 1802. A lace 1804 may pass through one or more guides 1806 positioned along one or more straps 1808 that wrap around a user's lower leg. As the lace 1804 is tensioned, the straps 1808 are tightened to secured or constrict the lower leg guard about the user's leg, such as around the user's calf. In some embodiments, a tensioning device 1810 may be positioned on a panel 1812 that extends from an upper portion of a leg guard 1814. The panel 1812 may be detachably coupled with the upper portion of the leg guard 1814 and may be opened like a clam shell to enable a user to insert their leg within the leg guide 1814. The panel 1812 may then be wrapped around the user's leg and coupled with the upper portion of leg guide 1814 via coupling of the components 1816 and corresponding mating components 1818 that are disposed on the leg guard 1814. A lace 1820 that extends from the tensioning device 1810 along the panel 1812 and passes through the guides (not shown) may be tensioned to tighten the upper leg guard against the user's leg.

FIG. 19 shows three tensioning devices 1900, 1902, and 1904 attached to a hip guard 1906. Each tensioning device 1900, 1902, and 1904 adjusts a fit of a separate piece or component of armor, which enables individual adjustment of each piece of armor at a single location. For example, a first tensioning device 1900 tensions a lace 1908 that traverses an upper leg guard 1910 and a lower leg guard 1912. The lace 1908 is operatively coupled with one or more straps 1914 that are positioned on the lower leg guard 1912 and that wrap around a user's lower leg. As the lace 1908 is tensioned, the straps 1914 are tightened around the user's leg to secure the lower leg guard 1912 about the user's leg. In some embodiments, coupling components may be included on the straps 1914 to allow easy removal of the lower leg guard 1912 by unfastening or uncoupling the components 1914. A second tensioning device 1902 is configured to tension a lace 1916 that is operatively coupled (e.g., wrapped around) with the upper leg guard 1910. As the lace 1916 is tensioned, the upper leg guard 1910 is tightened or constricted around the user's upper leg. In some embodiments, the upper leg guard 1910 may include a detachable panel that can be opened to allow easy removal of the upper leg guard 1910 from the user's leg. A third tensioning device 1904 tensions a lace 1918 that wraps around the hip guard 1906 to tighten the hip guard 1906 around a user.

Figure 20:
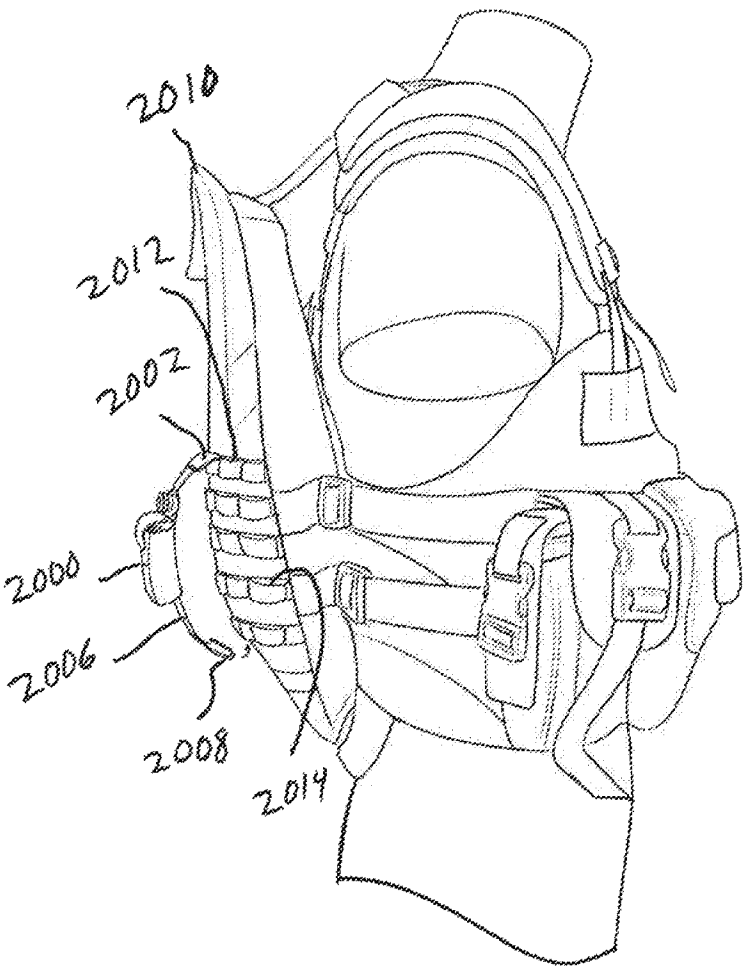
FIGS. 20-22 illustrate tensioning devices that secure storage compartments about a user and/or to another component.
Figure 21:
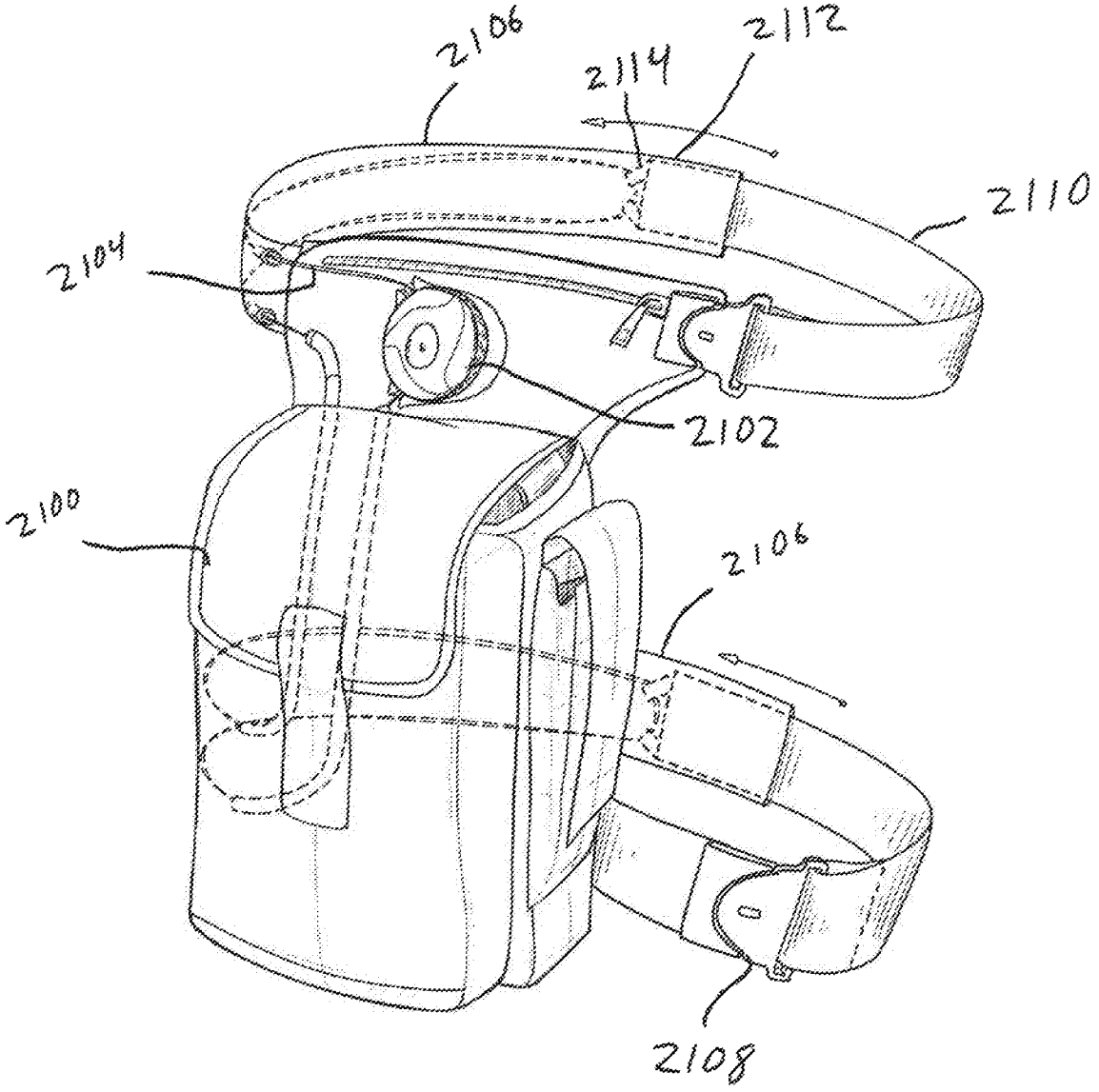
Figure 22:
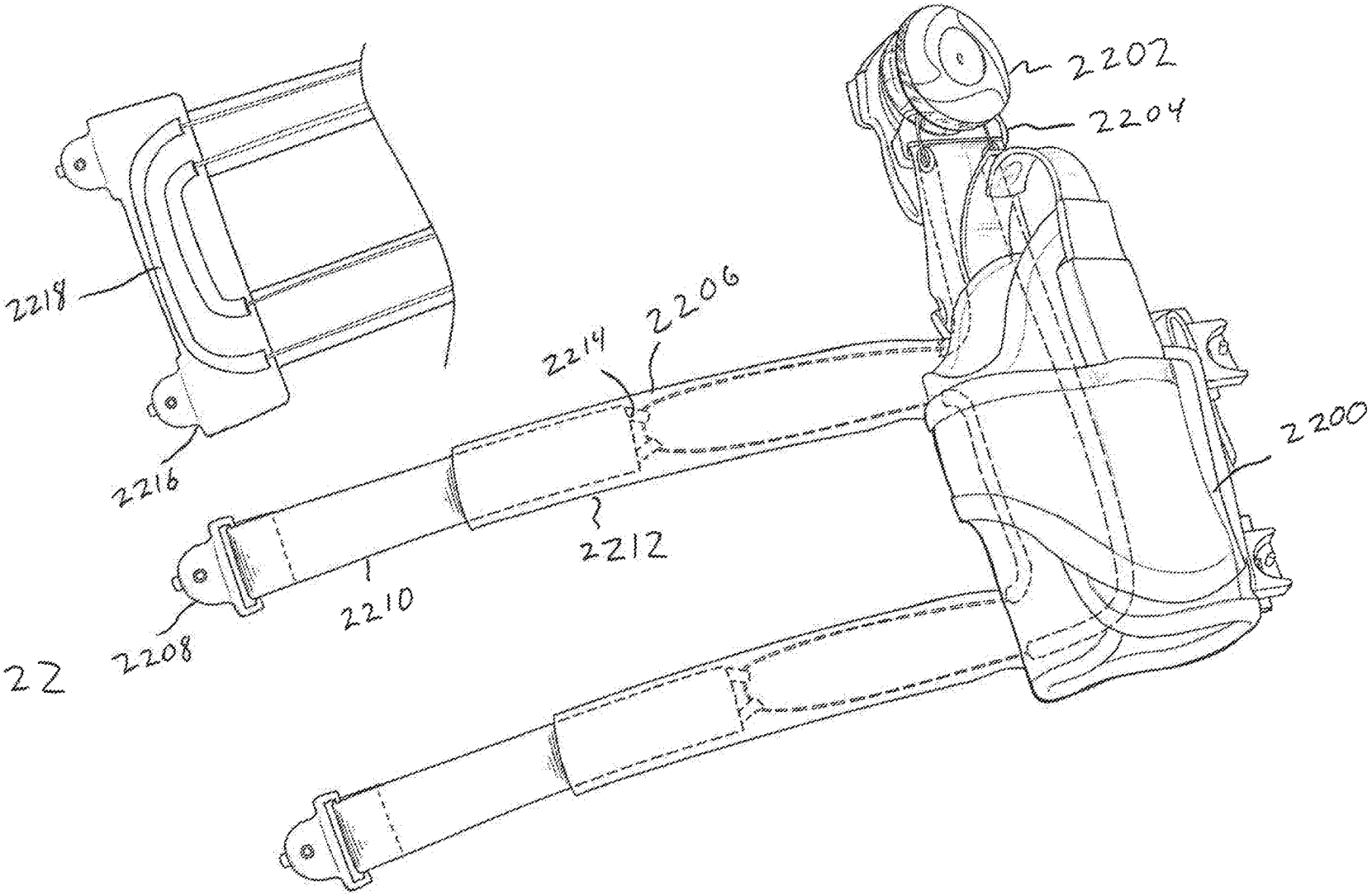

FIGS. 20-22 depict tensioning devices that secure storage compartments about a user or to another component. For example, FIG. 20 shows a pouch or bag 2000 having a top hook 2002 and bottom hook 2008 extending from a top and a bottom of the pouch 2000 respectively. A tensioning device 2004 is coupled with the pouch 2000 and configured to tension a lace 2006. The lace 2006 is coupled with the top hook 2002 and/or the bottom hook 2008 such that as the lace 2006 is tensioned, the top hook 2002 and/or the bottom hook 2008 are retracted toward the pouch 2000. A garment or pack 2010 may include a series of horizontal straps 2012 having slots or openings 2014 that may receive the hooks 2002 and 2008 of the pouch 2000. The hooks 2002 and 2008 may be positioned within the slots or openings 2014 to secure the pouch 2000 to the pack 2010. The lace 2006 may then be tensioned to retract the hooks 2002 and 2008 toward the pouch 2000 and thereby secure the hooks 2002 and 2008 within the openings 2014 of the straps 2012. In other embodiments, the hooks may be horizontally extending left and right hooks that couple with vertically oriented backpack straps.

FIG. 21 illustrates a pouch 2100 that is configured to be attached around a user's limb, such as an arm or a leg. The pouch 2100 includes a tensioning device 2102 that is coupled to a lace 2104 that is operatively coupled with one or more straps 2106. Each strap 2106 may include a coupling component 2108 that allows the straps 2106 and pouch 2100 to be easily removed from about the user's limb. The straps 2106 may each include an outer segment 2112 and an inner segment 2110 that is slidably disposed within the outer segment 2112. A distal end of inner segment 2110 may include a guide or loop 2114 that couples with a lace 2104 such that when the lace 2104 is tensioned, the inner segment 2110 slides within a lumen of channel of the outer segment 2112. This movement enables a diameter of the strap 2106 to be reduced to tighten the strap 2106 about the user's limb.

As shown in FIG. 22, a similar strap and tensioning system arrangement may be used to attach a holster 2200 to a user's limb. A tensioning device 2202 is included that is coupled to a lace 2204 that traverse along one or more straps 2206. Each strap 2206 may include a coupling component 2208 that enables easy removal of the holster 2200 from about the user's limb. The straps 2206 may each include an outer segment 2212 and an inner segment 2210 that is disposed within a channel of the outer segment 2212 as described herein. Inner segment 2210 may include a guide or loop 2214 that couples with lace 2204 so that tensioning of the lace 2204 causes the inner segment 2210 to slide within the channel or lumen of the outer segment 2212 to tighten the straps 2206 around the user's limb. In some embodiments, a detachable panel 2216 including guides 2218 may be used in place of one or more straps 2206. The lace 2204 may pass through the guides 2218 such that when the panel 2216 is coupled with the holster 2200, tensioning of the lace 2204 tightens the holster 2200 around a user's limb.

Figure 23:
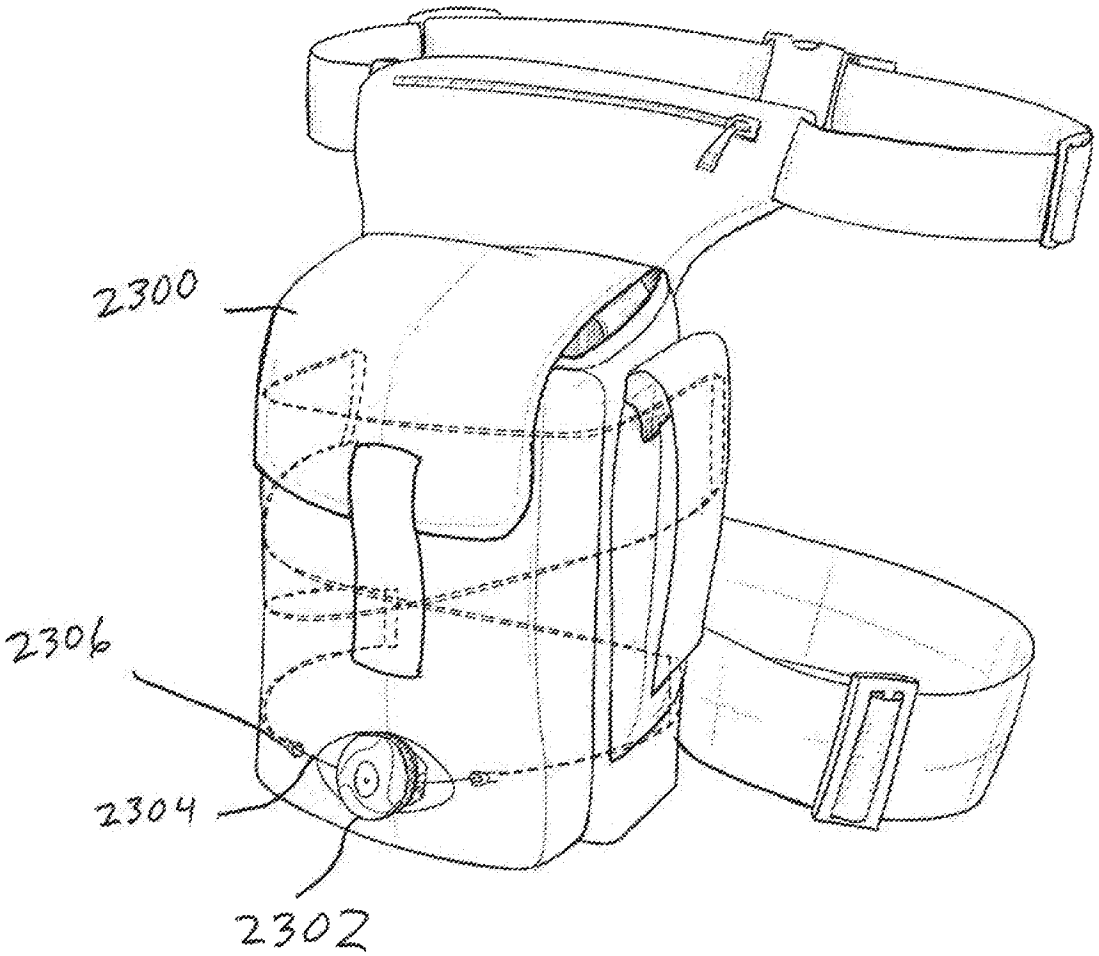
FIGS. 23-24 illustrate tensioning devices that are used to compress storage compartments.
Figure 24:
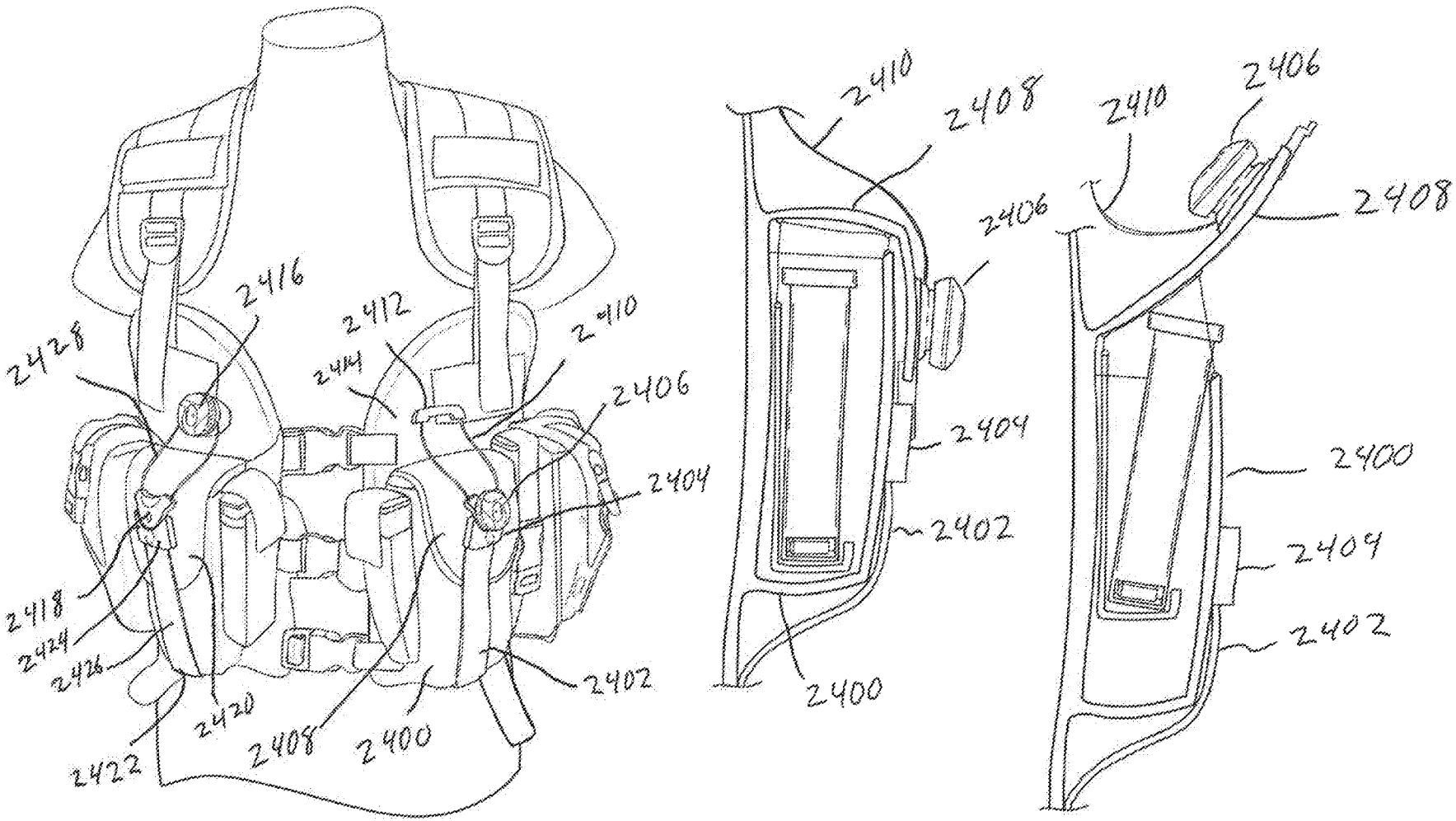

FIGS. 23-24 depict tensioning devices that are used to compress storage compartments. For example, FIG. 23 shows a pouch 2300 having a tensioning device 2302. A lace 2304 is coupled with tensioning device 2302 and passes through channels and/or guides 2306 that wrap around the pouch 2300 and along or around at least a portion of a vertical length of the pouch. As the lace 2304 is tensioned by the tensioning device 2302, the lace 2304 compresses the pouch 2300, which reduces a volume of the pouch 2300 and secures contents within the pouch 2300.

FIG. 24 shows a pouch 2400 having a strap 2402 that is disposed over a bottom portion of the pouch 2400. A proximal portion of the strap 2402 includes a receiver 2404 that couples with a coupling component of a tensioning device 2406. The tensioning device 2406 is positioned on a cover 2408 of the pouch 2400. The tensioning device 2406, or a distal end of the cover 2408, includes a coupling component that couples with the receiver 2404 of the strap 2402 to close the pouch 2400. The coupling component of the tensioning device 2406 or cover 2408 may be decoupled from the receiver 2404 to open the pouch 2400. A lace 2410 is coupled with the tensioning device 2406 and with a guide 2412 positioned on a surface of a jacket 2414. As the lace 2410 is tensioned, the tensioning device 2406 pulls the strap 2402 upward toward the jacket 2414 to compress the pouch 2400.

In other embodiments, a tensioning device 2416 may be positioned on the surface of the jacket 2414 and a detachable guide 2418 may be coupled with a distal end of a lace 2428 that is operatively attached to the tensioning device 2416. The detachable guide 2418 may be coupled with a receiver 2424 that is disposed on a distal end of the strap 2426. When the detachable guide 2418 is coupled with the receiver 2424, the tensioning device 2416 may be operated to tension the lace 2428, which tensions and pulls the strap 2426 toward the jacket 2414 via detachable guide 2418 to compress the pouch 2422.

Figure 25:
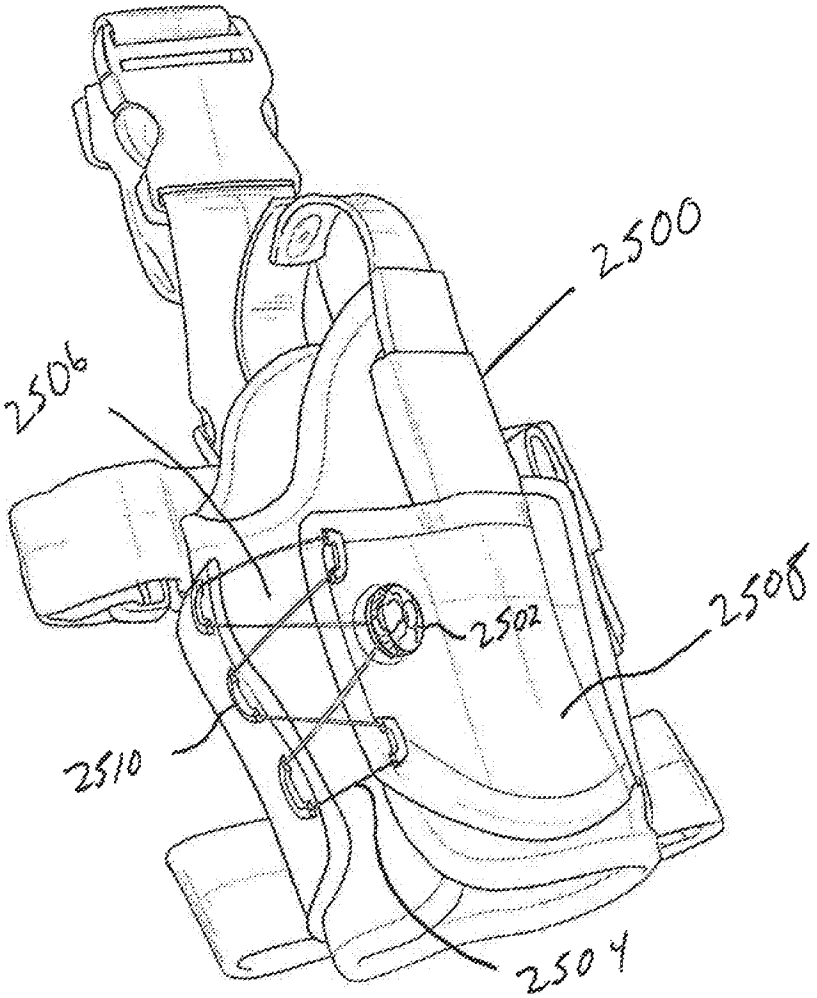
FIGS. 25-26 illustrate tensioning devices that may be used to secure a firearm or other object within a holster.
Figure 26:
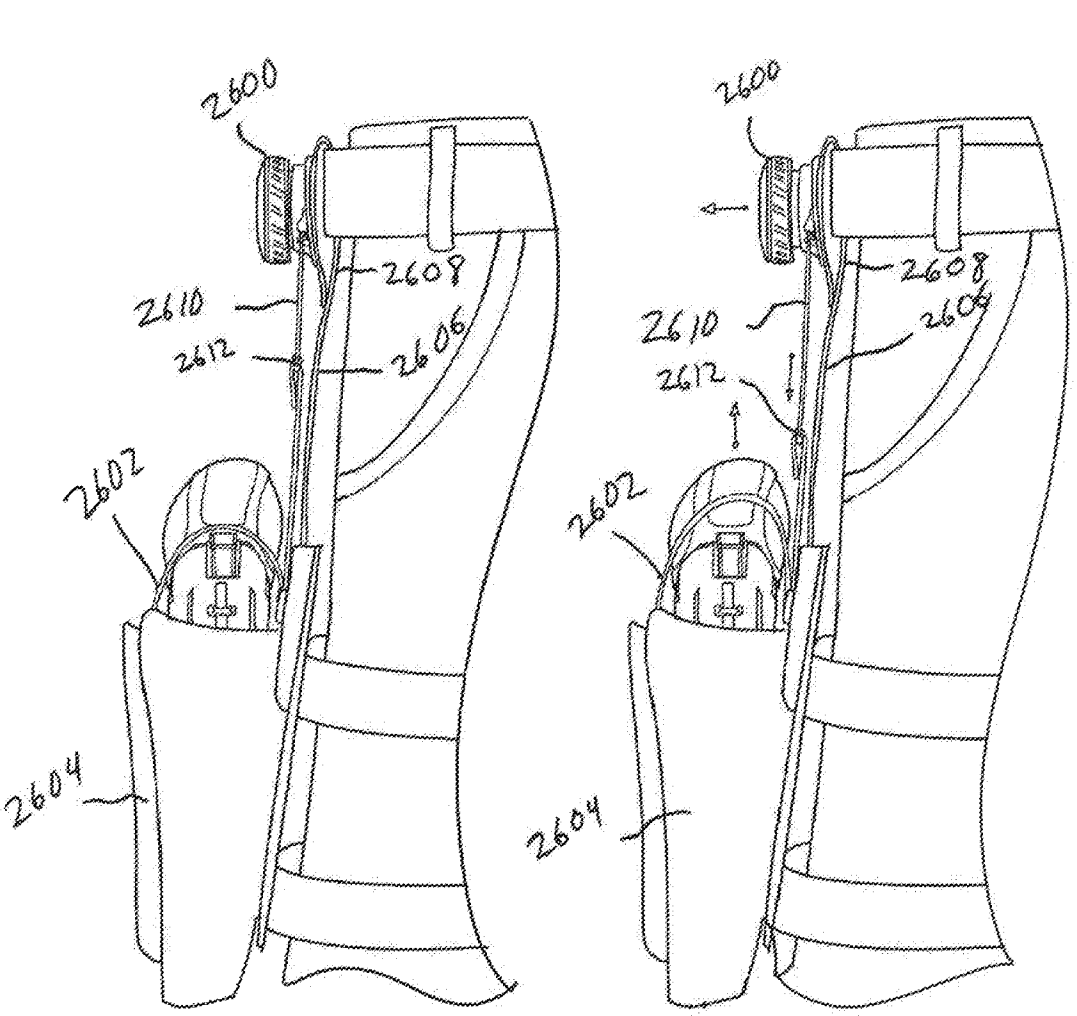

FIGS. 25 and 26 illustrate tensioning devices that may be used to secure a firearm or other object within a holster. For example, FIG. 25 depicts a holster 2500 having a tensioning device 2502. The tensioning device 2502 may tension a lace 2504 that spans an opening or gap 2506 in an outer shell 2508 of the holster 2500. The lace 2504 extends across the opening 2506, such as in a crisscross pattern directed by guides 2510, such that when tensioned, the lace 2504 pulls opposing ends of the outer shell 2508 toward one another to tighten the holster 2500 around a gun or other object.

FIG. 26 shows a tensioning device 2600 that may be used to secure a release strap 2602 around a firearm or other weapon positioned within a holster 2604. The tensioning device 2600 may be positioned on a strap 2606 that is coupled at a distal end with the holster 2604. The tensioning device 2600 may be positioned on a proximal end of the strap 2606, such as on a belt loop 2608 that couples with a user's belt. Positioning the tensioning device 2600 near the user's belt enables a user to easily access and operate the tensioning device 2600. The tensioning device 2600 is operatively coupled with a lace 2610 that is in turn coupled with a proximal end of the release strap 2602 via a guide 2612. The release strap 2602 is slidingly disposed through a slot or opening on a first side of the holster 2604 and a distal end of the release strap 2602 is attached to a second side of the holster 2604 so that a distal portion of the release strap 2602 is disposed over the top of the firearm or weapon that is positioned within the holster 2604. As the lace 2610 is tensioned, via tensioning device 2600, the release strap 2602 is pulled through the slot or opening of the gun holster so that the distal portion of the strap 2602 is tightened against the firearm or weapon positioned within the holster 2604. In this manner, operation of the tensioning device 2600 secures the firearm or weapon within the holster 2604. The tensioning device 2600 may similarly be operated to loosen the lace 2610, which allows the release strap 2602 to be retracted through the slot or opening of the gun holster 2604 so that the distal portion of the strap 2602 is loosened from about the firearm or weapon, thereby enabling the firearm or weapon to be removed from the holster 2604. Accordingly, the tensioning device 2600 may be used to both secure the firearm or weapon within the holster 2604 and to enable quick access thereto.

Figure 27:
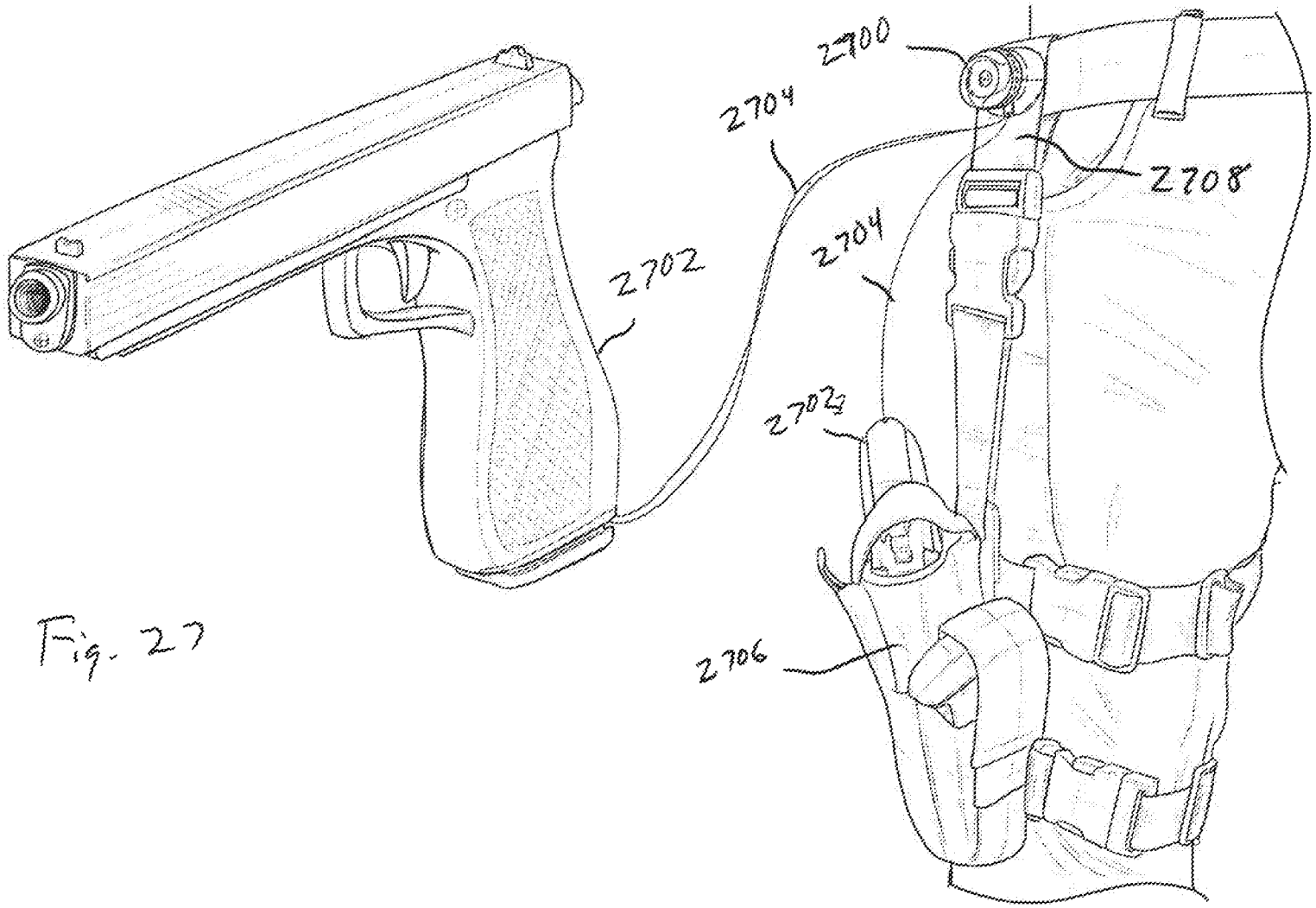
FIG. 27 illustrates a tensioning device that tensions a lace.

FIG. 27 shows a tensioning device 2700 that tensions a lace 2704. The lace 2704 couples with a butt of a gun 2702 and serves as a tether for the gun 2702. The tensioning device 2700 is coupled to a portion of the holster 2706, such as a belt loop 2708. When the gun 2702 is secured within the holster 2706, the lace 2704 may be tensioned to reduce the length of the lace 2704 present outside of the tensioning device 2700. As the gun 2702 is removed from the holster 2706, the tensioning device 2700 may be disengaged to release the lace 2704, allowing a user to pull the gun 2702 a usable distance away from the holster 2706. The lace 2704 also prevents the gun 2702 from being moved beyond a certain distance set by the length of the lace 2704. Such tethering ensures that the gun 2704 is not lost or stolen.

Boots and Other Footwear

FIGS. 28-45 provide various closure devices that may be used to tighten footwear, such as boots. Due to the increased amount of leg covered by a boot, it is often difficult to provide a proper fit for a user. Not only does a user need to properly fit the foot portion of the boot, but also must properly fit the lower leg portion of the boot against the foot. Embodiments herein provide adjustable configurations for closure devices that enhance the closure process to meet a variety of user needs. Embodiments may provide a proper fit for all or a portion of the wearer's leg and/or foot. In some embodiments, an inner shell, tongue, and/or other internal feature may be used to adjust the fit of a boot or other footwear without altering the exterior surface of the boot.

For convenience, the disclosure will focus mainly on boots, although it should be realized that the embodiments described herein may be used with a variety of other articles, such as garments, footwear, or other structure. In addition, for convenience in describing the embodiments, the disclosure generally describes the devices, or components thereof, being closed via a reel or dial mechanism or a lacing system. The reel or dial mechanism or lacing system typically closes the device, or components thereof, by tensioning a lace. As described herein, the dial is typically rotated to wind a lace onto a spool. Although the disclosure generally describes the closure devices, or components thereof, using a reel or dial mechanism, it should be realized that any tightening mechanism may be used and the disclosure is not limited to embodiments that only use a reel or dial. A general description of a reel or dial mechanism is provided in FIGS. 28-31.

Figure 28:
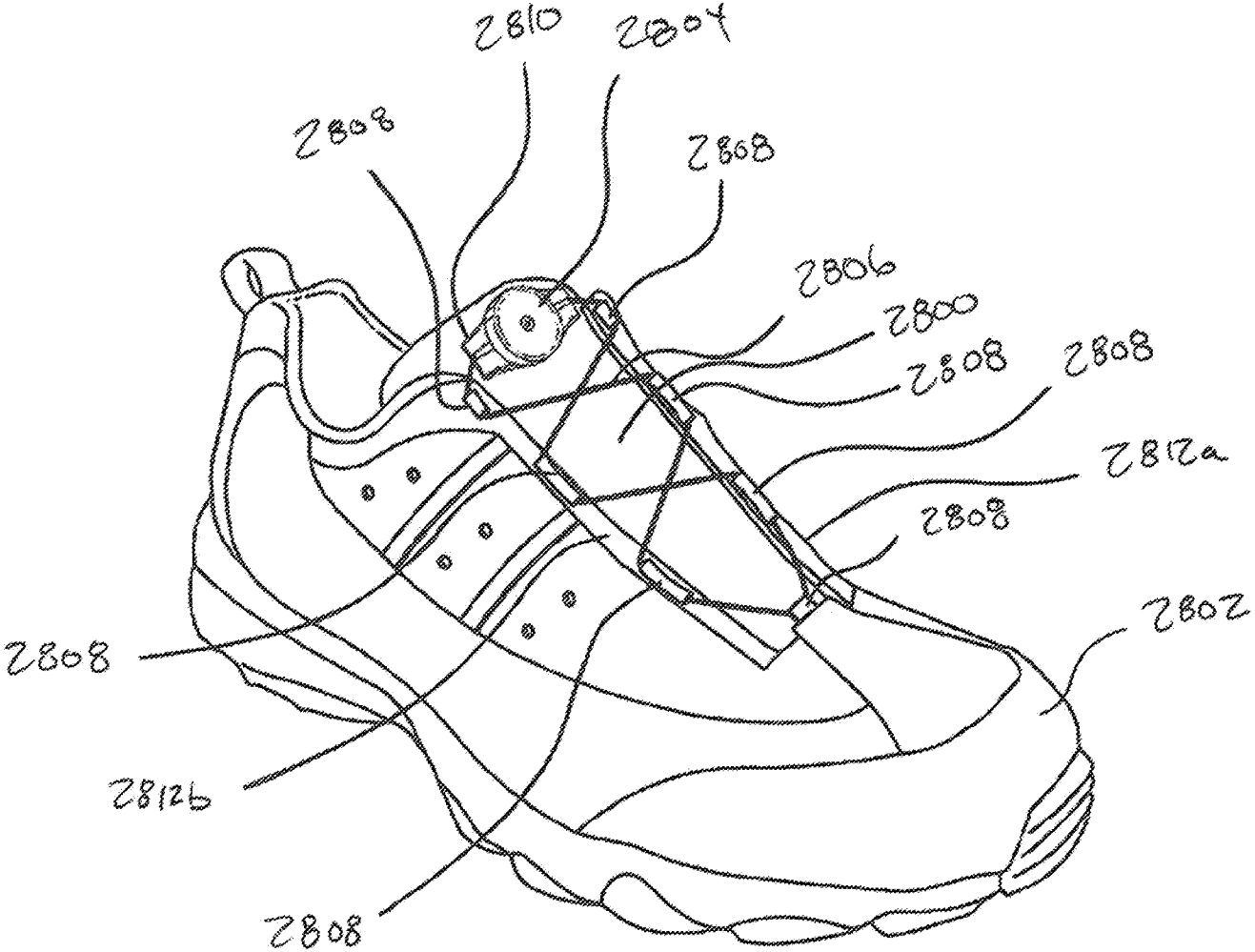
FIGS. 28-31 illustrate a general configuration of a reel or dial based mechanism that is configured to tension a lace or tension member.
Figure 29:
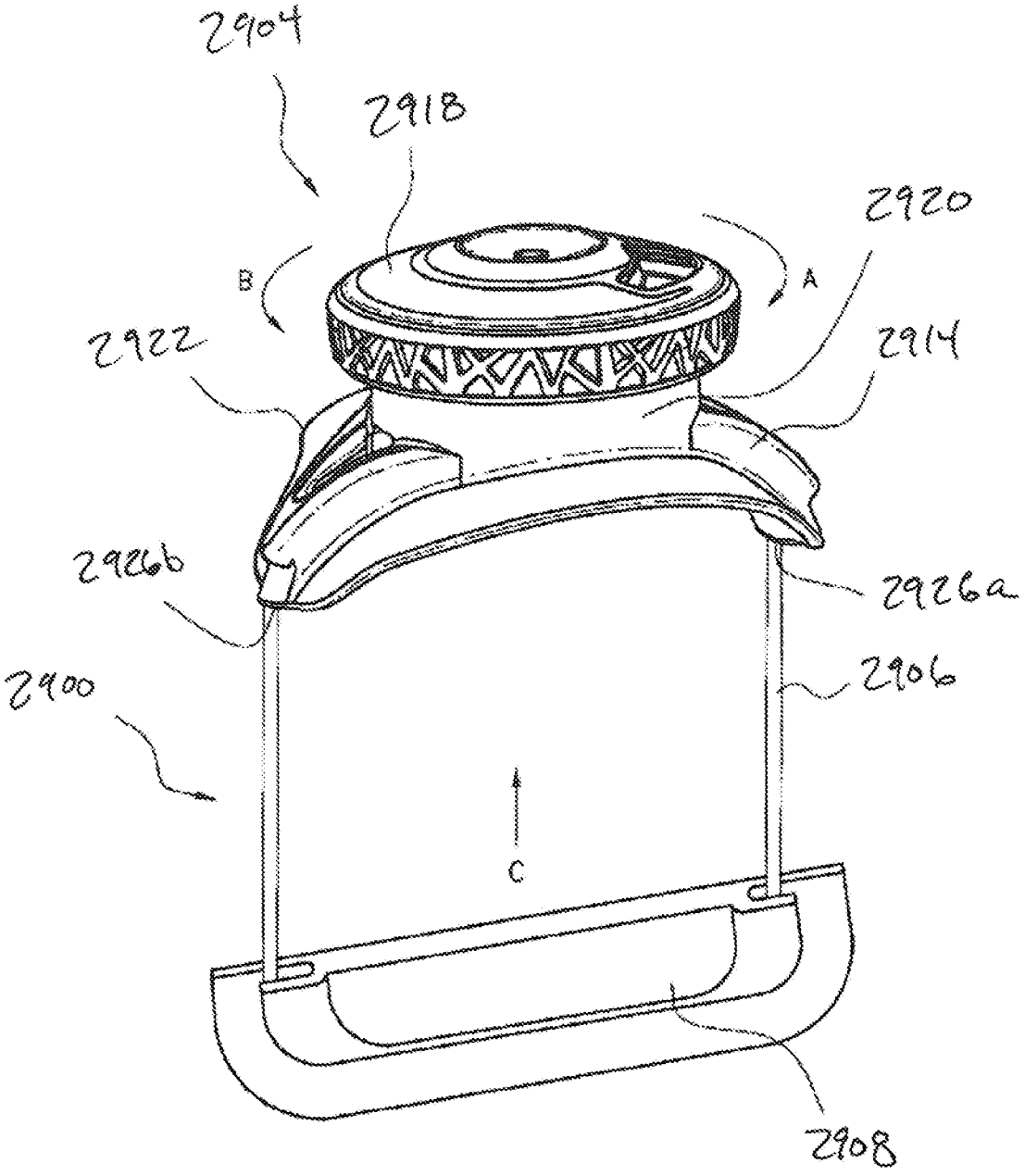
Figure 30:
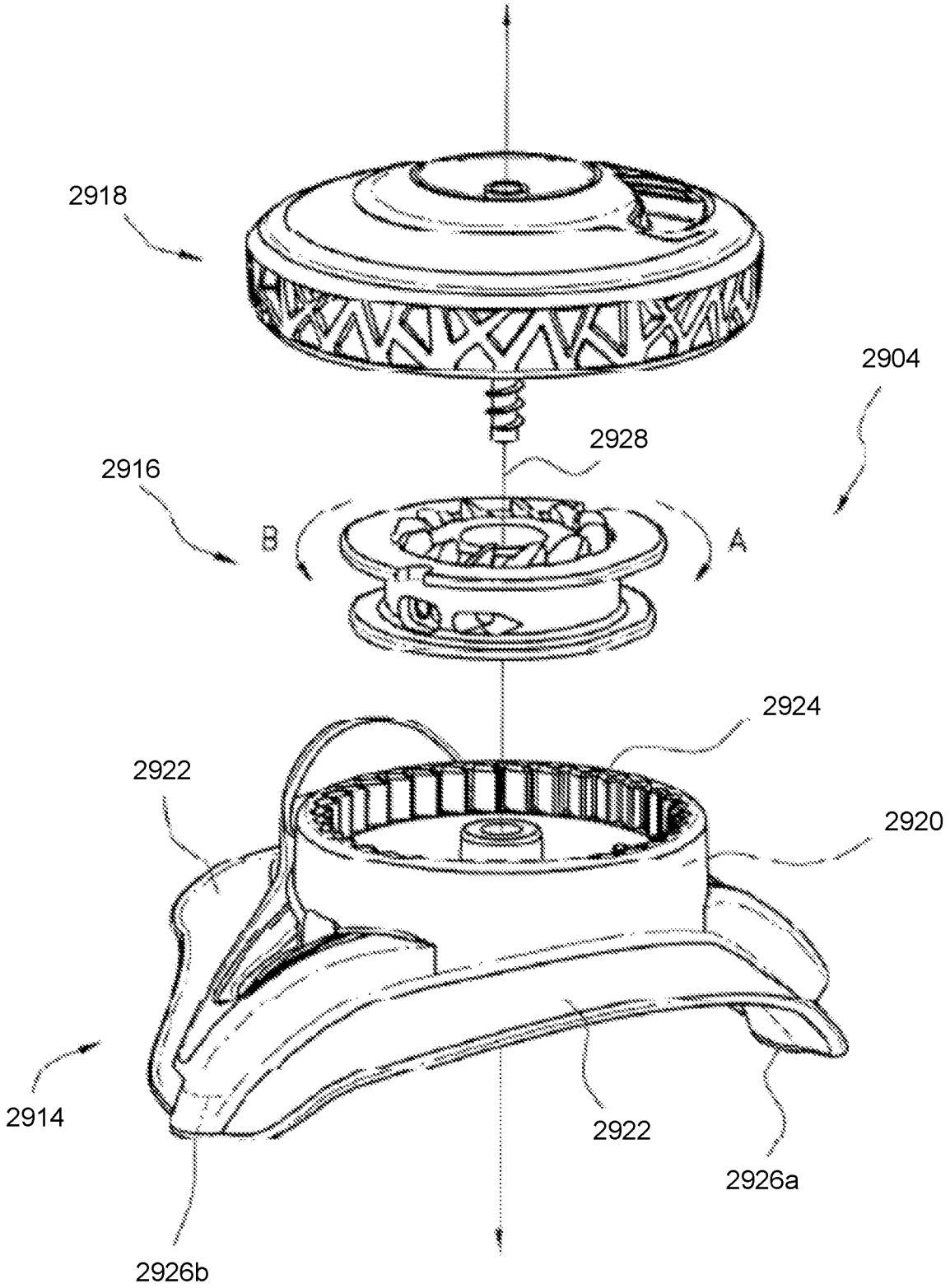
Figure 31:
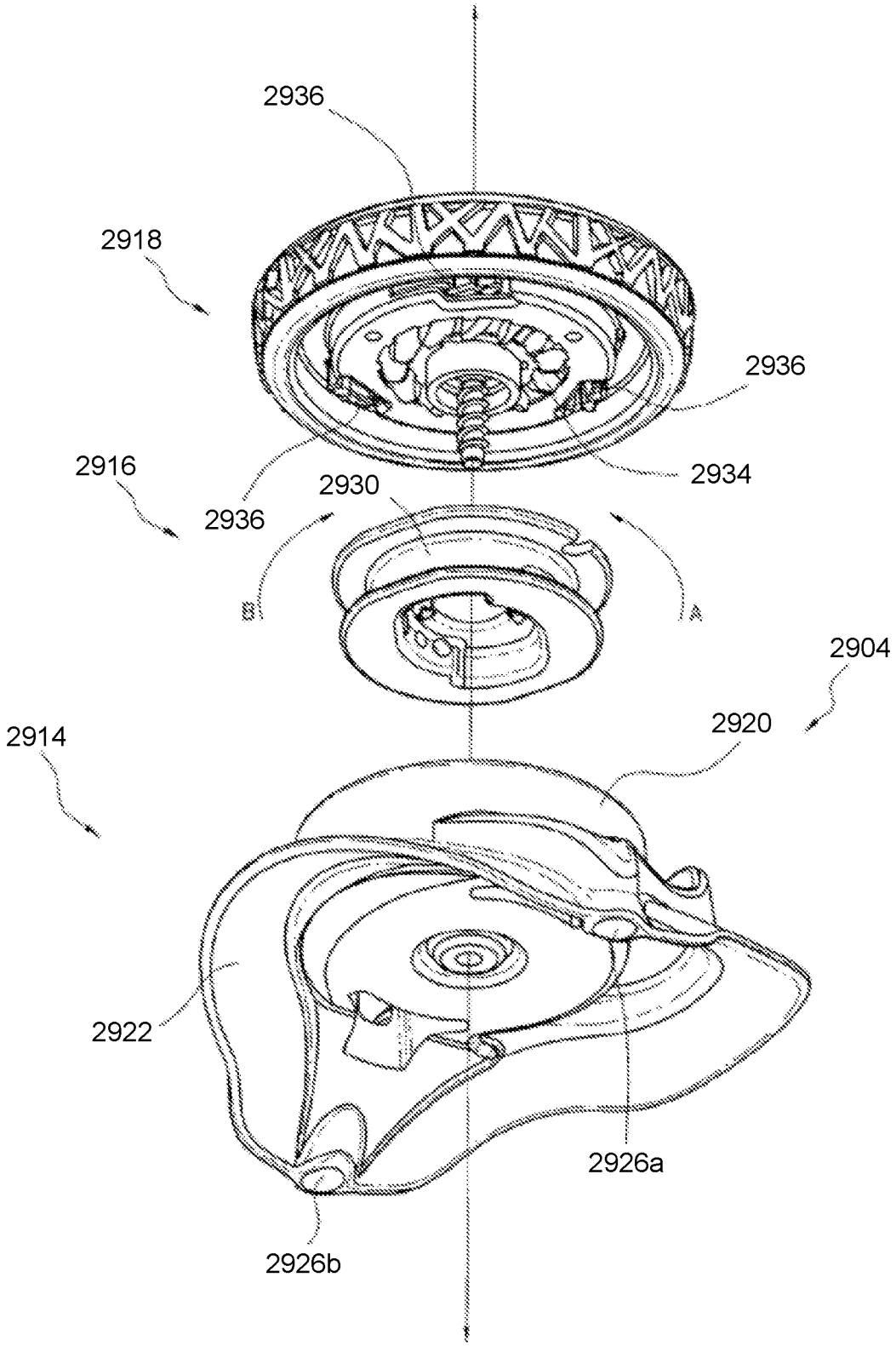

FIG. 28 is a perspective view of an embodiment of lacing system 2800 used for tightening a shoe 2802. While shown as being attached to a shoe 2802, the lacing system 2800 and related components may be incorporated into a boot, or other footwear. The lacing system includes a reel 2804, a lace 2806, and one or more lace guides 2808. The lacing system 2800 may be attached to the tongue 2810 and used to close opposing eyestays, 2812*a* and 2812*b*, of the shoe 2802. FIG. 29 is a perspective view of an embodiment of a lacing system 2900 that can be similar to the lacing system 2800, or any other lacing system. The lacing system can include a reel 2904 which can be similar to the reel 2804 or any other reel. FIG. 30 is an exploded perspective view of the reel 2904. FIG. 31 is another exploded perspective view of the reel 2904.

With reference to FIGS. 29-31, the reel 2904 can include a base member 2914, a spool member 2916, and a knob member 2918. The base member can include a housing 2920 and a mounting flange 2922. The housing 2920 can include a plurality of housing teeth 2924, which can extend radially inwardly. The housing 2920 can include lace holes 2926*a-b* that allow the lace 2906 to enter the housing 2920.

The spool member 2916 can be disposed within the housing 2920 such that the spool member 2916 is rotatable about an axis 2928 with respect to the housing 2920. The lace 2906 can be secured to the spool member 2916 such that when the spool member 2916 rotates in a tightening direction (shown by arrow A) the lace 2906 is drawn into the housing 2920 and is wound around the channel 2930 formed in the spool member 2916, and when the spool member 2916 rotates in a loosening direction (shown by arrow B) the lace 2906 unwinds from the channel 2930 of the spool member 2916 and exits the housing 2920 via the lace holes 2926*a-b*. The spool member 2916 can also include spool teeth formed thereon. It will be understood that the embodiments disclosed herein can be modified such that rotation in the direction shown by arrow B will tighten the lacing. In this particular embodiment, the knob member 2918 may be raised axially to disengage from spool 2930 to allow the spool to freewheel in direction B in order to release the lace. In other embodiments, rotation of the dial in the direction shown by arrow A may loosen the lacing system.

The knob member 2918 can be attached to the housing 2920 such that the knob member 2918 can rotate about the axis 2928 with respect to the housing 2920. The knob member 2918 can include knob teeth 2934 that can be configured to mate with the spool teeth to couple the knob member 2918 to the spool member 2916 such that rotation of the knob member 2918 in the tightening direction causes the spool member 2916 to also rotate in the tightening direction. In some embodiments, the rotation of the knob member 2918 in the loosening direction can also cause the spool member 2916 to rotate in the loosening direction. The knob member 2918 can also include one or more pawls 2936 which can be biased radially outwardly so as to mate with the housing teeth 2924. The pawls 2936 and housing teeth 2924 can be configured so that the housing teeth 2924 can displace the pawls 2936 radially inwardly when the knob member 2918 is rotated in the tightening direction, thereby allowing the knob member 2918 to rotate in the tightening direction. The pawls 2936 and the housing teeth 2924 can also be configured so that they engage one another when force is applied to twist the knob member 2918 in the loosening direction, thereby preventing the knob member 2918 from rotating in the loosening direction.

Thus, the reel 2904 can provide a one-way tightening system configured to allow the user to rotate the knob member 2918 in the tightening direction, which causes the spool member 2916 to rotate in the tightening direction, which in turn causes the lace 2906 to be drawn into the housing 2920 via the lace holes 2926*a-b*. As the lace 2906 is drawn into the housing 2920 the lacing system 2900 can tighten, causing the lace guide 2908 to be drawn in the direction toward the reel 2904 (shown by arrow C in FIG. 29). Although the lacing system 2900 is shown with a single lace guide 2908, any other suitable number of lace guides can be used. Other feature of the reel and lacing system are described in U.S. Patent Application No. 2011/0266384, filed Apr. 29, 2011, and Titled "Reel Based Lacing System", the entire disclosure of which is incorporated herein by reference.

Figure 32:
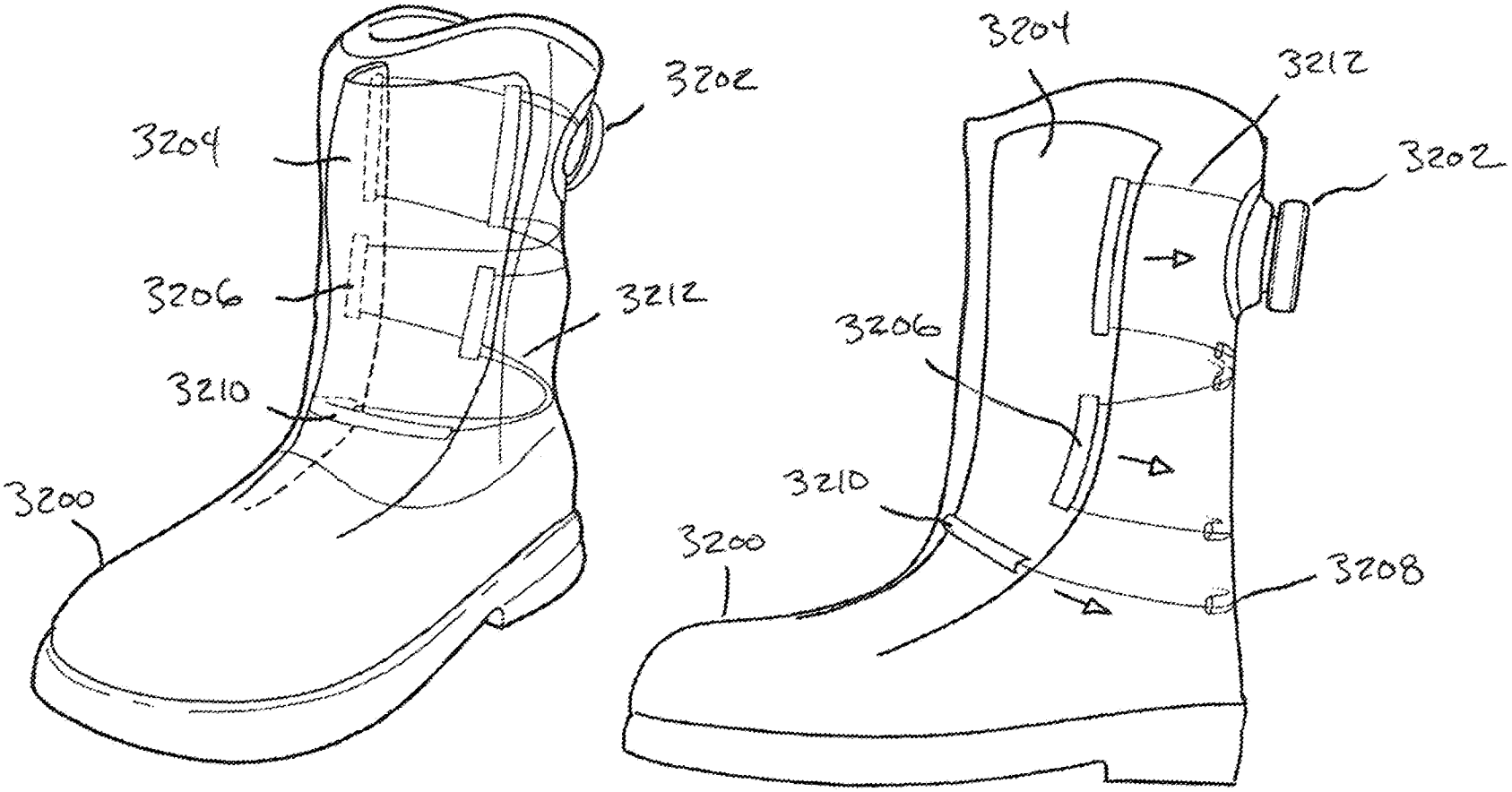
FIG. 32 illustrates a boot having a reel based closure system that tightens an internal tongue portion against a user's leg.

FIGS. 32-45 illustrate various embodiments in which a boot or work shoe may be closed and/or tightened about a user's foot. FIG. 32 depicts a boot 3200 having a reel based closure system 3202 (hereinafter reel 3202) that tightens an internal tongue 3204 against a user's leg. Tongue 3204 may be attached to boot 3200 and is typically a part of an inner shell within boot 3200. For example, a base of tongue 3204 may be coupled with or integrally formed with an inside of boot 3200. Tongue 3204 may include one or more guides 3206 positioned along edges of the tongue 3204 or elsewhere. One or more additional guides 3208 may be positioned along a back of boot 3200. Another guide or guides 3210 may be positioned near a base of tongue 3204 and/or may extend across a lower portion thereof. A lace 3212 may extend from reel 3202 and pass through guides 3206, 3208, and 3210 to form a lace path. For example, the lace 3212 may pass from the reel 3202 to one or more guides 3206 positioned on opposing sides of the tongue 3204 and wrap around inner sides of the boot 3200 to one or more guides 3208 positioned on the back of boot 3200. The lace 3212 may also extend through a guide 3210 positioned near a base of tongue 3204. Such a lace pattern where the lace 3212 alternates from side to side of boot 3200 enables the tensioned lace 3212 to pull the tongue 3204 towards the back of the boot 3200. By pulling tongue 3204 toward the back of boot 3200 using guides 3206, 3208, and/or 3210, a user's heel and foot may be pressed against a heel of the boot 3200. Pulling the tongue 3204 toward back of boot 3200 using guides 3206 and/or 3208 may tighten the boot 3200 and tongue 3204 around a user's lower leg. It will be appreciated that other configurations of guides and/or reels may be used to tighten a boot against a wearer's foot and/or leg.

Figure 33:
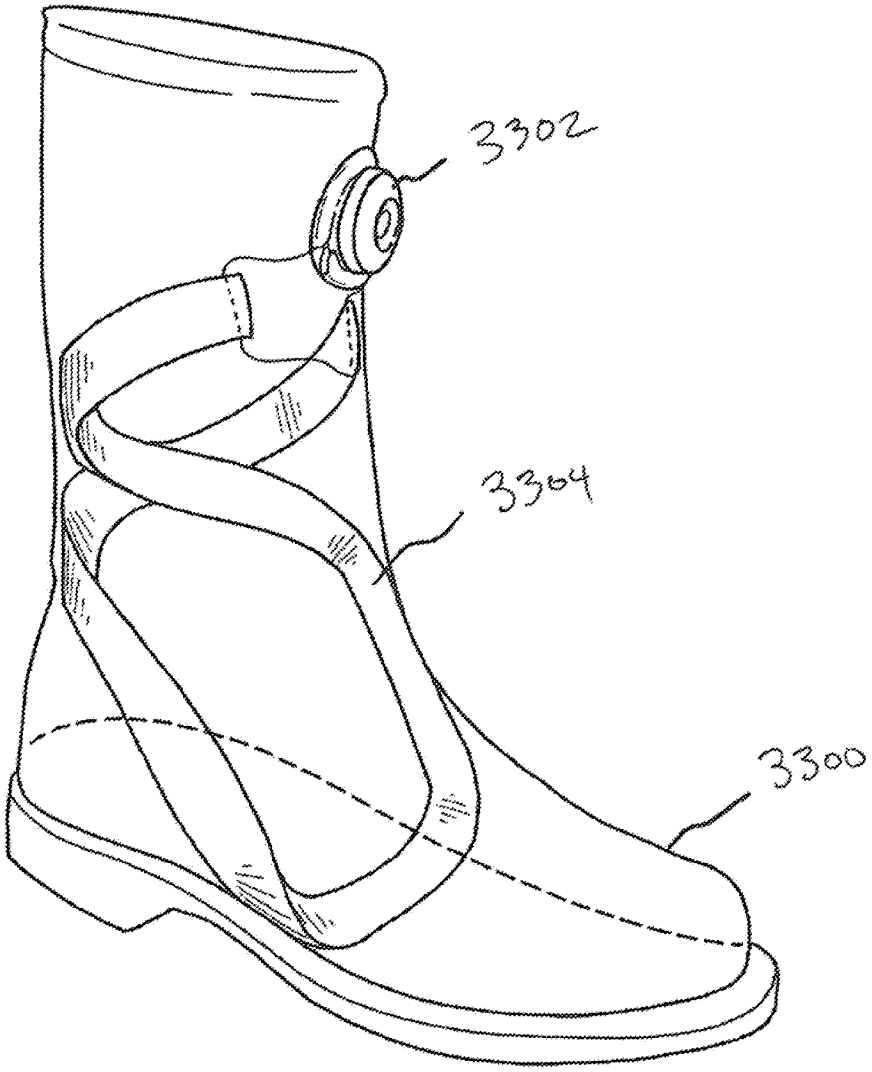
FIGS. 33-36 illustrate tightening systems employing straps or strips of material to tighten and/or secure a boot against a wearer's foot and/or leg.
Figure 34:
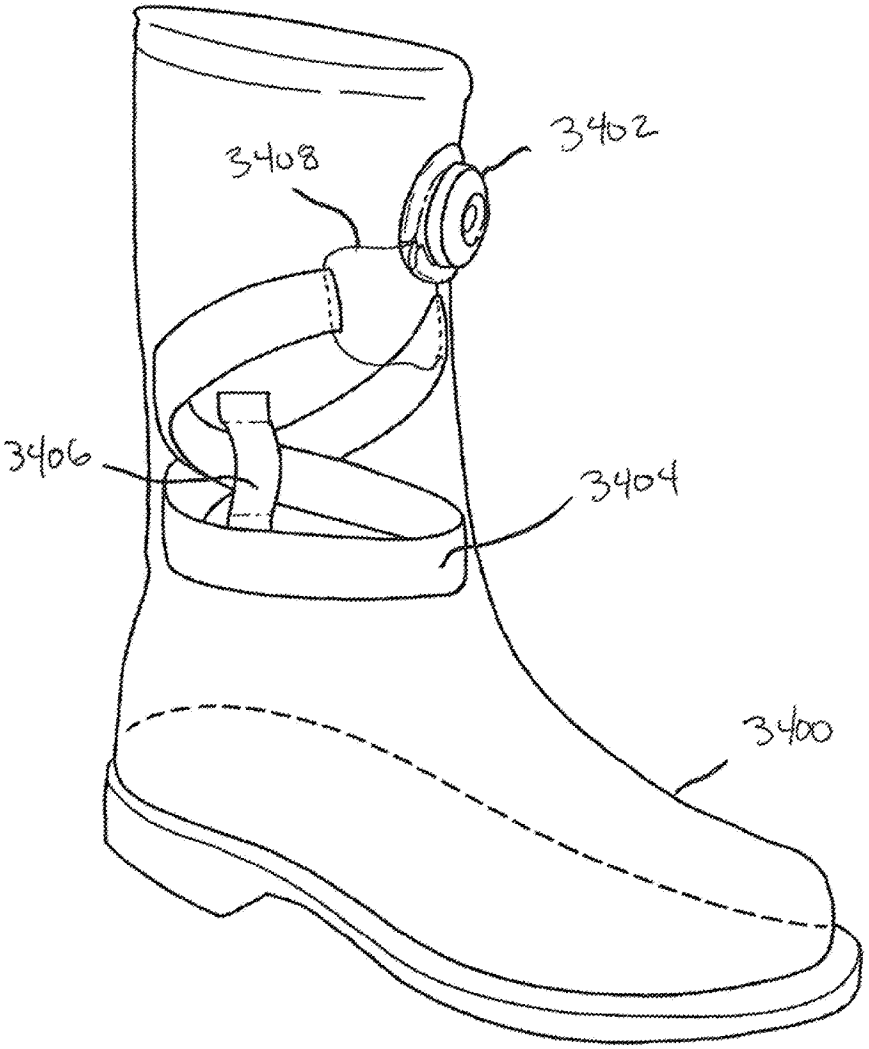

FIGS. 33 and 34 show tightening systems using straps or strips of material to tighten and/or secure a boot against a wearer's foot and/or leg. For example, FIG. 33 shows a boot 3300 having a reel based mechanism 3302 (hereinafter reel 3302) that tightens a strap or wrap 3304 within the boot 3300. Strap 3304 may be a flexible material of any width desired. The width of strap 3304 affects the force distribution on the boot 3300 and/or a wearer's foot and/or leg. A wider strap 3304 distributes a force about a larger area, which may make the strap 3304 more comfortable to wear. The strap 3304 may wrap around an interior of the boot 3300. In some embodiments, the strap 3304, or more precisely portions of the strap 3304, may be secured to the material of the interior of boot 3300, while in other embodiments, the strap may be positioned underneath one or more layers of material of the interior of the boot 3300. In some embodiments, the strap 3304 may be largely unsecured from the interior of boot 3300, acting as a harness for the wearer's leg and/or foot. In some embodiments, the strap 3304 may be looped to wrap around various portions of the boot 3300 to tighten about and support the wearer's foot and/or leg. For example, the strap 3304 may wrap around a user's lower leg, near the ankle, as well as under a portion of the foot, such as under the arch. The strap 3304 may be secured to the arch position and/or behind the leg and/or ankle such that when the strap 3304 is tightened, the user's leg is secured within boot 3300. In some embodiments, tightening the strap 3304 may increase arch support as the portion of the arch secured to the strap 3304 may be drawn upward by the tensioned strap 3304. Strap 3304 may be tightened using the reel 3302. In some embodiments, the reel 3302 may tension a lace (not shown) that is coupled with one or more ends of the strap 3304. Tensioning the lace causes the strap 3304 to tighten. In some embodiments, the reel 3302 is positioned outside the boot 3300, such as on a front of boot 3300, although in other embodiments, the reel 3302 may be positioned within the boot 3300. By tensioning the lace, the reel 3302 may draw or pull a frontal portion of the boot 3300 rearward to tighten the boot 3300 around a user's lower leg. In some embodiments, the strap 3304 may have any number of loops that warp around one or more portions of a user's foot and/or leg.

FIG. 34 depicts a boot 3400 having a reel based mechanism 3402 (hereinafter reel 3402) that tightens a strap or wrap 3404 within the boot 3400, similar to the strap 3304 of FIG. 33. The strap 3404 may wrap around a lower leg portion of boot 3400 one or more times. For example, the strap 3404 may form two loops that may secure a wearer's lower leg within the boot 3400. In some embodiments, one or more portions of the strap 3404 may be secured to the interior of the boot 3400. For example, the strap 3404 may be secured to a back of the boot 3400 such that when the strap 3404 is tightened, the strap 3404 pulls the wearer's lower leg toward the back of boot 3400, or otherwise secures firmly around the wearer's leg. The strap 3404 may be stitched or otherwise secured to the back of boot 3400. In some embodiments, the strap 3404 may be secured to back of the boot 3400 using a separate piece of fabric 3406 or other material that is stitched or otherwise secured to the interior of the boot. The strap 3404 may be tightened using the reel 3402. In some embodiments, the reel 3402 may tension a lace 3408 that is coupled with the strap 3404. For example, the lace 3408 may pass through guides or loops in the ends of the strap 3404. Tensioning the lace causes the strap 3404 to tighten.

Figure 35:
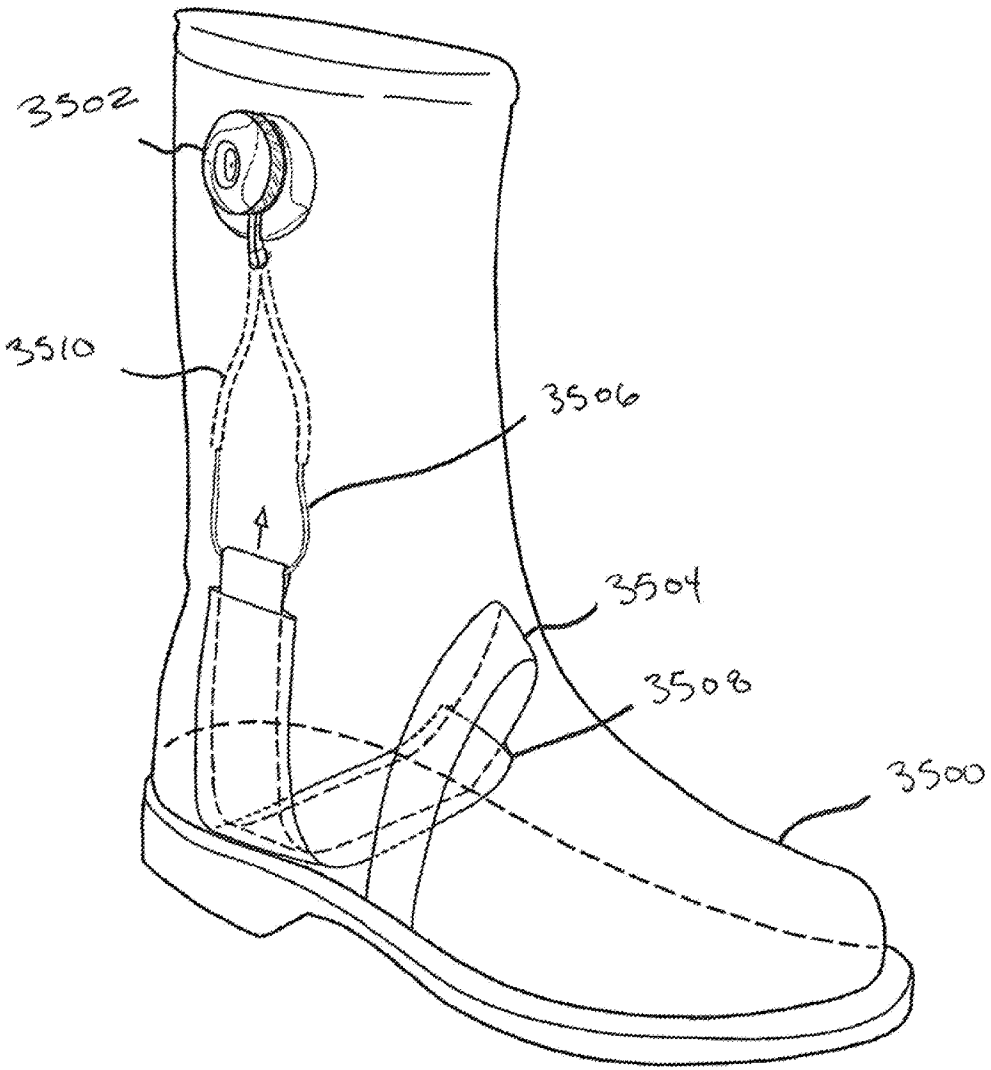

FIG. 35 shows a strap 3504 that may be used to secure a wearer's foot within a boot 3500. The strap 3504 may be fastened or otherwise secured to a side of the insole of the boot 3500. For example, the strap 3504 may be secured to an outside edge of the insole. The strap 3504 may then loop over a top of the boot's interior and through a channel or lumen adjacent or within the insole. In some embodiments, the channel 3508 may be formed of a material or sleeve that is positioned within and/or coupled to the boot 3500. The material or sleeve may function as a tunnel to direct the strap 3504 through the insole and/or along a portion of the boot. The boot 3500 may further include a reel based mechanism 3502 (hereinafter reel 3502) that is used to tension a lace 3506. The lace 3506 may pass through a loop in an end of strap 3504 such that when the lace 3506 is tensioned using the reel 3502, the strap 3504 is tensioned to tighten the strap 3504 against a user's foot. As strap 3504 is fixed at the edge of the insole, the loop portion within the boot's interior is pulled downward toward the sole of the boot 3500 and against a wearer's foot. In some embodiments, one or more guides 3510 may be included to direct the lace 3506 from the reel 3502 to the strap 3504.

Figure 36:
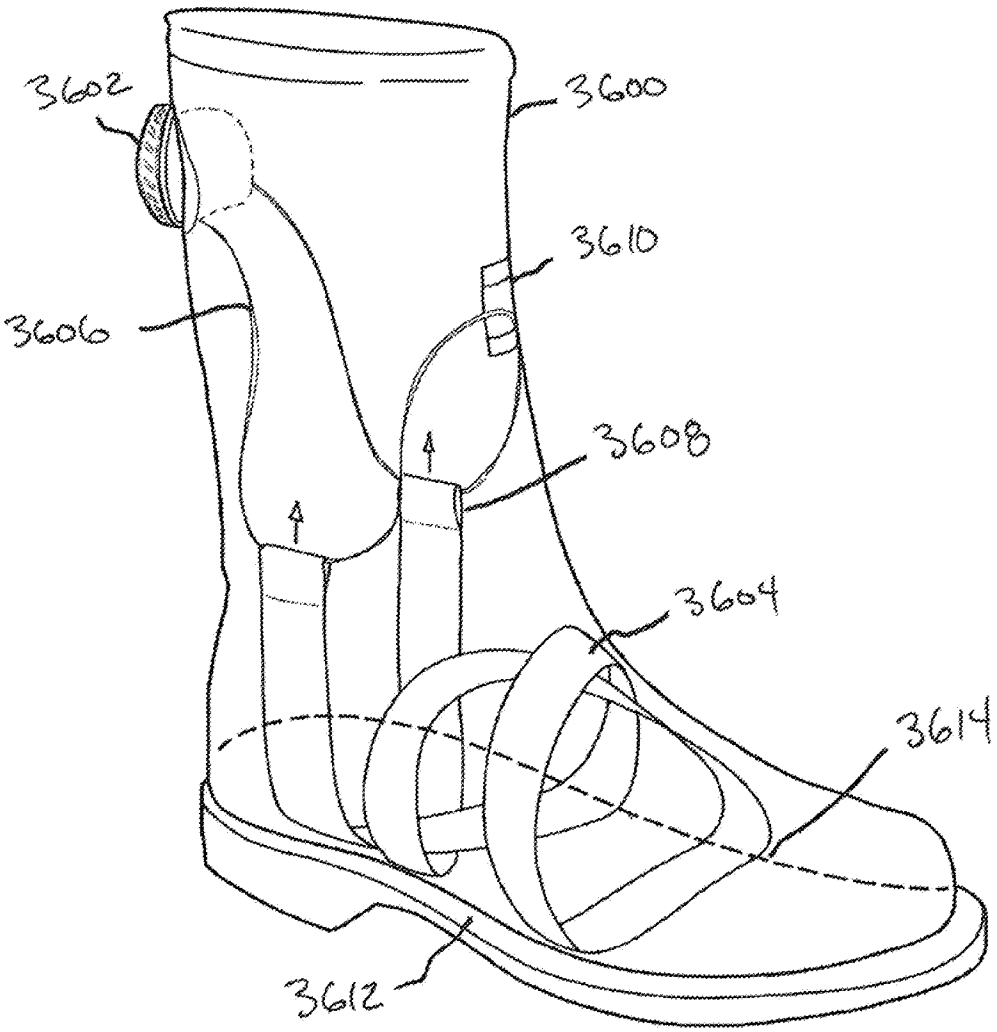

FIG. 36 shows a strap 3604, similar to the strap 3504 of FIG. 35, that secures a wearer's foot to a boot 3600. In the illustrated embodiment, the strap 3604 may wrap around an interior of the boot 3600 one or more times. A difference between the strap 3604 of FIG. 36 and the strap 3504 of FIG. 35 is that both opposing ends of the strap 3604 are tensionable to tighten or cinch the strap (or an inner portion of the boot) against a wearer's foot. For example, a first end of the strap 3604 may be positioned on a first side 3612 of the boot 3600 and extend across the insole to a second side 3614 of the boot 3600 before looping one or more times around an interior of the foot portion of the boot 3600. The strap 3604 may then extend back across the insole and up the second side 3614 of the boot 3600. In some embodiments, the strap 3604 may be positioned within the insole or other inner layer of the boot 3600, such as via one or more channels. The boot 3600 may further include a reel based mechanism 3602 (hereinafter reel 3602) that is used to tension a lace 3606. The reel 3602 may be positioned on the back of the boot 3600 or elsewhere as desired. The lace 3606 may pass through a loop 3608 in each end of the strap 3604 such that when the lace 3606 is tensioned using the reel 3602, both ends of the strap 3604 are pulled upward. As the lace 3606 is tensioned, the strap 3604 that wraps around the foot portion of the boot 3600 is tightened or cinched against the user's foot. In some embodiments, a guide 3610 may be positioned on a front interior of the boot 3600 to direct the lace 3606 from the first end of the strap 3604 to the second end of the strap 3604. The guide 3610 may also prevent the lace 3606 from digging into or directly contacting a front of the user's leg, making the boot 3600 more comfortable to wear. It will be appreciated that other reel, guide, and/or strap positions may be used to achieve desired fit and/or aesthetic characteristics for different boots.

Figure 37:
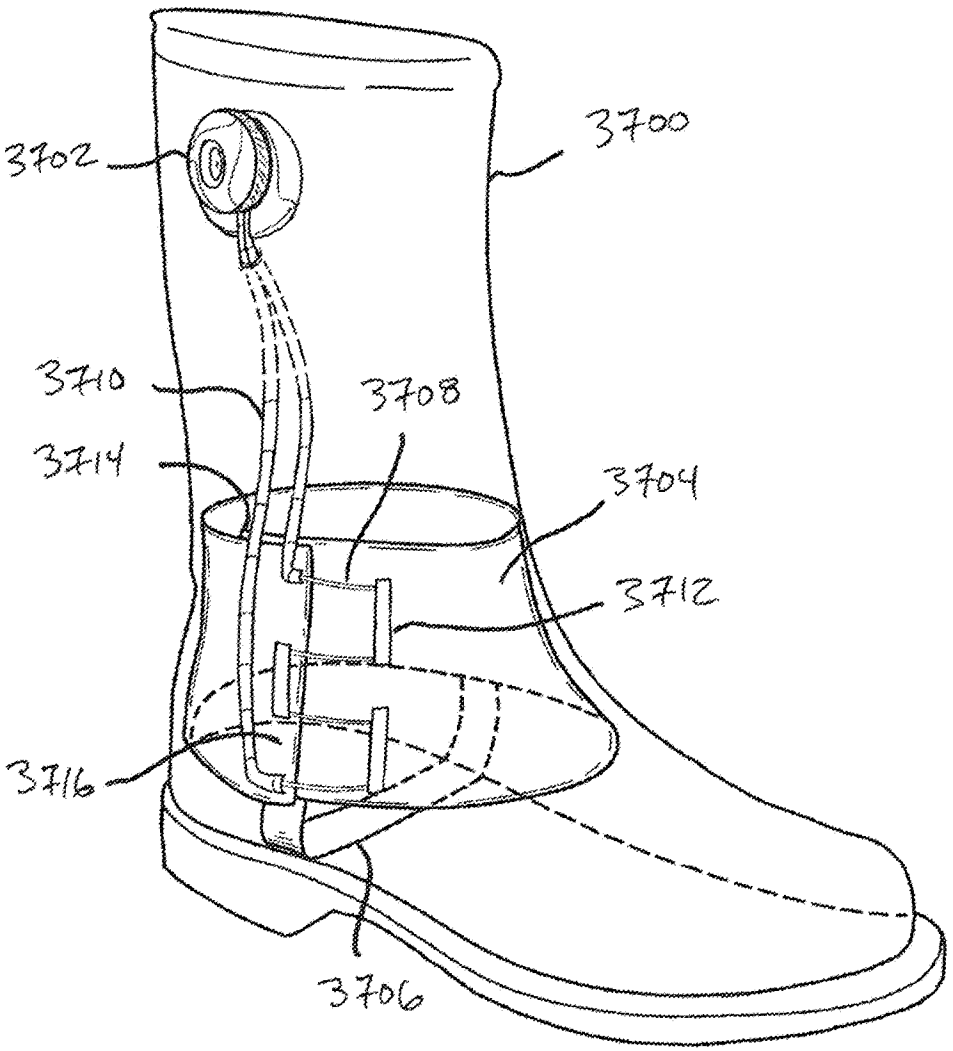
FIG. 37 illustrates a collar wrap mechanism that wraps around an interior of a boot to secure a user's lower leg and/or ankle within boot.

FIG. 37 depicts a collar wrap mechanism 3704 that wraps around an interior of a boot 3700 to secure a user's lower leg and/or ankle within the boot 3700. The collar wrap mechanism 3704 may be a wide strap, shell, or liner having a first end 3714 and a second end 3716. The collar wrap mechanism 3704 may be tightened around a user's lower leg by pulling the first end 3714 toward the second end 3716 such that the second end 3716 overlaps the first end 3714, or such that an overlap of the second end 3716 and first end 3714 is increased. By increasing the amount of overlap, the collar wrap mechanism 3704 may be tightened about a wearer's leg. In some embodiments, a strap 3706 may be coupled with the collar wrap mechanism 3704, such as with an insole of boot 3700. The strap 3706 prevents the collar wrap mechanism 3704 from moving upward or otherwise out of position upon tightening of the collar wrap mechanism 3704 around the wearer's leg. In some embodiments, the boot 3700 may include a reel based mechanism 3702 (hereinafter reel 3702) that tensions a lace 3708. One or more guides 3710, such as tubing, may direct the lace 3708 from the reel 3702 to the collar wrap mechanism 3704. The collar wrap mechanism 3704 may include one or more guides 3712 positioned on the first end 3714 and/or the second end 3716 that function to guide the lace along a path about the first end 3714 and second end 3716 and/or cause the first end 3714 and second end 3716 to be pulled together. For example, as the lace 3708 is tightened, the lace 3708 pulls the first end 3714 toward the second end 3716 and increases the amount of overlap to tighten the collar wrap mechanism 3704 around a user's lower leg.

Figure 38:
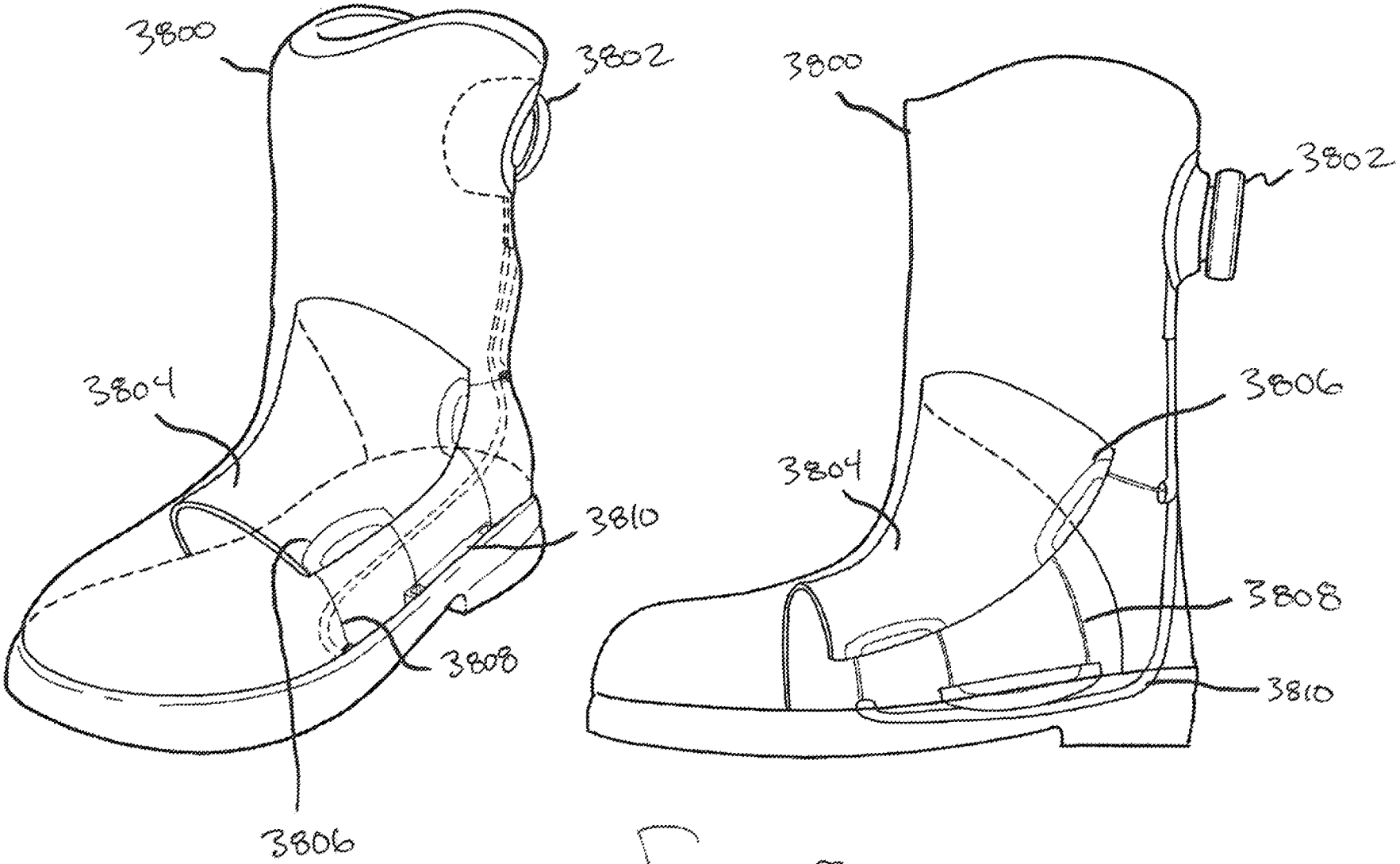
FIGS. 38-41 illustrate tightening systems that employ flexible canopy members or shells that press inward against a user's foot and/or leg.
Figure 39:
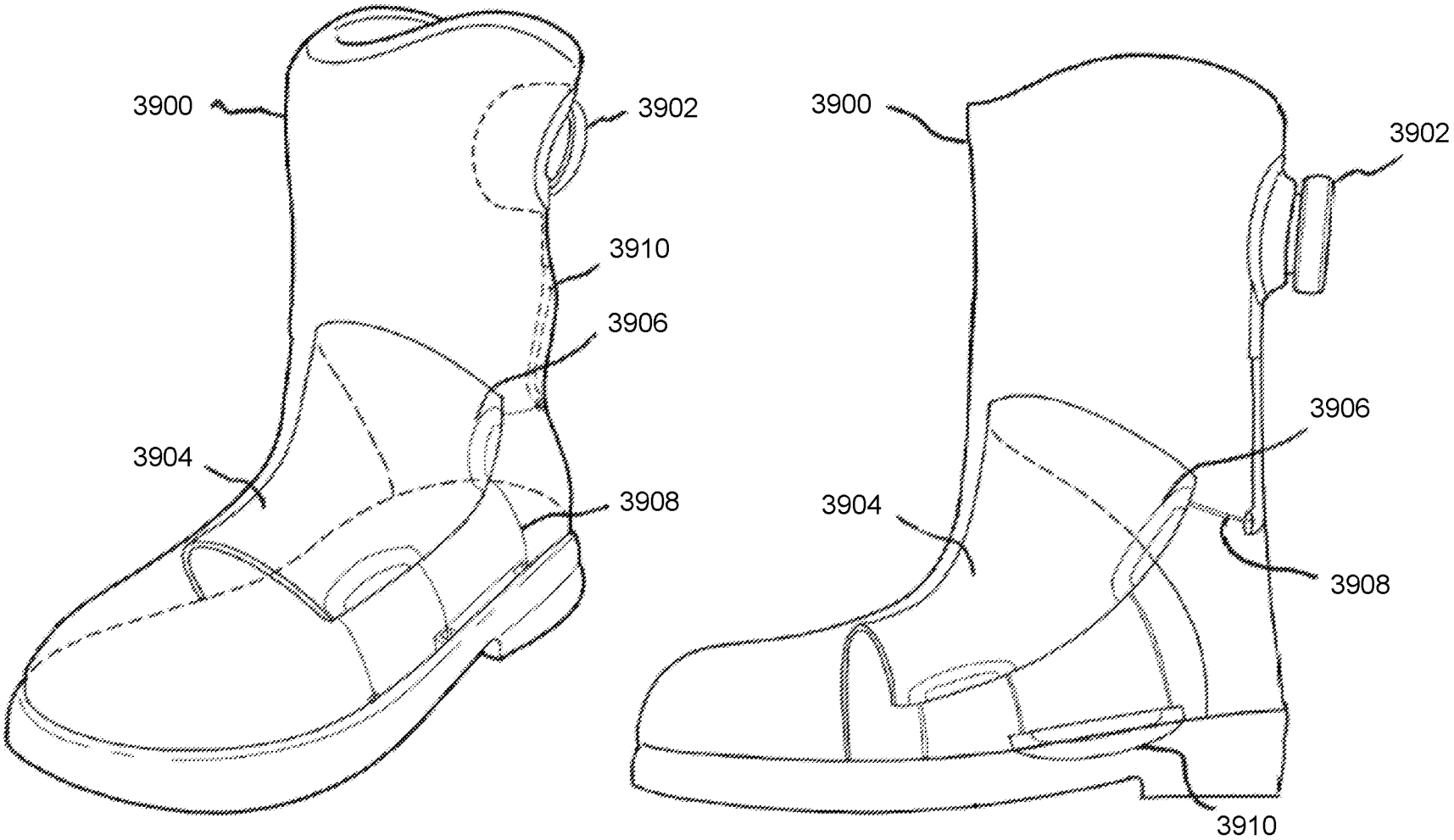

FIGS. 38-41 show embodiments of fitting a boot to a wearer's foot or leg using flexible canopy members that pull a user's foot toward the insole and/or heel of a boot. For example, FIG. 38 shows a boot 3800 having a canopy member 3804 positioned above at least a portion of the foot section of the boot 3800. In some embodiments, one side of the canopy 3804 may be secured to a side and/or insole of the boot 3800. For example, an instep side of the canopy 3804 may be secured to the inner side and/or inner portion of the insole of the boot 3800. A free end or side may include one or more guides 3806 that may receive a lace 3808. The lace 3808 may be tensioned by a reel based mechanism 3802 (hereinafter reel 3802) that is positioned on the boot 3800. One or more guides 3810 may positioned on or within the boot 3800 to direct the lace 3808 from the reel 3802 to corresponding guides 3806 on the canopy member 3804 and/or positioned near or within the boot's insole. In some embodiments, the guides 3806 and 3810 are positioned and aligned such that when the lace 3808 is tensioned, the free end of the canopy member 3804 is drawn toward the guides 3810 and against a wearer's foot to pull the wearer's foot against the insole and/or heel portions of the boot 3800. In some embodiments, the canopy member 3804 may press directly against a wearer's foot, while in other embodiments the canopy member 3804 presses against an inner liner or surface of the boot 3600. In some embodiments, the lace 3808 may form a loop from the reel 3802 through guides 3806 and 3810 and return to the reel 3802, while in other embodiments one end of the lace 3808 may terminate within the boot as shown in FIG. 39. Terminating one end of the lace 3908 as shown in FIG. 39 may increase the tension that is imparted to the lace via a reel based mechanism 3902, which may increase the closure force imparted to a canopy member 3904. This in turn may increase the fit of the boot 3900 about a user's leg. As described herein, tubing 3910 and/or one or more guides 3906 may be used to route the lace 3908 within the boot along a lace path.

Figure 40:
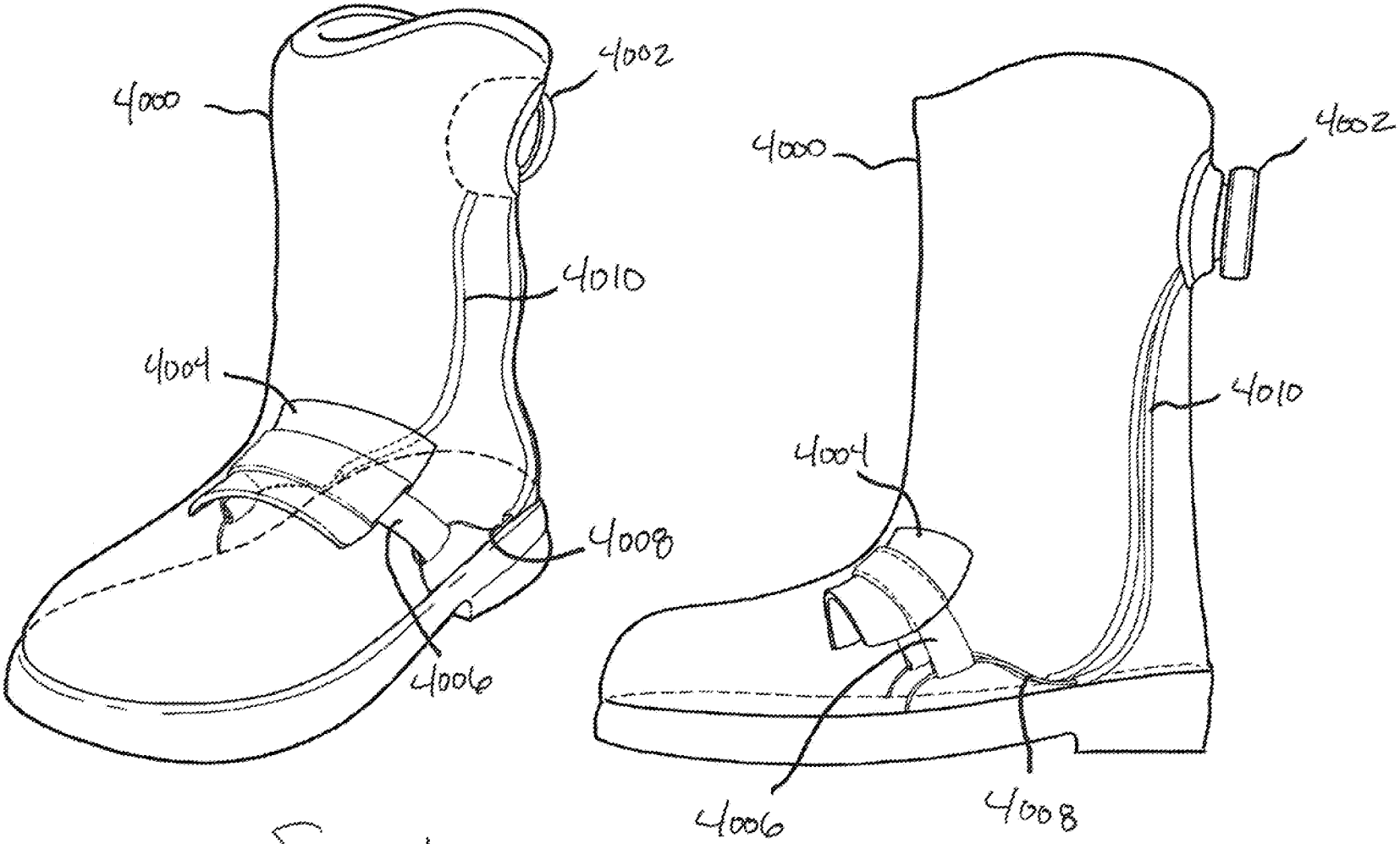

FIG. 40 shows a boot 4000 having a canopy member 4004 positioned over at least a portion of a foot section of the boot 4000. A strap 4006 may be positioned atop the canopy member 4004 and, upon tensioning, used to press or pull the canopy member 4004 downward toward the insole of the boot 4000. In some embodiments, the strap 4006 may pass through a channel in the canopy member 4004 such that an end of strap 4006 extends beyond each side of the canopy member 4004. Each end of the strap 4006 may include a loop of fabric or other guide through which a lace 4008 may pass. The lace 4008 may be tensioned by a reel based mechanism 4002 (hereinafter reel 4002) positioned on or within the boot 4000. The lace 4008 may be directed from the reel 4002 and about a lace path within the boot 4000 using one or more guides 4010. The lace 4008 may then pass through the loops in the strap 4006, and ends of the lace 4008 may be secured with an interior surface of the boot 4000. As the lace 4008 is tensioned, the ends of strap 4006 are pulled down toward the bottom of the boot 4000 to cause the canopy member 4004 to draw a user's foot toward the bottom and/or heel portion of the boot 4000.

Figure 41:
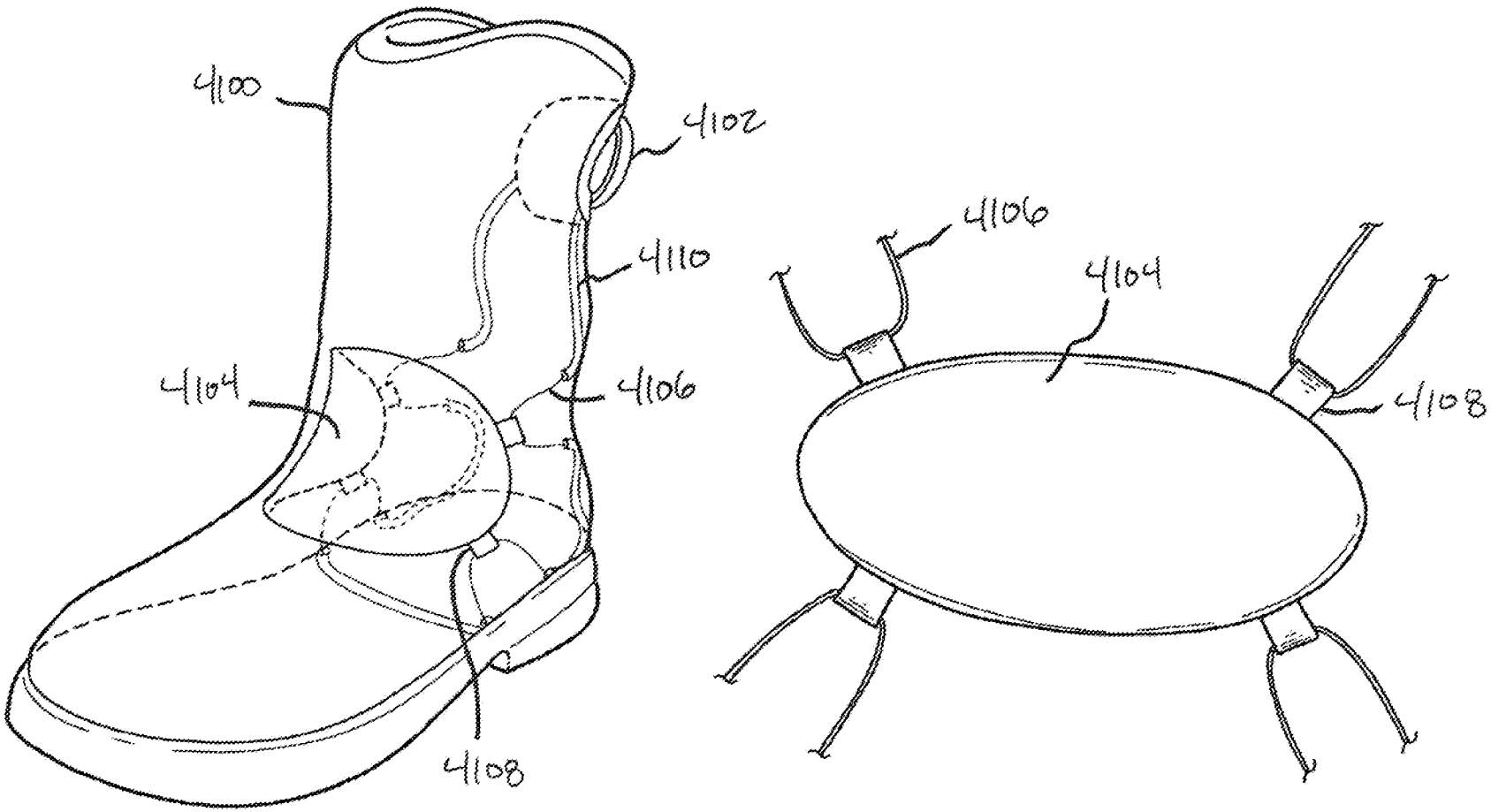

FIG. 41 depicts a boot 4100 having a canopy member 4104 positioned over at least a portion of a foot section of the boot 4100. The canopy member 4104 may include one or more guides or fabric loops 4108 through which a lace 4108 is inserted. In a specific embodiment, the canopy member 4104 may include four fabric loops 4108 positioned such that when the lace 4106 is tightened, the canopy member 4104 is drawn diagonally within the boot 4100 toward a back and heel portion of the boot 4100. As described herein, the lace 4106 may be tightened by a reel based mechanism 4102 positioned on or within the boot 4100. One or more guides 4110 may guide the lace 4106 about a lace path within the boot 4100.

Figure 42:
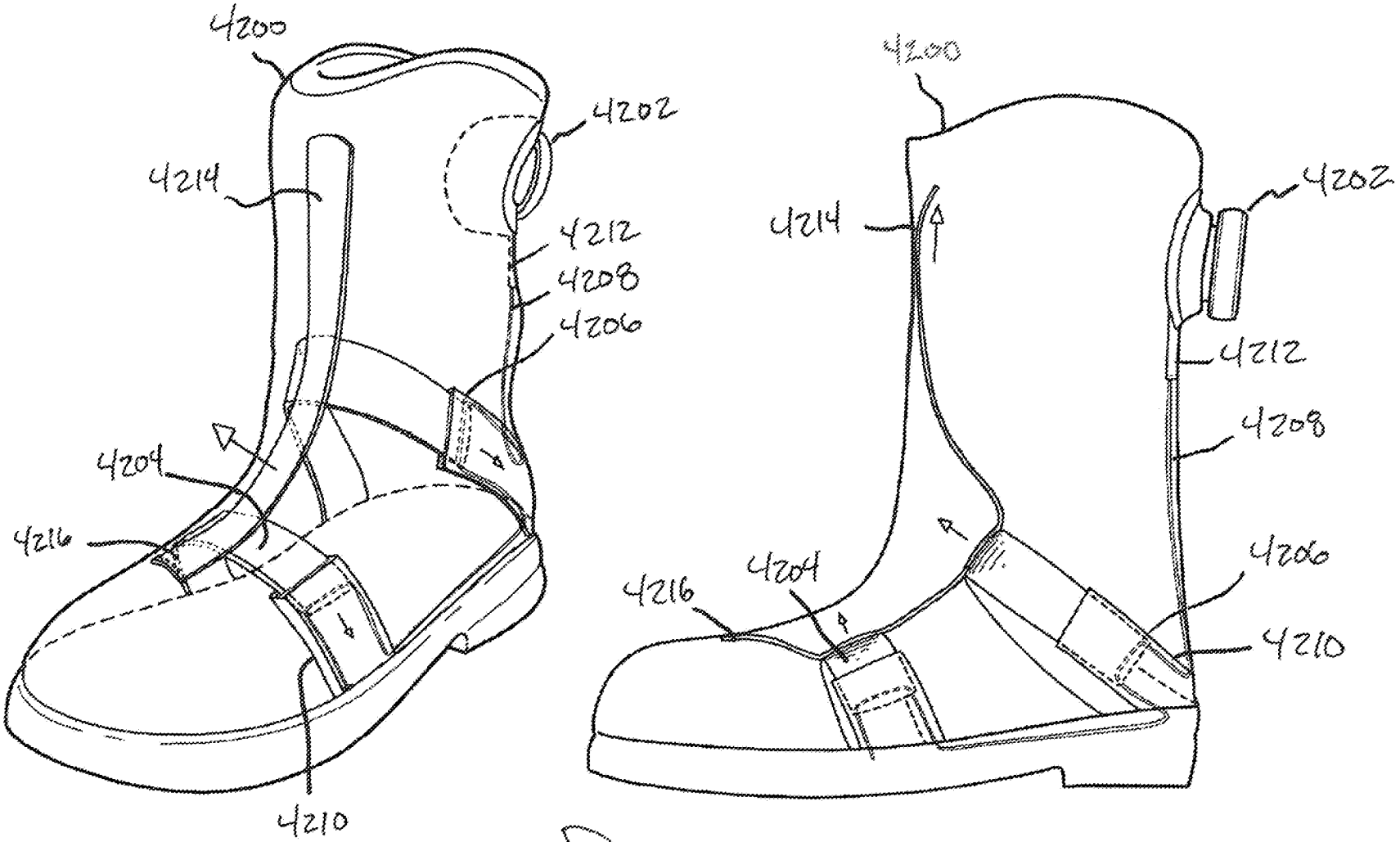
FIG. 42 illustrates a tightening system that employs one or more straps that engage a release or loosening mechanism.

FIG. 42 shows a boot 4200 having one or more straps 4204 positioned within an interior of the boot 4200. The straps 4204 may be positioned at a variety of positions within the boot 4200 including: near the forefoot, near the ankle, around the lower leg portion of the boot 4200, and the like. A first end, such as an inner end, of each strap 4204 may be fixed to an interior surface of boot 4200. The straps 4204 may include guides or loops 4206 that couple with and/or guide a lace 4208. The lace 4208 may be tensioned using a reel based mechanism 4202 that is positioned on or within the boot 4200. As the lace 4208 is tensioned, the loops 4206 are pulled toward the boot's insole, which pulls the straps 4204, or a liner of the boot 4200, downward and against a user's foot and/or leg. In some embodiments, each strap 4204, or a portion thereof, may be positioned within a sleeve 4210 that is secured to an inner surface of the boot 4200. As the lace 4208 is tensioned, the straps 4204 may be drawn within the sleeves 4210 to tighten the straps 4204 against a user's foot and/or leg. The sleeves 4210 may prevent or minimize contact between the lace 4208 and the user's foot or leg. In some embodiments, the boot 4200 may include one or more guides 4212 that direct the lace 4208 from the reel 4202 and about a lace path. The boot 4200 may further include a donning strap 4214 having a distal end 4216 that is coupled with an interior of the boot 4200 and a proximal end that is positioned near an opening of the boot 4200. The donning strap 4214 may be coupled with each strap 4204 such that when a user pulls on the proximal end of the donning strap 4214, each strap 4204 is loosened to make it easier for the user to place his or her foot in boot 4200.

Figure 43:
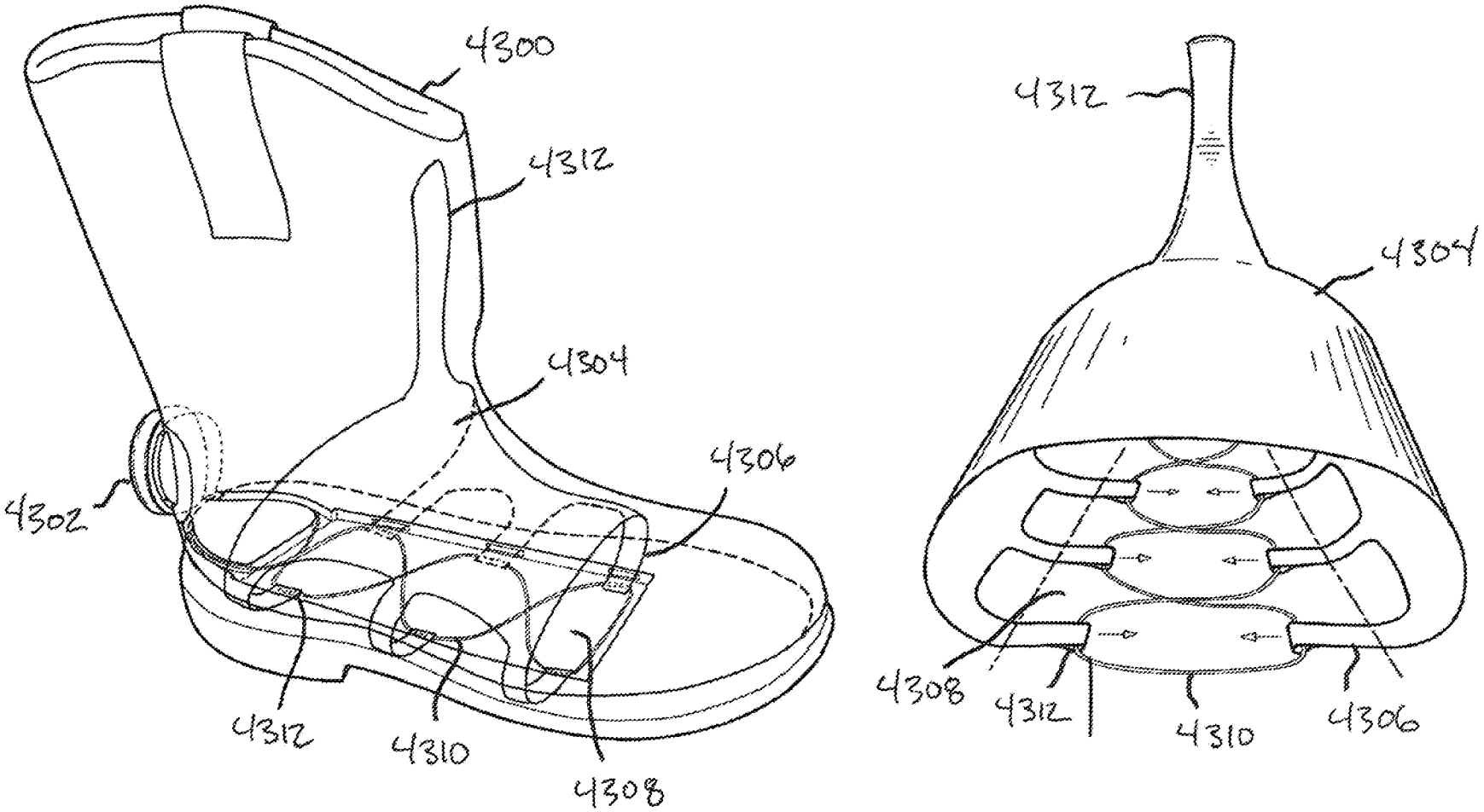
FIG. 43 illustrates an adjustable sleeve that is positionable within a boot's interior and operable to tighten about a user's foot.

FIG. 43 shows a boot 4300 that includes an adjustable sleeve 4304 positioned within the interior of the boot 4300. The sleeve 4304 may include multiple fingers 4306 extending from a bottom of the sleeve 4304. A bottom of the boot 4300 may include a channel 4308 that receives at least a portion of each finger 4306. The boot 4300 may also include a reel based mechanism 4302 that tensions a lace 4310. The lace 4310 may pass through a guide or loop 4312 on an end of each finger 4306 within the channel 4308. For example, the lace 4310 may pass through the ends of the fingers 4306 on opposing sides of the boot 4300. As the lace 4310 is tensioned, the fingers 4306 are pulled inward toward a center of the bottom of the boot 4300, causing a diameter of the sleeve 4304 to be reduced, thereby cinching or wrapping the sleeve 4304 about a wearer's foot. This cinching or wrapping may draw a wearer's foot toward a bottom of the boot 4300. A top of sleeve 4304 may further include a tab 4312 that a wearer may pull to loosen the sleeve 4304, making donning of the boot 4300 easier.

Figure 44:
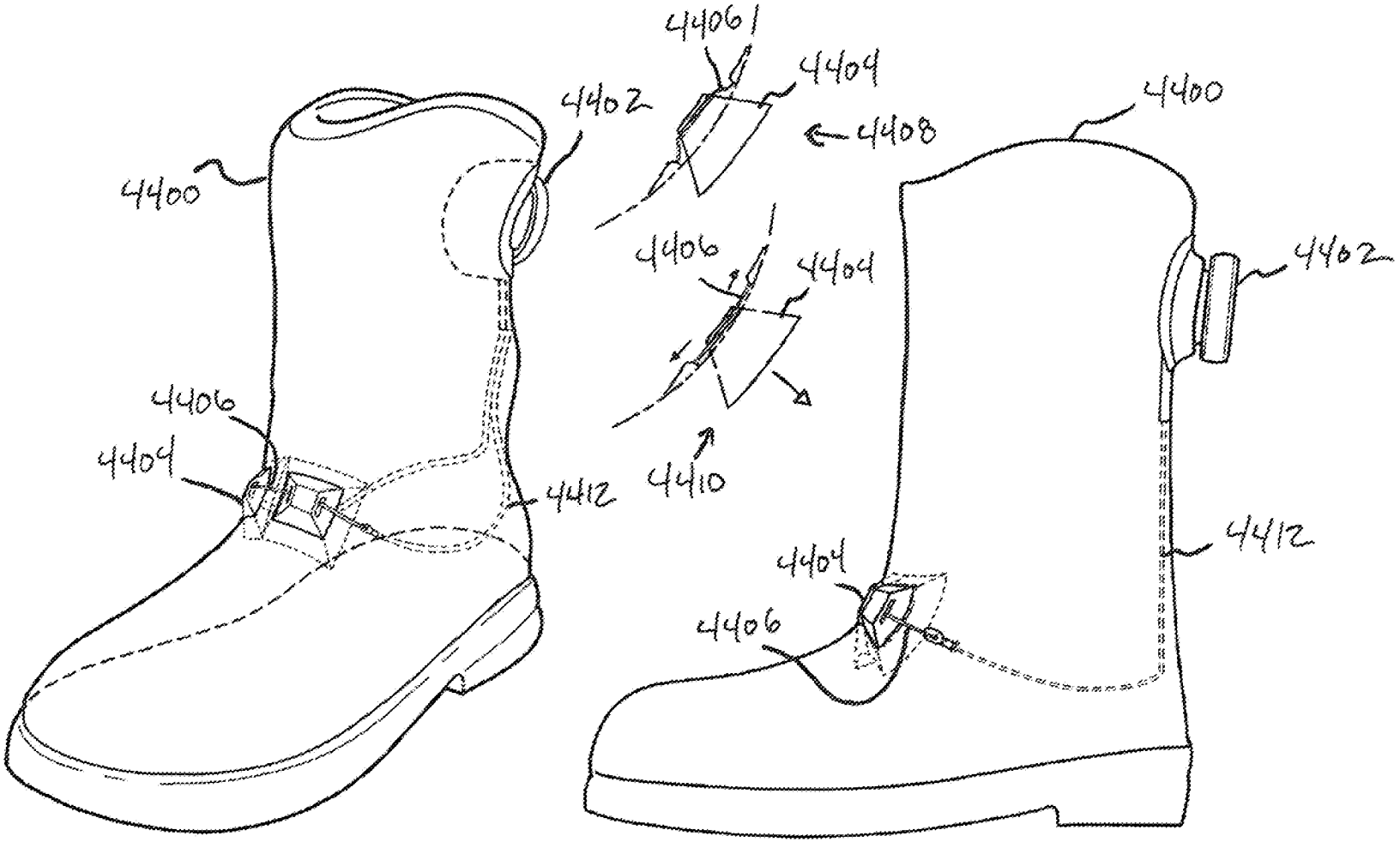
FIG. 44 illustrates a wedge or pad that extends into an interior of the boot and that is configured to apply pressure to a user's foot.

FIG. 44 shows a boot 4400 having one or more wedges or pads 4404 that extend into an interior of the boot 4400, such as through an outer surface of the boot 4400. Each pad 4404 may include a channel configured to receive a lace 4406. In a first position 4408, the channel and a top surface of the pad 4404 may be positioned above the surface of the boot 4400. The lace 4406 may be tensioned by a reel based mechanism 4402 to pull the channel and pad 4404 to a second position 4410 that is closer to the surface of the boot 4400, which causes a bottom surface of the pad 4404 to press against a wearer's foot. This may press the wearer's foot against the insole or heel portion of the boot 4400. In some embodiments, one or more guides 4412 may be included on the boot 4400 to direct the lace 4406 from the reel 4402 and along a lace path to the pads 4404.

Figure 45:
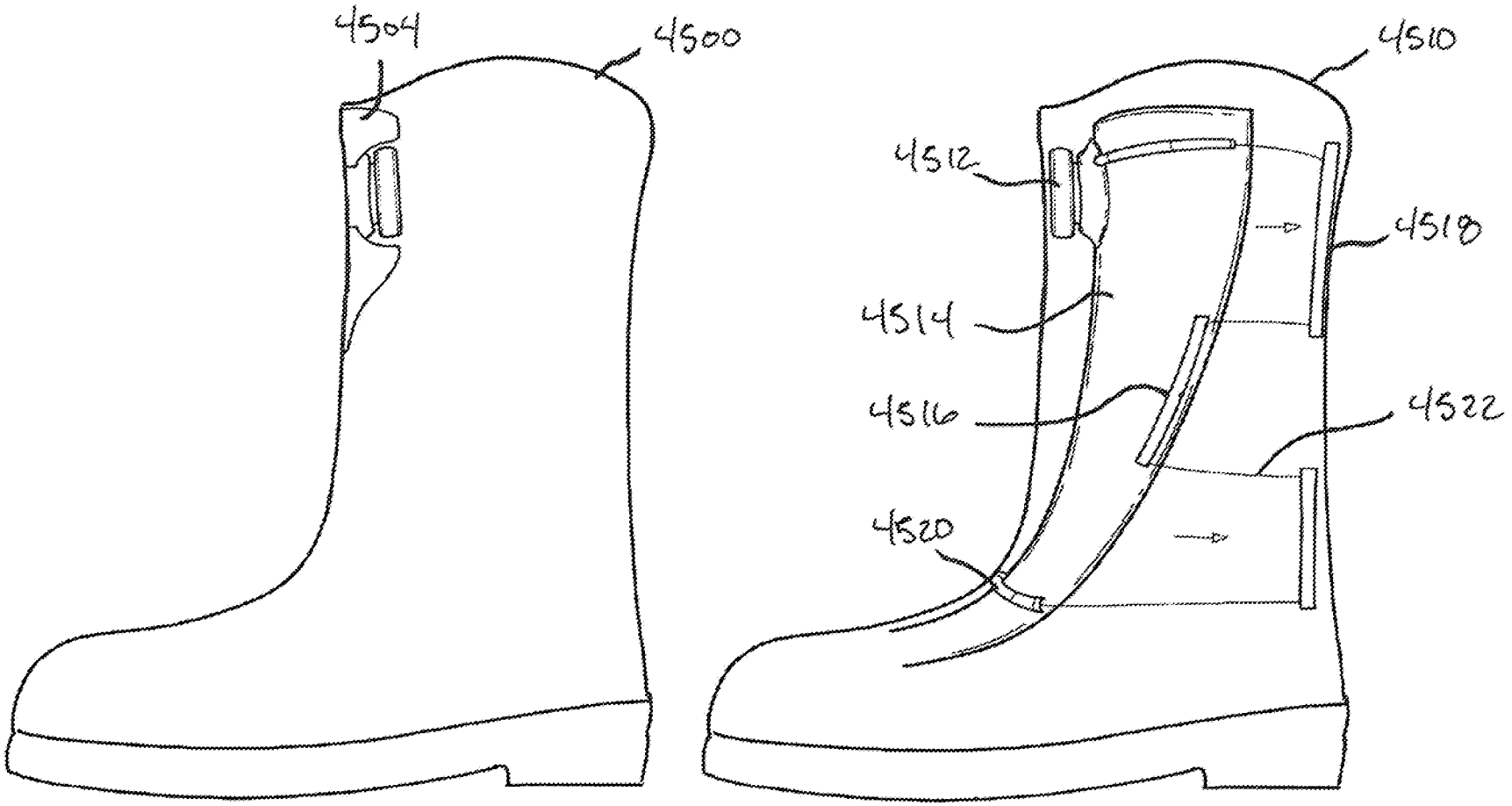
FIG. 45 illustrates an embodiment in which a reel based mechanism is positioned on a component of the boot to cause the component to contact and apply pressure to a user's foot and/or leg.

While many of the embodiments illustrate a reel based mechanism positioned on an exterior surface of a boot, in other embodiments the reel based mechanism may be positioned on an interior of the boot and/or hidden within the boot. For example, FIG. 45 depicts boots having a reel based mechanism 4502 positioned within the a boot's interior. The boot 4500 may include one or more members or pads 4504 that are positioned on one or more sides of the reel 4502 to prevent the reel 4502 from contacting a user's leg. In another embodiment, the boot 4510 includes an inner tongue 4514 having a base 4514 and one or more guides (4516, 4518, and 4520) as previously described. A reel based mechanism 4512 may be coupled with an upper portion of the inner tongue near an opening of the boot 4500 so as to be easily accessible by a user. The reel based mechanism 4512 may be operated to tension the lace 4522, which causes the inner tongue 4514 to be pressed against a wearer's leg. It will be appreciated that other configurations of guides and/or reels may be used to tighten a boot against a wearer's foot and/or leg.

In some embodiments, the reel based mechanism may be replaced by, or used in addition to, a pull cord mechanism, such as those described in U.S. patent application Ser. No. 14/166,799, filed Jan. 28, 2014, and entitled "Lace Fixation Assembly and System," and U.S. Patent Application No. 61/985,332, filed Apr. 28, 2014, also entitled "Lace Fixation Assembly and System," the entire disclosures of which are hereby incorporated by reference. Other lace tensioning systems may likewise be employed.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A boot comprising:

a sole;

an upper that is attached to the sole and configured to fit around a foot and a portion of a leg of a wearer;

a single canopy or panel that is positioned under the upper near an instep of the boot and that is configured to exert pressure on the wearer's foot in response to tensioning of the single canopy or panel, the single canopy or panel having a first end that is coupled with a first side of the boot and a second end that is positioned on an opposite side of the boot, the single canopy or panel also having a body portion that extends between the first end and the second end;

a tension member;

one or more guides that are coupled with the second end of the single canopy or panel and that are configured to guide the tension member about a path within the boot; and a tightening mechanism that is operably coupled with the tension member and that is configured to effect tensioning of the tension member upon operation of the tightening mechanism;

wherein the single canopy or panel is the only canopy or panel operably coupled with the tension member.

2. The boot of claim 1, wherein a proximal end of the tension member is coupled with the tightening mechanism and a distal end of the tension member is coupled with the boot.

3. The boot of claim 1, wherein the tightening mechanism is a reel based closure device.

4. The boot of claim 3, wherein the reel based closure device is positioned on a back shaft of the boot.

5. The boot of claim 4, wherein the tension member is routed from the reel based closure device to the one or more guides via tubing.

6. The boot of claim 1, wherein the boot includes one or more guides that are attached to the boot and that are configured to guide the tension member about a path such that the tension member is routed within the boot between the canopy or panel and the sole.

7. The boot of claim 1, wherein the single canopy or panel is configured to pull an inner shell of the boot into contact with the wearer's foot or leg.

8. A system for footwear about a wearer's foot, the system comprising;

a canopy or panel that is positionable under an upper of the footwear near an instep of the footwear, the canopy or panel having a fixed end that is coupleable with a first side of the footwear and a free end that is positionable on an opposite side of the footwear, the canopy or panel having a body portion that extends between the fixed end and the free end;

a tension member;

one or more guides that are coupled with the free end of the canopy or panel and that are configured to guide the tension member about a path within the footwear; and a tightening mechanism that is operably coupled with the tension member and that is configured to effect tensioning of the tension member upon operation of the tightening mechanism;

wherein the path of the tension member is routed only on one side of the footwear.

9. The system of claim 8, wherein when coupled with the footwear, a proximal end of the tension member is coupled with the tightening mechanism and a distal end of the tension member is coupled with the footwear.

10. The system of claim 8, wherein the tightening mechanism is a reel based closure device.

11. The system of claim 10, wherein the reel based closure device is configured for coupling with a rear surface of the footwear.

12. The system of claim 10, further comprising tubing that is configured to route the tension member from the reel based closure device to the one or more guides.

13. The system of claim 8, further comprising one or more guides that are attachable to the footwear and that are configured to guide the tension member about the path.

14. The system of claim 8, wherein the footwear is a boot or work shoe.

15. The system of claim 14, wherein the canopy or panel is configured to pull an inner shell of the boot into contact with the wearer's foot or leg.

16. A method of manufacturing footwear comprising:

providing the footwear;

positioning a canopy or panel under an upper of the footwear near an instep of the footwear and coupling a fixed end of the canopy or panel with a first side of the footwear, the canopy or panel having a free end that is positionable on an opposite side of the footwear and having a body portion that extends between the fixed end and the free end;

coupling one or more guides with the free end of the canopy or panel;

coupling one or more guides with the footwear;

coupling a tension member with the one or more guides of the canopy or panel and the one or more guides of the footwear so that the tension member is routed or guided about a path within the footwear; and coupling a tightening mechanism with the footwear, the tightening mechanism being operably coupled with the tension member and that being configured to effect tensioning of the tension member upon operation of the tightening mechanism;

wherein the path of the tension member is routed only on one side of the footwear.

17. The method of claim 16, further comprising coupling a distal end of the tension member with the footwear.

18. The method of claim 16, coupling the tightening mechanism with a rear surface of the footwear.

19. The method of claim 16, further comprising coupling tubing with the footwear to route the tension member from the tightening mechanism to the one or more guides of the canopy or panel.

20. The method of claim 16, wherein the footwear is a boot or work shoe.

* * * * *